US012630385B2

(12) United States Patent
Abe et al.

(10) Patent No.: US 12,630,385 B2
(45) Date of Patent: May 19, 2026

(54) MEDIUM PROCESSING APPARATUS AND IMAGE FORMING SYSTEM INCORPORATING SAME

(71) Applicants: Kohta Abe, Kanagawa (JP); Kei Sasaki, Kanagawa (JP); Keisuke Sugiyama, Kanagawa (JP); Kazuki Seto, Kanagawa (JP); Shohei Saito, Kanagawa (JP); Sachika Tamaki, Kanagawa (JP); Takashi Yamamoto, Kanagawa (JP)

(72) Inventors: Kohta Abe, Kanagawa (JP); Kei Sasaki, Kanagawa (JP); Keisuke Sugiyama, Kanagawa (JP); Kazuki Seto, Kanagawa (JP); Shohei Saito, Kanagawa (JP); Sachika Tamaki, Kanagawa (JP); Takashi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 18/584,866

(22) Filed: Feb. 22, 2024

(65) Prior Publication Data

US 2024/0300772 A1 Sep. 12, 2024

(30) Foreign Application Priority Data

Mar. 6, 2023 (JP) ..... 2023-034043
Jan. 23, 2024 (JP) ..... 2024-008331

(51) Int. Cl.
*B31F 5/02* (2006.01)
*B65H 37/04* (2006.01)

(52) U.S. Cl.
CPC ..... *B65H 37/04* (2013.01); *B65H 2301/5126* (2013.01); *B65H 2301/5162* (2013.01);
(Continued)

(58) Field of Classification Search
CPC .... B31F 5/00; B31F 5/02; B31F 5/022; B31F 5/025; B65H 37/04; B42C 1/12;
(Continued)

(56) References Cited

U.S. PATENT DOCUMENTS 10,406,772 B2 * 9/2019 Takahashi ..... B42C 1/12
11,981,529 B2 * 5/2024 Tsuruoka ..... G03G 15/6538
(Continued)

FOREIGN PATENT DOCUMENTS

EP 4300199 A1 1/2024
JP H90-104183 A 4/1997
(Continued)

OTHER PUBLICATIONS

Espacenet machine translation of JP2015101009A; https://translationportal.epo.org/emtp/translate/?ACTION=description-retrieval&COUNTRY=JP&ENGINE=google&FORMAT=docdb&KIND=A&LOCALE=en_EP&NUMBER=2015101009&OPS=ops.epo.org/3.2&SRCLANG=ja&TRGLANG=en (Year: 2015).*
(Continued)

*Primary Examiner* — Leslie A Nicholson, III
(74) *Attorney, Agent, or Firm* — Harness, Dickey & Pierce, P.L.C.

(57) ABSTRACT

A medium processing apparatus includes a liquid applier and a post-processing device. The liquid applier includes a liquid application member including a foam containable a liquid to apply the liquid to a liquid application region in a part of at least one medium of a bundle of media. The post-processing device performs a given process on a post-processing region in the part of at least one medium having the liquid application region on which the liquid is applied by the liquid applier. The liquid applier applies the liquid to the liquid application region overlapped with at least a part of the post-processing region.

18 Claims, 27 Drawing Sheets

(52) U.S. Cl.
CPC ..... *B65H 2406/21* (2013.01); *B65H 2801/06* (2013.01); *B65H 2801/24* (2013.01)

(58) Field of Classification Search
CPC ..... B42B 4/00; B42B 5/00; B41J 2/01; G03G 2215/0067; G03G 2215/00772; G03G 2215/00827; G03G 2215/00835; G03G 2215/00848; G03G 2215/00864; G03G 15/6544; G03G 15/6582
See application file for complete search history.

(56) References Cited

U.S. PATENT DOCUMENTS

| | | | | |
|---|---|---|---|---|
| 12,005,675 | B2 * | 6/2024 | Matsumoto | B31F 5/02 |
| 12,043,508 | B2 * | 7/2024 | Oikawa | B31F 1/36 |
| 2014/0219747 | A1 | 8/2014 | Takahashi et al. | |
| 2022/0394145 | A1 | 12/2022 | Seto et al. | |
| 2023/0234322 | A1 | 7/2023 | Fukuchi et al. | |
| 2023/0234804 | A1 | 7/2023 | Suzuki et al. | |
| 2023/0241859 | A1 | 8/2023 | Saito et al. | |
| 2023/0271804 | A1 | 8/2023 | Abe et al. | |
| 2023/0294950 | A1 | 9/2023 | Ibuka et al. | |
| 2023/0399191 | A1 | 12/2023 | Akamatsu et al. | |
| 2023/0416040 | A1 | 12/2023 | Sasaki et al. | |

FOREIGN PATENT DOCUMENTS

| | | | |
|---|---|---|---|
| JP | 2014-148398 | A | 8/2014 |
| JP | 2015-101009 | A | 6/2015 |
| JP | 2016-210555 | A | 12/2016 |
| JP | 2017-019592 | A | 1/2017 |
| JP | 2019-011174 | A | 1/2019 |
| JP | 2023-174594 | A | 12/2023 |
| WO | 2023/148689 | A1 | 8/2023 |

OTHER PUBLICATIONS

Extended European Search Report dated Jul. 18, 2024 issued in corresponding European Appln. No. 24160404.0.

* cited by examiner

MEDIUM PROCESSING APPARATUS AND IMAGE FORMING SYSTEM INCORPORATING SAME

CROSS-REFERENCE TO RELATED APPLICATIONS

This patent application is based on and claims priority pursuant to 35 U.S.C. § 119(a) to Japanese Patent Application Nos. 2023-034043, filed on Mar. 6, 2023, and 2024-008331, filed on Jan. 23, 2024, in the Japan Patent Office, the entire disclosure of each of which is hereby incorporated by reference herein.

BACKGROUND

Technical Field

Embodiments of the present disclosure relate to a medium processing apparatus and an image forming system incorporating the medium processing apparatus.

Background Art

Medium processing apparatuses are known in the art that perform binding to form a sheet bundle, which is a bundle of stacked sheet-shaped media on which images are formed. Some medium processing apparatuses are known in the art that perform binding without metal binding needles (i.e., staples) from a viewpoint of resource saving and reduction in environmental load. This binding operation is referred to as a "staple-less binding." A medium processing apparatus that executes staple-less binding includes serrated binding teeth.

The binding executable in the medium processing apparatus is so-called "crimp binding." The crimp binding sandwiches a sheet bundle with serrate binding teeth so that a part of the stacked media is pressed and deformed to crimp the stacked media.

When the crimp binding is performed, as the number of media of the sheet bundle increases, the degree of deformation due to application of pressure of the binding teeth against a portion of the sheet bundle decreases. When the degree of deformation decreases, the strength of crimping of the sheet bundle tends to decrease. Another medium processing apparatus is also known that includes a configuration in which, when performing crimp binding, a liquid is applied in advance to a portion of a medium of a sheet bundle, the portion to be pressed and deformed through contact (nipping) of the binding teeth, so that the binding teeth easily bites the sheet bundle.

Furthermore, to prevent deterioration in sheet quality when crimping the sheet bundle with a liquid applied in advance to a portion where the sheet bundle is pressed, a configuration is known that has a liquid supply hole in crimping teeth (binding teeth) for performing a crimp binding process on the sheet bundle and an implementation area of a liquid application process using the liquid supply hole, and the implementation area is wider than the crimping area using the crimping teeth.

SUMMARY

Embodiments of the present disclosure described herein provide a novel medium processing apparatus includes a liquid applier and a post-processing device. The liquid applier includes a liquid application member including a foam containable a liquid to apply the liquid to a liquid application region in a part of at least one medium of a bundle of media. The post-processing device performs a given process on a post-processing region in the part of at least one medium having the liquid application region on which the liquid is applied by the liquid applier. The liquid applier applies the liquid to the liquid application region overlapped with at least a part of the post-processing region.

Further, embodiments of the present disclosure described herein provide an image forming system including an image forming apparatus and the above-described medium processing apparatus. The image forming apparatus forms to form an image on a medium. The above-described medium processing apparatus binds media including the medium on which the image is formed by the image forming apparatus by pressing and deforming the media.

BRIEF DESCRIPTION OF THE SEVERAL VIEWS OF THE DRAWINGS

Exemplary embodiments of this disclosure will be described in detail based on the following figures, wherein.

Figure 1:
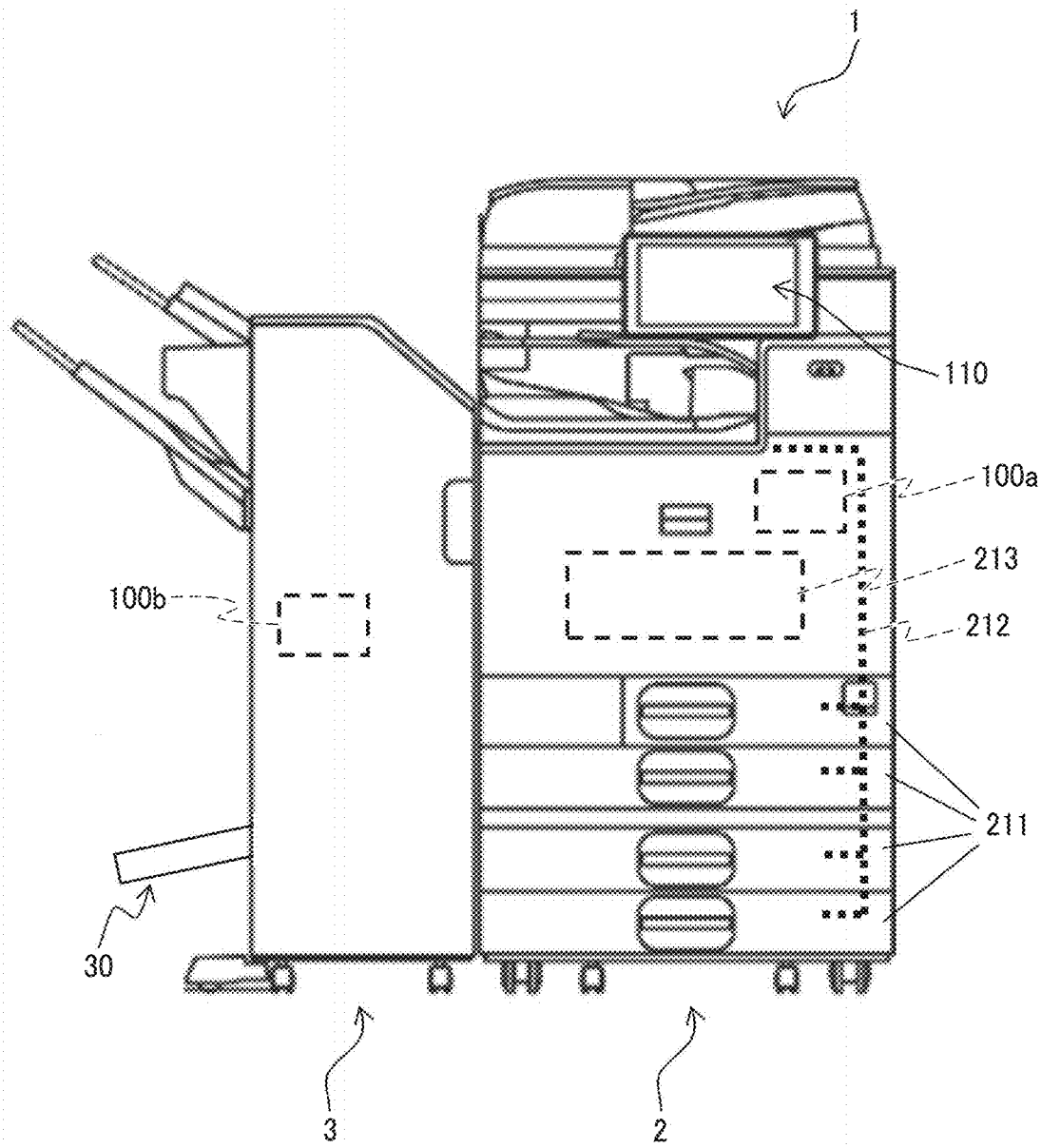
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present embodiment will be described below with the drawings.

Embodiment of Image Forming System 1

A description is given of an image forming system 1 according to an embodiment of the present disclosure, with reference to the drawings.

FIG. 1 is a diagram illustrating an overall configuration of the image forming system 1.

The image forming system 1 has a function of forming an image on a sheet P as a sheet medium and a function of performing a post-processing operation on the sheet P as a process after the image is formed on the sheet P. As illustrated in FIG. 1, the image forming system 1 includes an image forming apparatus 2 and a post-processing apparatus 3 serving as a medium processing apparatus according to an embodiment of the present disclosure. In the image forming system 1, the image forming apparatus 2 and the post-processing apparatus 3 operate in conjunction with each other.

In the present embodiment, the medium to be processed in the image forming system 1 is described on the assumption that the medium is a sheet of "paper". For example, any material or specification may be used as long as an image can be formed on a medium in a known image forming process and the medium is a target of a folding process or a binding process.

The image forming apparatus 2 forms an image on the sheet P and ejects the sheet P having the image to the post-processing apparatus 3. The image forming apparatus 2 includes an accommodation tray 211 that accommodates the sheet P, a conveyor 212 that conveys the sheet P accommodated in the accommodation tray 211, and an image former 213 that forms an image on the sheet P conveyed by the conveyor 212. The image former 213 may be an inkjet system that forms an image using ink or an electrophotographic system that forms an image using toner. The image forming apparatus 2 also includes a controller 100*a* that controls various operations of the conveyor 212 and the image former 213. Since the image forming apparatus 2 has a typical configuration, a detailed description of the configuration and functions of the image forming apparatus 2 are omitted.

Sheets of paper are widely known as an example of sheet-shaped media. Further, in the following description, a sheet-shaped medium as a medium to be processed is referred to as a "sheet P." Further, in the following description, a bundle of sheets of paper as a plurality of media is an example of a "sheet bundle Pb."

A description is given of the post-processing apparatus 3 according to a first embodiment of the present disclosure.

Figure 2:
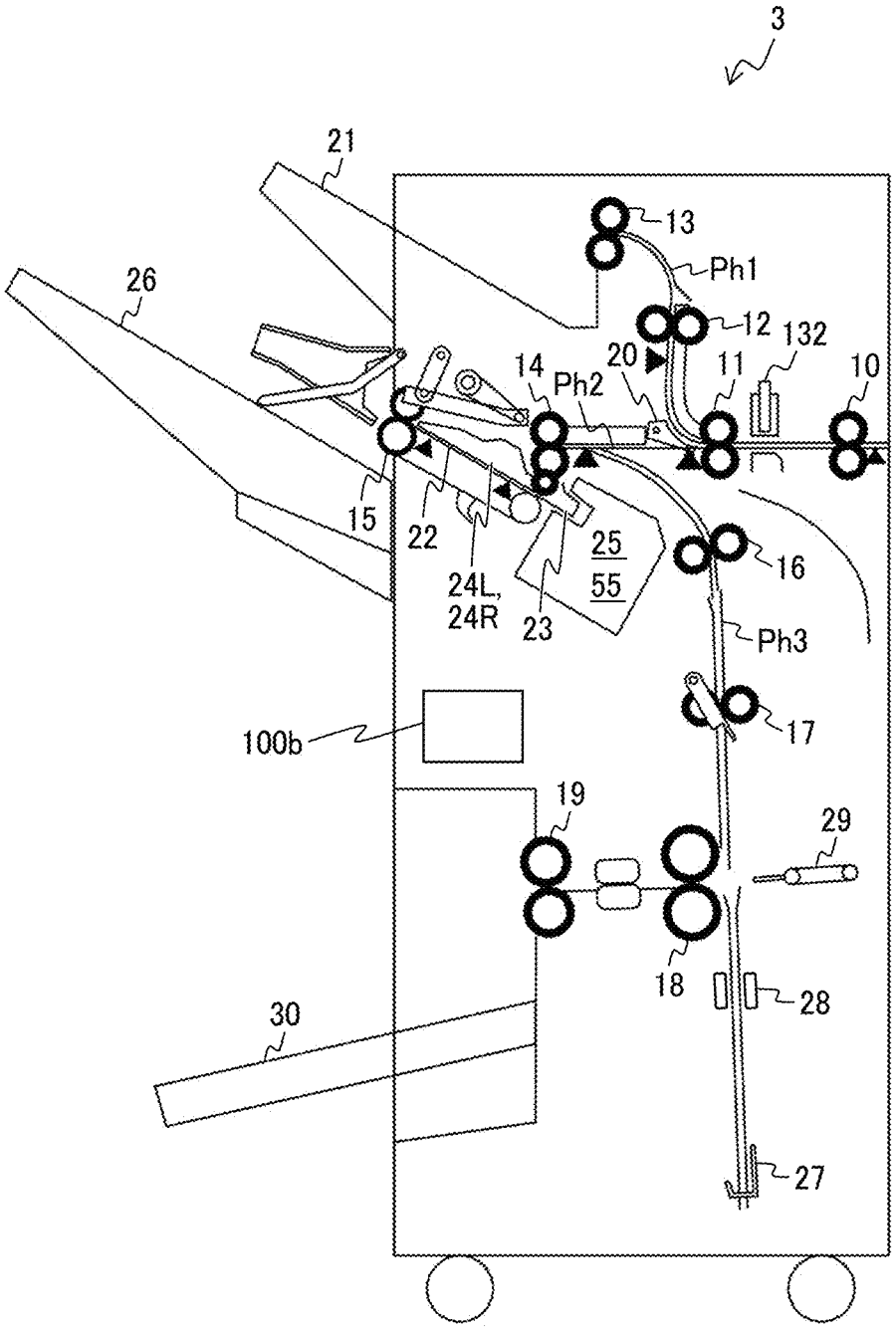
FIG. 2 is a diagram illustrating an internal configuration of a post-processing apparatus included in the image forming system of FIG. 1.

FIG. 2 is a diagram illustrating an internal configuration of the post-processing apparatus 3 included in the image forming system 1 of FIG. 1.

The post-processing apparatus 3 has a function that performs given post-processing on the sheet P on which an image is formed by the image forming apparatus 2. An example of the post-processing according to the present embodiment is a binding process as a "crimping process" that binds, without staples, a plurality of sheets P on each of which an image is formed as a bundle of sheets P, which may be referred to as a sheet bundle. Another example of the post-processing according to the present embodiment is a binding process as a "stapling process" that binds, with staples, a plurality of the sheets P on each of which an image is formed as a bundle of sheets P (i.e., sheet bundle).

In the following description, the bundle of sheets P may be referred to as a "sheet bundle Pb" as a bundle of media. In the present embodiment, a description is typically given of liquid application in a crimp binding process. However, the liquid application related to a stapling process is similar to the liquid application in the crimp binding process. In the following description, the term "binding process" indicates both the "crimp binding process" and the "stapling process", and is not limited to a binding method (whether a binding needle is used or a pressing and deforming process is performed).

More specifically, the "crimping process" according to the present embodiment is a process called "crimping" of applying pressure to a binding position corresponding to a part of sheets P of a sheet bundle Pb to deform (press and deform) the binding position to bind the sheet bundle Pb. The binding that can be executed by the post-processing apparatus 3 includes an edge binding process and a saddle binding process. The edge stitching process is a process to bind an edge of the sheet bundle Pb. The saddle binding process is a process to bind the center of the sheet bundle Pb.

The post-processing apparatus 3 includes the conveyance roller pairs 10 to 19 each functioning as a conveyor and the switching member 20. The conveyance roller pairs 10 to 19 convey, inside the post-processing apparatus 3, the sheet P supplied from the image forming apparatus 2. More specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3. A hole punch 132 is disposed between the conveyance roller pairs 10 and 11. The hole punch 132 performs punching on a sheet P conveyed by the conveyance roller pairs 10 and 11.

The first conveyance passage Ph1 is a passage extending to an ejection tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to an ejection tray 26 via an internal tray 22. The third conveyance passage Ph3 is a passage that branches off from the first conveyance passage Ph1 between the conveyance roller pairs 11 and 14 in the sheet conveyance direction and reaches to an ejection tray 30.

The switching members 20 each serving as a switcher are disposed at a branching position of the first conveyance passage Ph1 and the second conveyance passage Ph2.

Each of the switching members 20 can change the position between a first position and a second position. Each of the switching members 20 at the first position guides the sheet P to be ejected to the ejection tray 21 through the first conveyance passage Ph1. Each of the switching members 20 at the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in reverse to guide the sheet P to the third conveyance passage Ph3. The post-processing apparatus 3 further includes multiple sensors that detects the positions of the sheet P in the first conveyance passage Ph1, the second conveyance passage Ph2, and the third conveyance passage Ph3. Each of the multiple sensors is indicated by a black triangle in FIG. 2.

The post-processing apparatus 3 further includes the ejection tray 21. The sheet P that is ejected through the first conveyance passage Ph1 rests on the ejection tray 21. Among the sheets P supplied from the image forming apparatus 2, a sheet P not subjected to the binding process is ejected to the ejection tray 21.

The post-processing apparatus 3 further includes the internal tray 22 serving as a receptacle, an end fence 23, side fences 24L and 24R, an edge binder 25, a staple binder 55, and the ejection tray 26. The internal tray 22, the end fence 23, the side fences 24L and 24R, the edge binder 25, and the staple binder 55 perform the edge binding on the sheet bundle Pb of a plurality of sheets P conveyed to the internal tray 22 from the second conveyance passage Ph2. Among the sheets P supplied from the image forming apparatus 2, the sheet bundle Pb subjected to the edge binding is output to the ejection tray 26.

The "edge binding process" includes "parallel binding process," "oblique binding process," and "vertical binding process." The "parallel binding process" is a process of binding the sheet bundle Pb along one side of the sheet bundle Pb parallel to the main scanning direction. The "oblique binding process" is a process of binding a corner of the sheet bundle Pb. The "vertical binding process" is a process of binding the sheet bundle Pb along one side of the sheet bundle Pb parallel to the conveyance direction.

In the following description, the direction in which the sheet P is conveyed from the conveyance roller pair 15 toward the end fence 23 is defined as a "conveyance direction" of the sheet P. In other words, the "conveyance direction" herein corresponds to a direction in which the sheet P that has been output from the image forming apparatus 2 is moved toward the ejection tray 26 by, for example, the conveyance roller pair 10 and then is moved toward the end fence 23 by the conveyance roller pair 15. The direction that is orthogonal to the conveyance direction and a thickness direction of the sheet P is defined as a "main scanning direction" or a "width direction of the sheet P."

The sheets P that are sequentially conveyed through the second conveyance passage Ph2 are temporarily placed on the internal tray 22 serving as a placement tray. The end fence 23 aligns the position, in the conveyance direction, of the sheet P or the sheet bundle Pb placed on the internal tray 22. The side fences 24L and 24R align the position, in the main scanning direction, of the sheet P or the sheet bundle Pb placed on the internal tray 22. The edge binder 25 and the staple binder 55 bind an end of the sheet bundle Pb aligned by the end fence 23 and the side fences 24L and 24R. Then, the conveyance roller pair 15 ejects the sheet bundle Pb subjected to the edge binding to the ejection tray 26.

A detailed description is given of the edge binder 25 according to an embodiment of the present disclosure.

Figure 3:
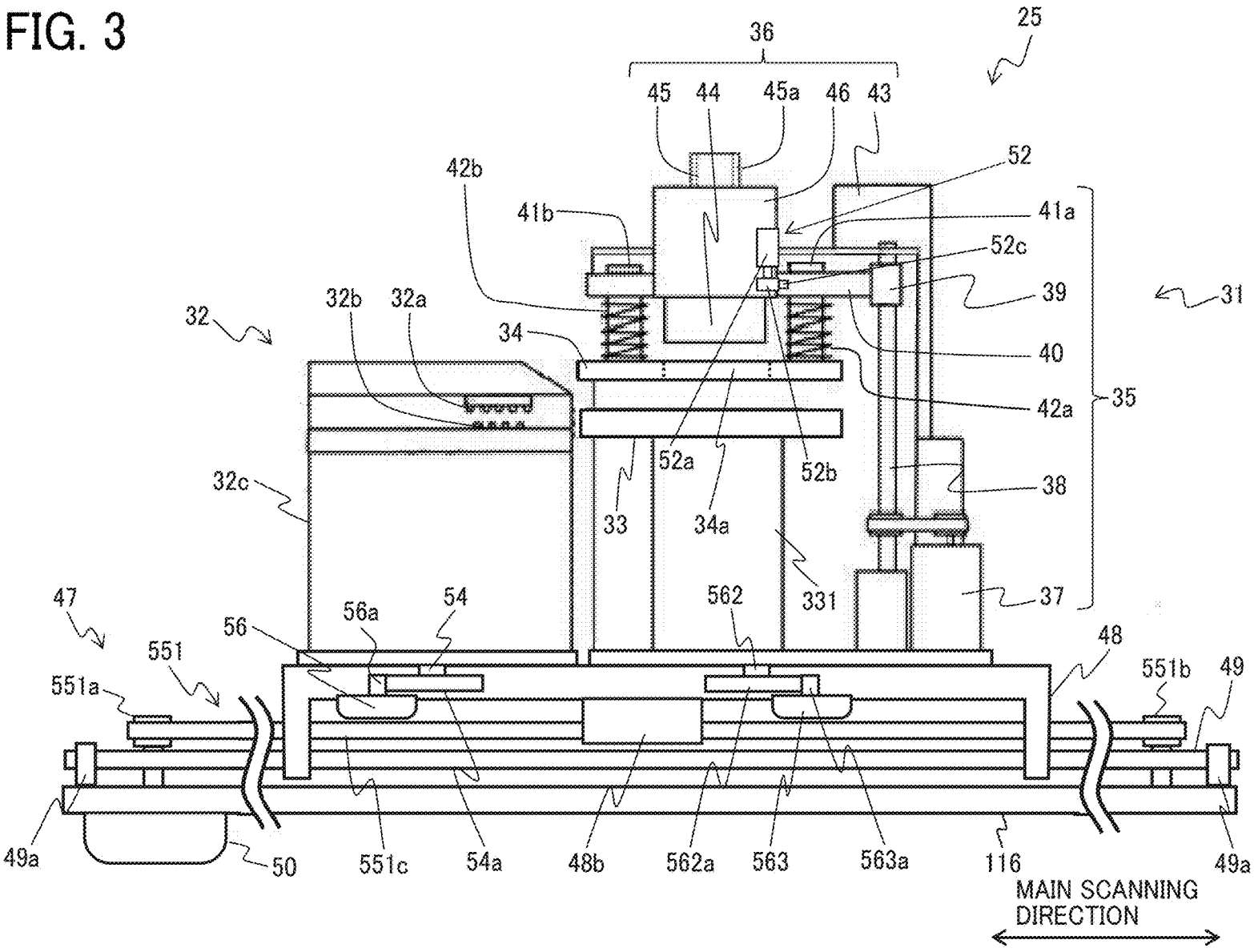
FIG. 3 is a schematic diagram illustrating an upstream side of an edge binder of the post-processing apparatus of FIG. 2 in a conveyance direction.

FIG. 3 is a schematic diagram illustrating an upstream side of the edge binder 25 in the conveyance direction.

The edge binder 25 performs liquid application and crimp binding illustrated in FIG. 2.

Figure 4:
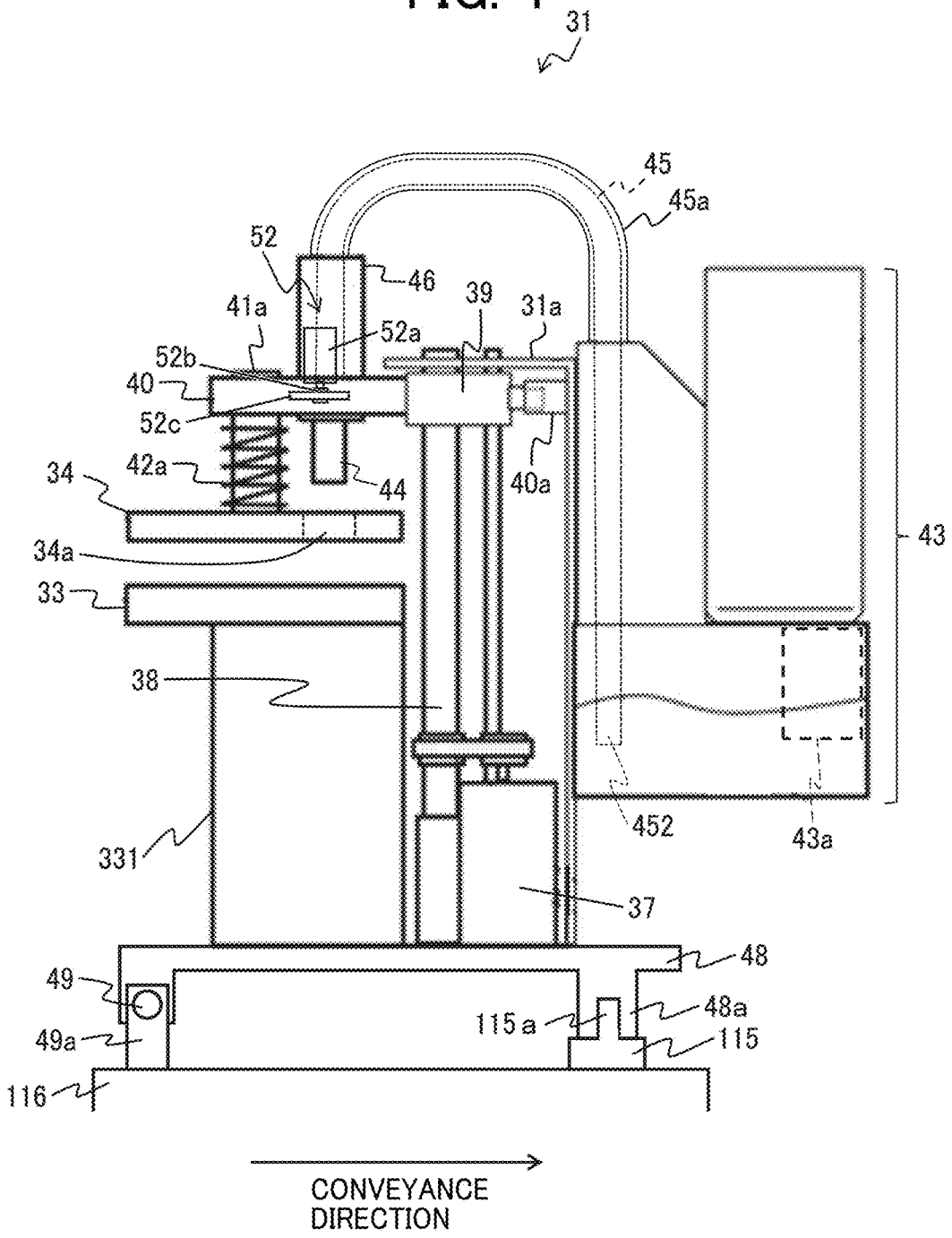
FIG. 4 is a schematic diagram illustrating a liquid applier of the edge binder of FIG. 3 in a main scanning direction.

FIG. 4 is a schematic diagram illustrating a liquid applier 31 of the edge binder 25 when viewed from the main scanning direction.

As illustrated in FIG. 3, the edge binder 25 includes the liquid applier 31 and a crimper 32. The liquid applier 31 executes a liquid application process. The crimper 32 serves as a post-processing device and executes a crimping process. The liquid applier 31 and the crimper 32 are disposed downstream from the internal tray 22 in the conveyance direction and adjacent to each other in the main scanning direction.

The liquid applier 31 applies liquid that is stored in a first liquid storage tank 43 serving as a first liquid storage to the sheet P or the sheet bundle Pb placed on the internal tray 22. The application of the liquid to the sheet P or the sheet bundle Pb by the liquid applier 31 and the operation of the liquid applier 31 in applying the liquid are referred to as "liquid application" below. The liquid applying operation of the liquid applier 31 involving control processing is referred to as a "liquid application process".

More specifically, the liquid that is stored in the first liquid storage tank 43 as liquid for the "liquid application" includes, as a main component, the liquid state of a compound of hydrogen and oxygen compound represented by the chemical formula $H_2O$. The liquid hydrogen-oxygen compound is at any temperature. For example, the liquid hydrogen-oxygen compound may be so-called warm water or hot water. The liquid hydrogen-oxygen compound is not limited to pure water. The liquid hydrogen-oxygen compound may be purified water or may contain ionized salts. The metal ion content ranges from so-called soft water to ultrahard water. In other words, the liquid hydrogen-oxygen compound is at any hardness.

The liquid that is stored in the first liquid storage tank 43 may include an additive in addition to the main component. The liquid that is stored in the first liquid storage tank 43 may include residual chlorine used as tap water. Preferably, for example, the liquid that is stored in the first liquid storage tank 43 may include, as an additive, a colorant, a penetrant, a pH adjuster, a preservative such as phenoxyethanol, a drying inhibitor such as glycerin, or a combination thereof. Furthermore, because water is used as a component of ink used for inkjet printers or ink used for water-based pens, such water or ink may be used for the "liquid application".

The water is not limited to the specific examples described above. The water may be water in a broad sense such as hypochlorous acid water or an ethanol aqueous solution diluted for disinfection. However, tap water may be used simply to enhance the binding strength after the binding process because tap water is easy to obtain and store. A liquid including water as a main component as exemplified above enhances the binding strength of the sheet bundle Pb, in comparison with a liquid of which the main component is not water.

As illustrated in FIGS. 3 and 4, the liquid applier 31 is movable in the main scanning direction together with the crimper 32 by a driving force transmitted from an edge binder movement motor 50. The liquid applier 31 includes a lower pressure plate 33 serving as a receptacle for the sheet P or the sheet bundle Pb, an upper pressure plate 34, a liquid applier movement assembly 35, and a liquid application assembly 36. The components of the liquid applier 31 such as the lower pressure plate 33, the upper pressure plate 34, the liquid applier movement assembly 35, the liquid application assembly 36, and the liquid applier movement motor 37 are held by a liquid application frame 31*a* and a base 48.

A liquid applier shaft 562 including a drive transmission gear 562*a* is fixed to a bottom face of the liquid application frame 31*a* that holds the components of the liquid applier 31. The liquid applier shaft 562 and the drive transmission gear 562*a* are held by the base 48 on which the liquid application frame 31*a* is disposed, so as to be rotatable in the forward and reverse directions. The drive transmission gear 562*a* meshes with an output gear 563*a* of a liquid applier pivot motor 563. The liquid applier 31 can be rotated in the forward and reverse directions about the liquid applier shaft 562 on the base 48 by a driving force transmitted from the liquid applier pivot motor 563 to the liquid applier shaft 562 via the output gear 563*a* and the drive transmission gear 562*a*.

The lower pressure plate 33 and the upper pressure plate 34 are disposed downstream from the internal tray 22 in the conveyance direction. The sheets P or the sheet bundle Pb that is placed on the internal tray 22 is also placed on the lower pressure plate 33. The lower pressure plate 33 is provided on a lower pressure plate holder 331. The upper pressure plate 34 is movable in the thickness direction of the sheet P or the sheet bundle Pb at a position where the upper pressure plate 34 faces the sheet P or the sheet bundle Pb placed on the internal tray 22.

In other words, the lower pressure plate 33 and the upper pressure plate 34 are disposed to face each other in the thickness direction of the sheet P or the sheet bundle Pb with the sheet P or the sheet bundle Pb placed on the internal tray 22 and interposed between the lower pressure plate 33 and the upper pressure plate 34. In the following description, the thickness direction of the sheet P or the sheet bundle Pb may be referred to simply as "thickness direction." Further, the upper pressure plate 34 has a through hole 34*a* penetrating in the thickness direction at a position facing the liquid application member 44 (one end portion of a liquid supply member 45 (liquid absorber) to be described later, which corresponds to a tip portion) held via a joint 46 attached to a base plate 40.

The liquid applier movement assembly 35 moves the upper pressure plate 34, the base plate 40, a joint 46, and the liquid application member 44 in the thickness direction of the sheet P or the sheet bundle Pb. The liquid applier movement assembly 35 according to the present embodiment moves the upper pressure plate 34, the base plate 40, the joint 46, and the liquid application member 44 in conjunction with each other with a single liquid applier movement motor 37. The liquid applier movement assembly 35 includes, for example, a liquid applier movement motor 37, a trapezoidal screw 38, a nut 39, the base plate 40, columns 41*a* and 41*b*, and coil springs 42*a* and 42*b*.

The liquid applier movement motor 37 generates driving force to move the upper pressure plate 34, the base plate 40, the joint 46, and the liquid application member 44. The trapezoidal screw 38 extends in the thickness direction of the sheet P or the sheet bundle Pb and is supported to the liquid application frame 31*a* such that the trapezoidal screw 38 is rotatable in the forward and reverse directions. The trapezoidal screw 38 is coupled to an output shaft of the liquid applier movement motor 37 via, for example, a pulley and a belt. The nut 39 is screwed to the trapezoidal screw 38. The trapezoidal screw 38 is rotated in the forward and reverse directions by the driving force transmitted from the liquid applier movement motor 37. The rotation of the trapezoidal screw 38 causes the nut 39 to reciprocate on the trapezoidal screw 38.

The base plate 40 is positioned apart from the upper pressure plate 34. The base plate 40 holds the liquid application member 44 with the tip portion of the liquid application member 44 protruding from the base plate 40 toward the upper pressure plate 34. The base plate 40 is coupled to the trapezoidal screw 38 via the nut 39 such that base plate 40 can reciprocate along the trapezoidal screw 38 as the trapezoidal screw 38 rotates in the forward and reverse directions. The position of the base plate 40 in the vertical direction is detected by a movement sensor 40*a* (see FIG. 8).

The columns 41*a* and 41*b* project from the base plate 40 toward the upper pressure plate 34 around the tip portion of the liquid application member 44. The columns 41*a* and 41*b* can relatively move with respect to the base plate 40 in the thickness direction. The columns 41*a* and 41*b* hold the upper pressure plate 34 with the respective tip ends closer to the lower pressure plate 33 than the other ends of the columns 41*a* and 41. The other ends of the columns 41*a* and 41 opposite the ends closer to the lower pressure plate 33 are provided with stoppers that prevent the columns 41*a* and 41*b* from being removed from the base plate 40.

The coil springs 42*a* and 42*b* are fitted around the columns 41*a* and 41*b*, respectively, between the base plate 40 and the upper pressure plate 34. The coil springs 42*a* and 42*b* bias the upper pressure plate 34 and the columns 41*a* and 41*b* toward the lower pressure plate 33 with respect to the base plate 40.

The liquid application assembly 36 applies liquid to the sheet P or the sheet bundle Pb placed on the internal tray 22. Specifically, the liquid application assembly 36 brings the liquid application member 44 into contact with the sheet P or the sheet bundle Pb to apply the liquid to at least one sheet P of the sheet bundle Pb.

The liquid application assembly 36 includes the liquid application member 44, the liquid supply member 45, the first liquid storage tank 43, and the joint 46.

The first liquid storage tank 43 stores the liquid to be supplied to the sheet P or the sheet bundle Pb. The liquid stored in the first liquid storage tank 43 is detected by a liquid amount sensor 43*a* serving as a first liquid detector.

The liquid application member 44 applies the liquid stored in the first liquid storage tank 43 to the sheet P or the sheet bundle Pb. The liquid application member 44 is held by the base plate 40 with the tip portion of the liquid application member 44 facing the upper pressure plate 34. Further, the liquid application member 44 includes a material having a relatively high liquid absorption. For example, the liquid application member 44 includes an open cell foam that can contain liquid. The liquid application member 44 is not limited to a particular kind as long as the liquid application member 44 is made of a material having a property of absorbing and holding the liquid and has a property of being crushable in accordance with a pressing force applied when the liquid application member 44 is in contact with the sheet P. The pressing force corresponds to an amount of movement of the liquid application member 44 to the sheet P (or the sheet bundle Pb). For example, the liquid application member 44 may be a foam material such as a sponge or a fiber material that can absorb liquid by capillary action.

The liquid supply member 45 (liquid absorber) is an elongated member having an immersion portion 452 at a base end (proximal end) immersed in the liquid stored in the first liquid storage tank 43 and a tip end (distal end) coupled to the liquid application member 44. Like the liquid application member 44, for example, the liquid supply member 45 is made of a material having a relatively high liquid absorption. As a result, the liquid absorbed from the immersion portion 452 of the liquid supply member 45 is supplied to the liquid application member 44 by the capillary action. In other words, the liquid stored in the first liquid storage tank 43 is sucked up from the immersion portion 452 of the liquid supply member 45, and the sucked liquid is supplied to the liquid application member 44 that is coupled to the tip portion via the liquid supply member 45.

As described above, the liquid sucked up from the immersion portion 452 of the liquid supply member 45 is supplied to the liquid application member 44 through the liquid supply member 45, and the liquid application member 44 contacts the upper face of an uppermost sheet of the sheets P or the sheet bundle Pb to apply the liquid. For this reason, the liquid application member 44 is supported by the base plate 40 with the tip portion of the liquid application member 44 facing downward.

Although the case where the liquid supply member 45 and the liquid application member 44 are separate bodies has been described above, the liquid supply member 45 and the liquid application member 44 may be a unified body formed of a material having a high liquid absorption rate. In other words, the liquid application member 44 may be part of the liquid supply member 45. In such a case, liquid can be supplied from the liquid supply member 45 to the liquid application member 44 more smoothly by the capillary action.

A protector 45*a* is an elongated cylindrical body (e.g., a tube) that is fitted around the liquid supply member 45. Such a configuration prevents the liquid absorbed by the liquid supply member 45 from leaking or evaporating. Each of the liquid supply member 45 and the protector 45*a* is made of a flexible material. The joint 46 holds a part of a liquid application member position adjuster 52 to be described below and the liquid application member 44, and is movably disposed relative to the base plate 40 in the conveyance direction of the sheet P or the sheet bundle Pb alone. Accordingly, even when the liquid application member 44 is moved by the liquid applier movement assembly 35 in a direction orthogonal to the conveyance direction and the main scanning direction, the liquid application member 44 keeps projecting from the base plate 40 toward the upper pressure plate 34 with the tip portion of the liquid application member 44 facing the upper pressure plate 34.

In the liquid application process, the controller 100 controls the amount of movement (pressing amount) of the liquid application member 44 to the sheet P or the sheet bundle Pb by controlling the amount of driving force of the liquid applier movement motor 37. By controlling the amount of movement of the liquid application member 44 relative to the sheet P or the sheet bundle Pb, the size of the area (contact area) where the liquid application member 44 contacts the sheet P or the sheet bundle Pb or the contact time (contact time) is adjusted. By so doing, the amount of liquid applied to the sheet P or the sheet bundle Pb in the liquid application process and the spread of the liquid can be adjusted.

As illustrated in FIGS. 3 and 4, the liquid applier 31 further includes a liquid application member position adjuster 52 that adjusts a liquid application position by the liquid application member 44 in the liquid application process. The liquid application member position adjuster 52 includes a liquid applier positional adjustment motor 52*a*, a pinion gear 52*b*, and a rack 52*c*. The pinion gear 52*b* is driven by the liquid applier positional adjustment motor 52*a*. The rack 52*c* meshes with the pinion gear 52*b*. The liquid applier positional adjustment motor 52*a* and the pinion gear 52*b* are disposed to the joint 46 as described above. On the other hand, the rack 52*c* is fixed to the base plate 40. By controlling the amount of driving force of the liquid applier positional adjustment motor 52*a*, the position (liquid application position) at which the liquid application member 44 contacts the sheet P of the sheet bundle Pb can be adjusted. In other words, when the liquid applier positional adjustment motor 52*a* drives the liquid application member 44 and the joint 46 holding the liquid application member 44, the liquid application member 44 and the joint 46 can move in the conveyance direction of the sheet P. The liquid application member 44 is movable in the main scanning direction along driving of the edge binder movement motor 50. As a result, the liquid application member 44 can appropriately apply liquid to the liquid application position (that corresponds to the binding position) of the sheets P included in the sheet bundle Pb to be bound, in accordance with the binding position of the sheet bundle Pb on which the crimper 32 performs the binding process.

A description is given of the configuration of the crimper 32 according to an embodiment of the present disclosure.

The crimper 32 serving as a post-processing device presses and deforms a portion of the sheet bundle Pb by serrated upper crimping teeth 32*a* and lower crimping teeth 32*b*, and crimps the sheets P of the portion to bind the sheet bundle Pb. In other words, the crimper 32 binds the sheet bundle Pb without staples. The components of the crimper 32 such as a post-processing unit including the upper crimping teeth 32*a* and the lower crimping teeth 32*b* are disposed on a crimping frame 32*c*. In the following description, such a way of pressing and deforming a given position on the sheet bundle Pb to bind the sheet bundle Pb may be referred to as "crimp binding." In other words, the crimper 32 crimps and binds the sheet bundle Pb or performs the crimp binding on the sheet bundle Pb. The crimping and binding operation of the crimper 32 that involves control processing is referred to as "crimp binding process".

Figure 5A:
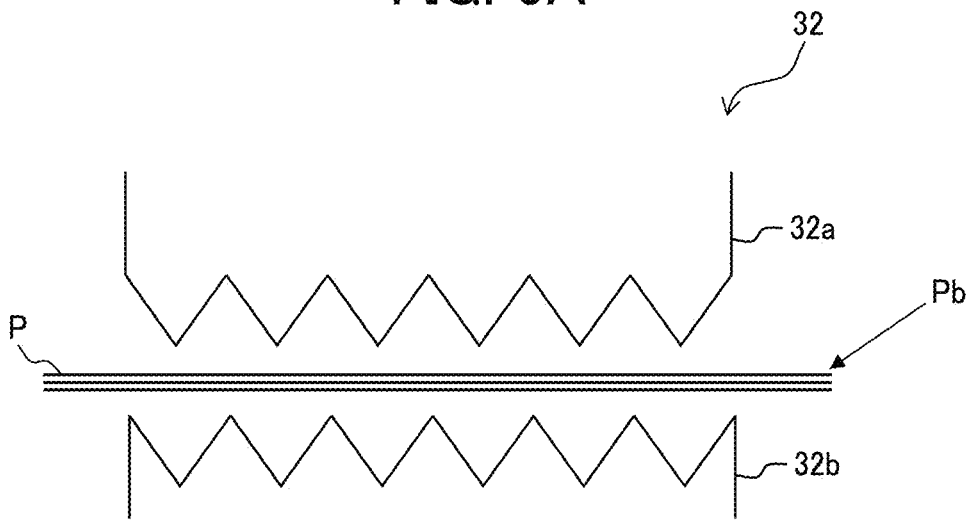
FIGS. 5A and 5B are schematic diagrams each illustrating a configuration of a crimper of the edge binder of FIG. 3.
Figure 5B:
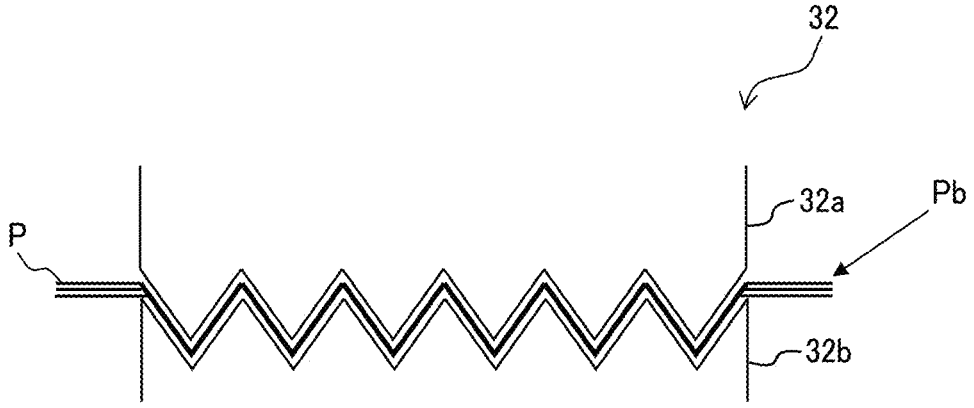

FIGS. 5A and 5B are schematic diagrams illustrating the configuration of the crimper 32.

As illustrated in FIGS. 5A and 5B, the crimper 32 includes the upper crimping teeth 32*a* and the lower crimping teeth 32*b*. The upper crimping teeth 32*a* and the lower crimping teeth 32*b* are disposed to face each other in the thickness direction of the sheet bundle Pb to sandwich the sheet bundle Pb placed on the internal tray 22. The upper crimping teeth 32*a* and the lower crimping teeth 32*b* have respective serrate faces facing each other. The serrate face of each of the upper crimping teeth 32*a* and the lower crimping teeth 32*b* includes concave portions and convex portions alternately formed. The concave portions and the convex portions of the upper crimping teeth 32*a* are shifted from those of the lower crimping teeth 32*b* such that the upper crimping teeth 32*a* are engaged with the lower crimping teeth 32*b*. The upper crimping teeth 32*a* and the lower crimping teeth 32*b* are brought into contact with and separated from each other by the driving force of a contact-separation motor 32*d* illustrated in FIG. 8.

In the process of supplying the sheets P of the sheet bundle Pb to the internal tray 22, the upper crimping teeth 32*a* and the lower crimping teeth 32*b* are separated from each other as illustrated in FIG. 5A. When all the sheets P of the sheet bundle Pb are placed on the internal tray 22, the upper crimping teeth 32*a* and the lower crimping teeth 32*b* are engaged with each other as illustrated in FIG. 5B by the driving force of the contact-separation motor 32*d* to press and deform the sheet bundle Pb in the thickness direction. As a result, the sheet bundle Pb that has been placed on the internal tray 22 is crimped and bound. The sheet bundle Pb thus crimped and bound is ejected to the ejection tray 26 by the conveyance roller pair 15.

The configuration of the crimper 32 as a crimping assembly is not limited to the configuration of a moving assembly exemplified in the present embodiment, and may be any other suitable structure in which the upper crimping teeth 32*a* and the lower crimping teeth 32*b* of the crimping assembly engage with each other. For example, the crimping assembly may bring the upper crimping teeth 32*a* and the lower crimping teeth 32*b* into contact with each other and separate the upper crimping teeth 32*a* and the lower crimping teeth 32*b* from each other with a link mechanism and a driving source that simply rotates forward or that rotates forward and backward (e.g., the crimping assembly disclosed in Japanese Patent No. 6057167). Alternatively, the crimping assembly may employ a linear motion system to linearly bring the upper crimping teeth 32*a* and the lower crimping teeth 32*b* into contact with each other and separate the upper crimping teeth 32*a* and the lower crimping teeth 32*b* from each other with a screw assembly that converts the forward and backward rotational motions of a driving source into linear reciprocating motion.

As illustrated in FIG. 3, the edge binder 25 includes an edge binder movement assembly 47.

The edge binder movement assembly 47 moves the edge binder 25, specifically, the liquid applier 31 and the crimper 32, in the main scanning direction along a downstream end in the conveyance direction of the sheet P placed on the internal tray 22. The edge binder movement assembly 47 includes, for example, the base 48, a guide shaft 49, the edge binder movement motor 50, and a driving force transmission assembly 551 that transmits the driving force of the edge binder movement motor 50 to the base 48.

The liquid applier 31 and the crimper 32 are attached to the base 48 such that the liquid applier 31 and the crimper 32 are adjacent to each other in the main scanning direction. As illustrated in FIG. 4, the guide shaft 49 is held by multiple guide shaft brackets 49*a* disposed in the main scanning direction at a position on the upstream side of a binding assembly base 116 in the conveyance direction of the sheet P. As illustrated in FIG. 3, the guide shaft 49 extends in the main scanning direction on the binding assembly base 116. The guide rail 115 is disposed in the main scanning direction on the downstream side of the binding assembly base 116 in the conveying direction of the sheet P.

As illustrated in FIG. 4, the guide rail 115 includes a fitting target portion 115*a* that fits to a fitting portion 48*a* of the base 48 in the main scanning direction. In other words, the base 48 is movably held by the guide shaft 49 and the guide rail 115 in the main scanning direction on the binding assembly base 116. The edge binder movement motor 50 generates a driving force to move the edge binder 25. The driving force transmission assembly 551 transmits the driving force of the edge binder movement motor 50 to the base 48 via pulleys 551*a* and 551*b*, a timing belt 551*c*, and a fastening portion 48*b* that fastens the base 48 and the timing belt 551*c*. As a result, the liquid applier 31 and the crimper 32 integrated by the base 48 move in the main scanning direction along the guide shaft 49. The position of the edge binder 25 may be ascertained with, for example, an encoder sensor 541 (see FIG. 8) attached to an output shaft of the edge binder movement motor 50. The standby position sensor 540 (see FIG. 8) detects the arrival of the edge binder 25 at a standby position HP illustrated in FIG. 10A.

A crimper shaft 54 including a drive transmission gear 54*a* is fixed to a bottom face of the crimping frame 32*c* that holds the components of the crimper 32. The crimper shaft 54 and the drive transmission gear 54*a* are held by the base 48 on which the crimping frame 32*c* is disposed, so as to be rotatable in the forward and reverse directions. The drive transmission gear 54*a* meshes with an output gear 56*a* of a crimper pivot motor 56. The crimper 32 can be rotated in the forward and reverse directions about the crimper shaft 54 on the base 48 by a driving force transmitted from the crimper pivot motor 56 to the crimper shaft 54 via the output gear 56*a* and the drive transmission gear 54*a*.

In the above description, the edge binder 25 has a configuration of moving along the guide shaft 49 with the crimper 32 and the liquid applier 31 being integrated, the embodiments of the present disclosure are not limited to the above-described configuration.

For example, the crimper 32 and the liquid applier 31 may have a configuration of moving separately from each other. A description is given of the staple binder 55.

Figure 6:
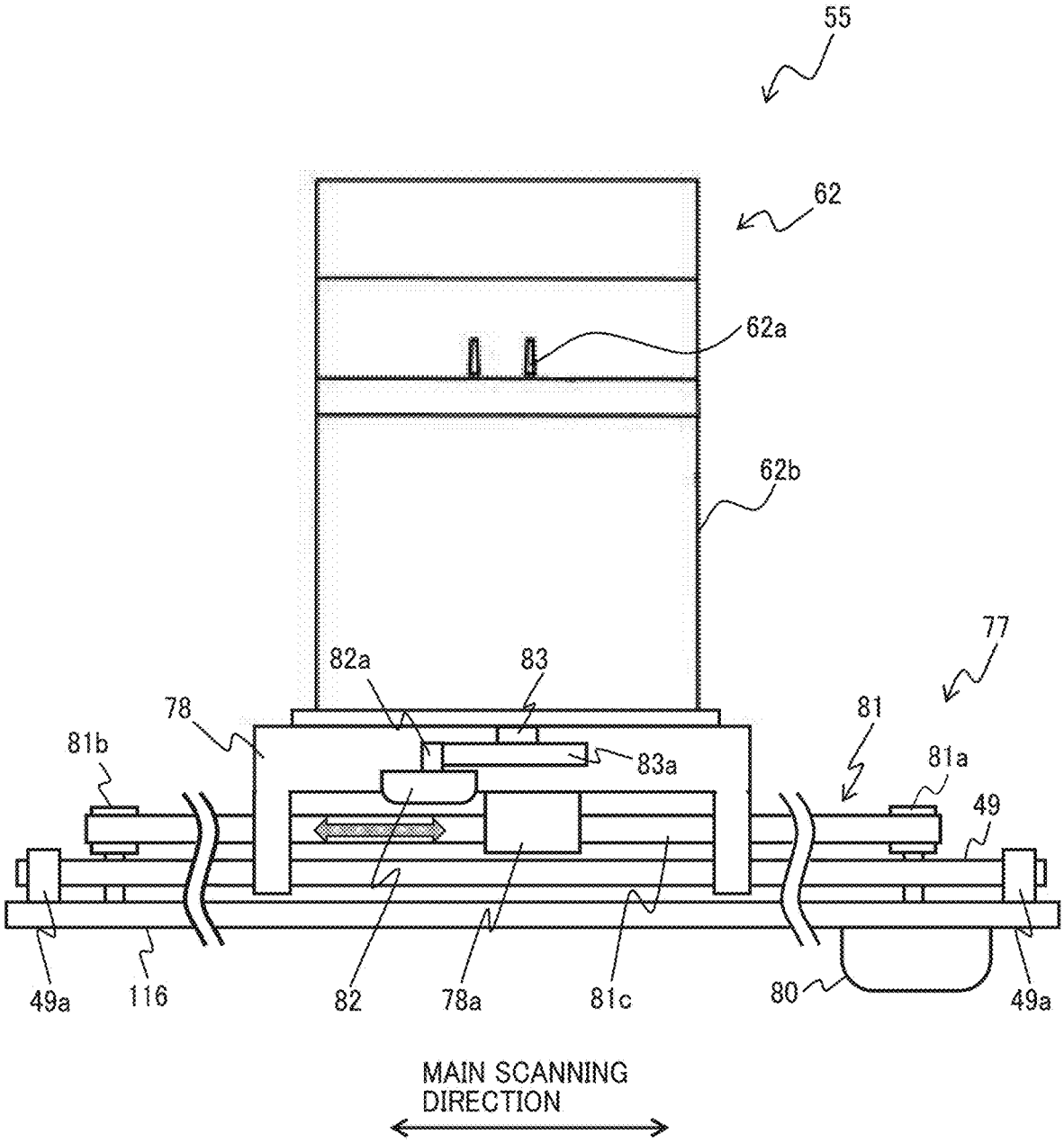
FIG. 6 is a schematic diagram illustrating an upstream side of a stapling unit of the post-processing apparatus of FIG. 2 in a conveyance direction.

Details of the staple binder 55 having the function of executing the stapling process are described below. FIG. 6 is a schematic diagram illustrating the staple binder 55 as viewed from the upstream side in the conveyance direction.

The staple binder 55 includes a stapler 62 that binds a sheet bundle Pb with staples. The stapler 62 is disposed downstream from the internal tray 22 in the conveyance direction of the sheet P and spaced apart from the edge binder 25 in the main scanning direction.

The stapler 62 serving as a post-processing device has a configuration of performing so-called "stapling" (i.e., stapling process) to bind a sheet bundle Pb with a staple or staples. To be more specific, the stapler 62 includes a stapling part drive motor 62*d* illustrated in FIG. 8. The stapling part drive motor 62*d* drives a stapling part 62*a*. The driving force of the stapling part drive motor 62*d* causes a staple loaded in the stapling part 62*a* to penetrate through a sheet bundle Pb, so that the stapling part 62*a* binds the sheet bundle Pb. Since the stapler 62 has a typical configuration, a detailed description of the stapler 62 will be omitted unless otherwise required. As illustrated in FIG. 6, the staple binder 55 includes a staple binder movement assembly 77.

The staple binder movement assembly 77 moves the staple binder 55 in the main scanning direction along a downstream end in the conveyance direction of the sheet P or the sheet bundle Pb placed on the internal tray 22. The staple binder movement assembly 77 includes, for example, a base 78, the guide shaft 49, a staple binder movement motor 80, and a driving force transmission assembly 81. The driving force transmission assembly 81 transmits a driving force of the staple binder movement motor 80 to the base 78 via pulleys 81*a* and 81*b*, a timing belt 81*c*, and a fastening portion 78*a* that fastens the base 78 and the timing belt 81*c*. A stapler shaft 83 is fixed to a bottom face of a stapling frame 62*b* that holds the components of the stapler 62.

The stapler shaft 83 and the drive transmission gear 83*a* are held by the base 78 on which the stapling frame 62*b* is disposed, so as to be rotatable in the forward and reverse directions. The stapler 62 is rotatable in the forward and reverse directions about the stapler shaft 83 on the base 78 by a driving force transmitted from the stapler pivot motor 82 to the stapler shaft 83 via an output gear 82*a* and the drive transmission gear 83*a*.

The edge binder 25 and the staple binder 55 are supported by the common guide shaft 49. The edge binder movement assembly 47 and the staple binder movement assembly 77 move the edge binder 25 and the staple binder 55 in the main scanning direction along the common guide shaft 49. The edge binder movement assembly 47 and the staple binder movement assembly 77 can separately move the edge binder 25 and the staple binder 55.

Figure 7:
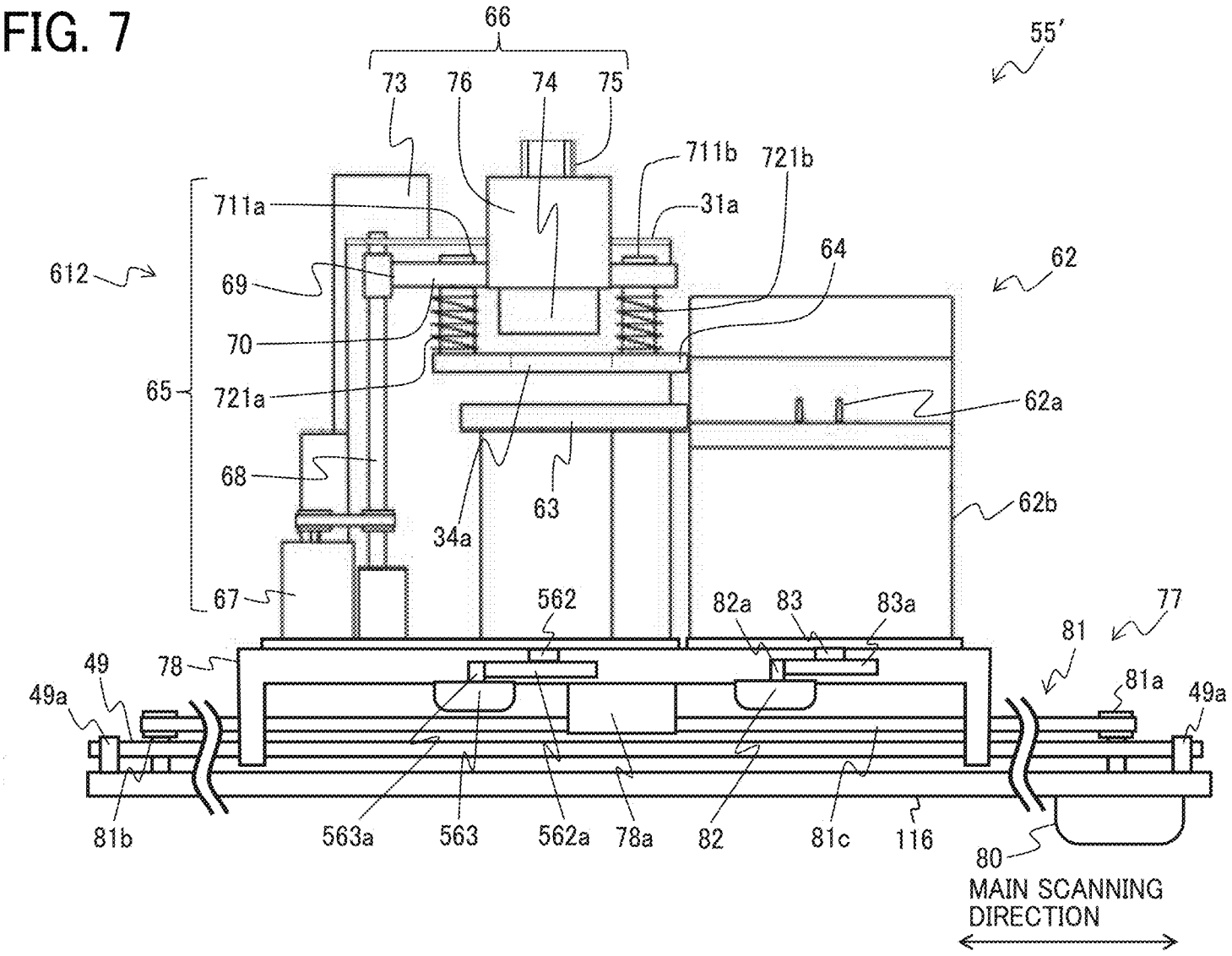
FIG. 7 is a schematic diagram illustrating an upstream side of a staple binder as a modification of the staple binder of FIG. 6 in the conveyance direction.

FIG. 7 illustrates a staple binder 55' as a modification of the staple binder 55. More specifically, FIG. 7 is a schematic diagram illustrating of the staple binder 55' as viewed from the upstream side in the conveyance direction. The staple binder 55' is different from the staple binder 55 in that the staple binder 55' includes a second liquid applier 612 in addition to the stapler 62. As illustrated in FIG. 7, the staple binder 55' includes the second liquid applier 612 and the stapler 62. The second liquid applier 612 and the stapler 62 are disposed downstream from the internal tray 22 in the conveyance direction of the sheet P and adjacent to each other in the main scanning direction. The second liquid applier 612 executes "liquid application" of applying liquid stored in a second liquid storage tank 73 to the sheet P or the sheet bundle Pb placed on the internal tray 22. A given area including a position to which the liquid is applied on the sheet P or the sheet bundle Pb by the second liquid applier 612 corresponds to a binding position to be stapled by the stapler 62. As illustrated in FIG. 7, the second liquid applier 612 includes a second lower pressure plate 63, a second upper pressure plate 64, a second liquid applier movement assembly 65, and a second liquid application assembly 66.

The second liquid applier movement assembly 65 includes, for example, a second liquid applier movement motor 67, a second trapezoidal screw 68, a second nut 69, a second base plate 70, second columns 711*a* and 711*b*, and second coil springs 721*a* and 721*b*. The second liquid application assembly 66 includes the second liquid storage tank 73, a second liquid application member 74, a second liquid supply portion 75, and a second joint 76. Since the second liquid application assembly 66 and the liquid application assembly 36 have common configurations, redundant descriptions thereof are omitted below unless otherwise required. Since the configuration of the stapler 62 illustrated in FIG. 6 is like the configuration of the stapler 62 illustrated in FIG. 7, a detailed description thereof is omitted below unless otherwise required. Since the second liquid applier 612 and the liquid applier 31 that are illustrated in FIG. 3 have common pivot mechanisms, redundant descriptions thereof will be omitted unless otherwise required. The pivot mechanism of the second liquid applier 612 includes a liquid applier pivot motor 563, an output gear 563*a*, drive transmission gear 562*a*, and a liquid applier shaft 562.

In the binding process, the staple binder 55' illustrated in FIG. 7 performs a liquid application process on a sheet P to loosen and soften the binding position of the sheet P, allowing a staple to easily pass through the sheet bundle Pb. As a result, the number of sheets to be bound per sheet bundle Pb can be increased as compared with a case where the stapling process is performed without applying the liquid.

Referring back to FIG. 2, the post-processing apparatus 3 further includes an end fence 27, a saddle binder 28, a sheet folding blade 29, and the ejection tray 30. The end fence 27, the saddle binder 28, and the sheet folding blade 29 perform saddle binding on a sheet bundle Pb foamed of the sheets P that are conveyed through the third conveyance passage Ph3. Among the sheets P supplied from the image forming apparatus 2, the sheet bundle Pb subjected to the saddle binding is ejected to the ejection tray 30.

The end fence 27 aligns the positions of the sheets P that are sequentially conveyed through the third conveyance passage Ph3, in a conveyance direction in which the sheets P are conveyed. The end fence 27 can move between a binding position where the end fence 27 causes the center of the sheet bundle Pb to face the saddle binder 28 and a folding position where the end fence 27 causes the center of the sheet bundle Pb to face the sheet folding blade 29. The saddle binder 28 binds the center of the sheet bundle Pb aligned by the end fence 27 at the binding position. The sheet folding blade 29 folds, in half, the sheet bundle Pb placed on the end fence 27 at the folding position and causes the conveyance roller pair 18 to nip the sheet bundle Pb. The conveyance roller pairs 18 and 19 eject the sheet bundle Pb subjected to the saddle binding to the ejection tray 30.

A description is given of a control block of the post-processing apparatus 3.

Figure 8:
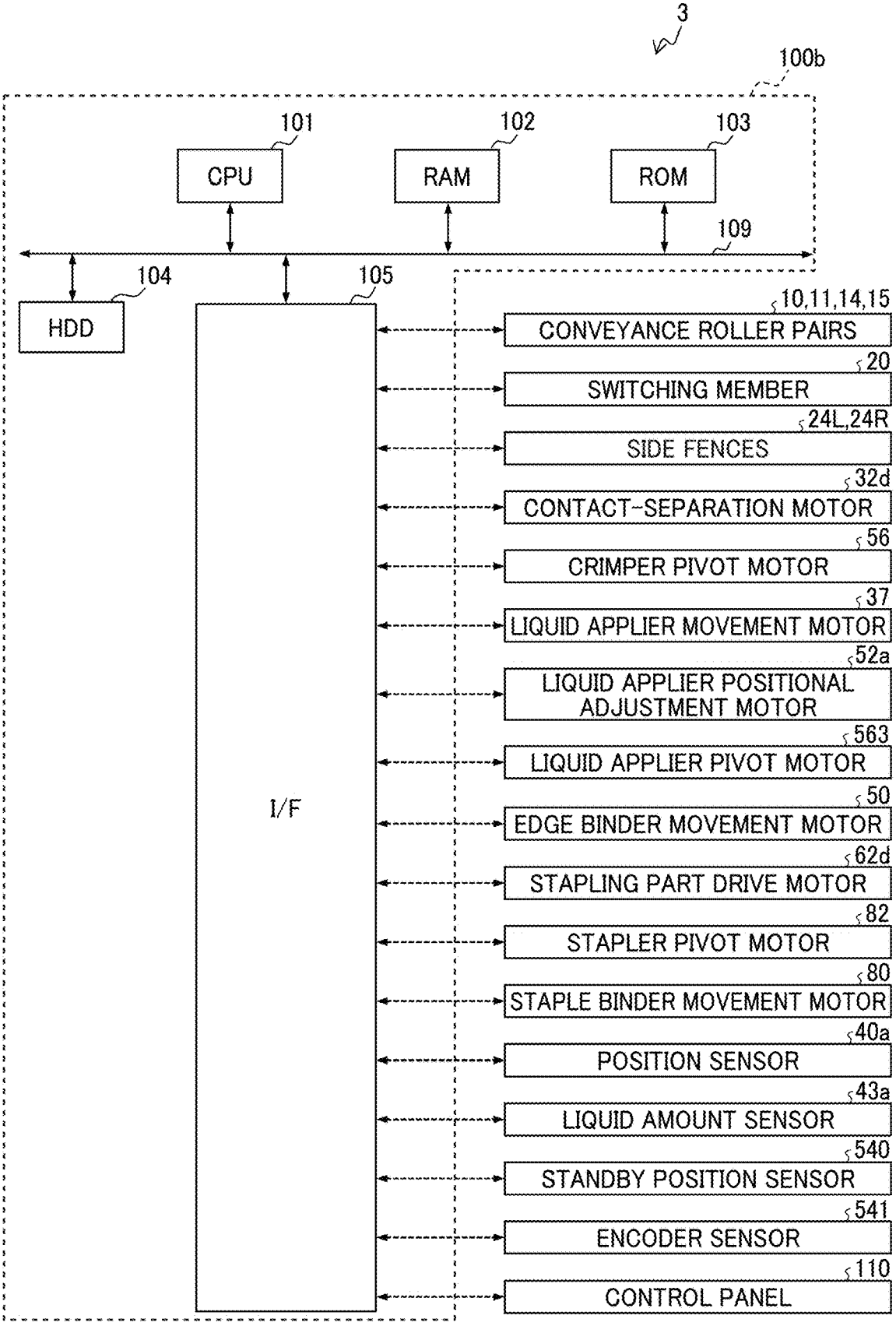
FIG. 8 is a diagram illustrating a hardware configuration of a control block for controlling an operation of a post-processing apparatus according to an embodiment of the present disclosure.

A description is given below of a control block of the post-processing apparatus 3, with reference to FIG. 8. FIG. 8 is a block diagram illustrating a hardware configuration for executing control processing in the post-processing apparatus 3.

As illustrated in FIG. 8, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected each other via a common bus 109.

The CPU 101 is an arithmetic unit and controls the operation of the overall operation of the post-processing apparatus 3. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs.

The post-processing apparatus 3 processes, by an arithmetic function of the CPU 101, e.g., a control program stored in the ROM 103 and an information processing program (or application program) loaded into the RAM 102 from a storage medium such as the HDD 104. Such processing configures a software controller including various functional modules of the post-processing apparatus 3. The software controller that is thus configured cooperates with hardware resources of the post-processing apparatus 3 to construct functional blocks that implement functions of the post-processing apparatus 3. In other words, the CPU 101, the RAM 102, the ROM 103, the HDD 104, and the I/F 105 constitute at least part of a controller 100B serving as a control device that controls the operation of the post-processing apparatus 3.

The I/F 105 is an interface that connects the conveyance roller pairs 10, 11, 14, and 15, the switching member 20, the side fences 24L and 24R, the contact-separation motor 32*d*, the crimper pivot motor 56, the liquid applier movement motor 37, the liquid applier positional adjustment motor 52*a*, the liquid applier pivot motor 563, the edge binder movement motor 50, the stapling part drive motor 62*d*, the stapler pivot motor 82, the staple binder movement motor 80, the movement sensor 40*a*, the liquid amount sensor 43*a*, the standby position sensor 540, the encoder sensor 541, and a control panel 110 to the common bus 109. The controller 100 controls, via the I/F 105, the operations of the conveyance roller pairs 10, 11, 14, and 15, the switching member 20, the side fences 24L and 24R, the contact-separation motor 32*d*, the crimper pivot motor 56, the liquid applier movement motor 37, the liquid applier positional adjustment motor 52*a*, the liquid applier pivot motor 563, the edge binder movement motor 50, the stapling part drive motor 62*d*, the stapler pivot motor 82, and the staple binder movement motor 80. The controller 100*b* acquires detection results from the movement sensor 40*a*, the liquid amount sensor 43*a*, the standby position sensor 540, and the encoder sensor 541. Although FIG. 8 illustrates only the components related to the edge binder 25 and the staple binder 55 that perform the edge binding, the components related to the saddle binder 28 that performs the saddle binding are also controlled by the controller 100*b*.

As illustrated in FIG. 1, the image forming apparatus 2 includes the control panel 110. The control panel 110 includes an operation device that receives instructions from a user and a display serving as a notifier that notifies the user of information. The operation unit includes, for example, hard keys and a touch panel superimposed on a display. The control panel 110 acquires information from the user through the operation unit and provides the information to the user through the display. A specific example of the notification unit is not limited to the display and may be an LED lamp or a speaker. The post-processing apparatus 3 may include a control panel 110 similar to the above-described control panel 110 of the image forming apparatus 2.

The controller 100*b* also counts pulse signals output from the encoder sensor 541 to ascertain the current position of the edge binder 25 moved from the standby position HP. However, a specific method of stopping the edge binder 25 at the target position without returning the edge binder 25 to the origin position is not limited to the aforementioned example. As another example, the post-processing apparatus 3 may include a sensor that detects the arrival of the edge binder 25 at a given target position.

The controller 100*b* causes the edge binder movement assembly 47 to move the edge binder 25 by the shortest distance between the position at which the liquid applier 31 faces the first liquid application position B1 and the position at which the liquid applier 31 faces the second liquid application position B2 without passing through the standby position HP.

The controller 100*b* causes the edge binder movement assembly 47 to move the edge binder 25 by the shortest distance between the position at which the crimper 32 faces the first binding position B1 and the position at which the crimper 32 faces the second binding position B2 without passing through the standby position HP.

Further, the controller 100*b* causes the edge binder movement assembly 47 to move the edge binder 25 by the shortest distance between the position at which the liquid applier 31 faces the first liquid application position B1 (or the second liquid application position B2) and the position at which the crimper 32 faces the first binding position B1 (or the second binding position B2) without passing through the standby position HP.

The controller 100*b* drives the contact-separation motor 32*d* to nip an end of the sheet bundle Pb between the pair of crimping teeth units (the upper crimping teeth 32*a* and the lower crimping teeth 32*b*) of the crimper 32 and press and deform the end of the sheet bundle Pb. In this operation (binding operation), the contact-separation motor 32*d* is controlled to apply a predetermined operation amount to the crimper 32.

The liquid application position to which liquid is applied on a sheet P or a sheet bundle Pb by the liquid applier 31 corresponds to the binding position on the sheet bundle Pb to be crimped by the crimper 32. For this reason, as described above, the first liquid application position and the first binding position share reference sign "B1" and the second liquid application position and the second binding position share reference sign "B2".

As described above, the post-processing apparatus 3 implements the function of performing operation control related to the liquid application by software (control programs) executed by the CPU 101 with hardware resources included in the controller 100*b*.

In some embodiments, the liquid application performed by the post-processing apparatus 3 may be performed in a form in which the staple binder 55 is provided with only the stapler 62 and the liquid application is performed using the liquid applier 31 of the edge binder 25. Alternatively, on the contrary, the edge binder 25 may be provided with only the crimper 32, and the liquid application may be performed using the second liquid applier 612 of the staple binder 55. In other words, the post-processing apparatus 3 may have a configuration in which only one of the liquid applier 31 and the second liquid applier 612 performs the liquid application, regardless of the type of the binding process.

Further, in the above description, the staple binder 55' has a configuration of moving along the guide shaft 49 with the stapler 62 and the second liquid applier 612 being integrated. However, embodiments of the present disclosure are not limited to the above-described configuration. For example, the stapler 62 and the second liquid applier 612 may have a configuration of moving independently of each other.

A description is given of a binding process according to an embodiment of the present disclosure.

A description is given below of the binding process executed by the edge binder 25 included in the post-processing apparatus 3.

Figure 9:
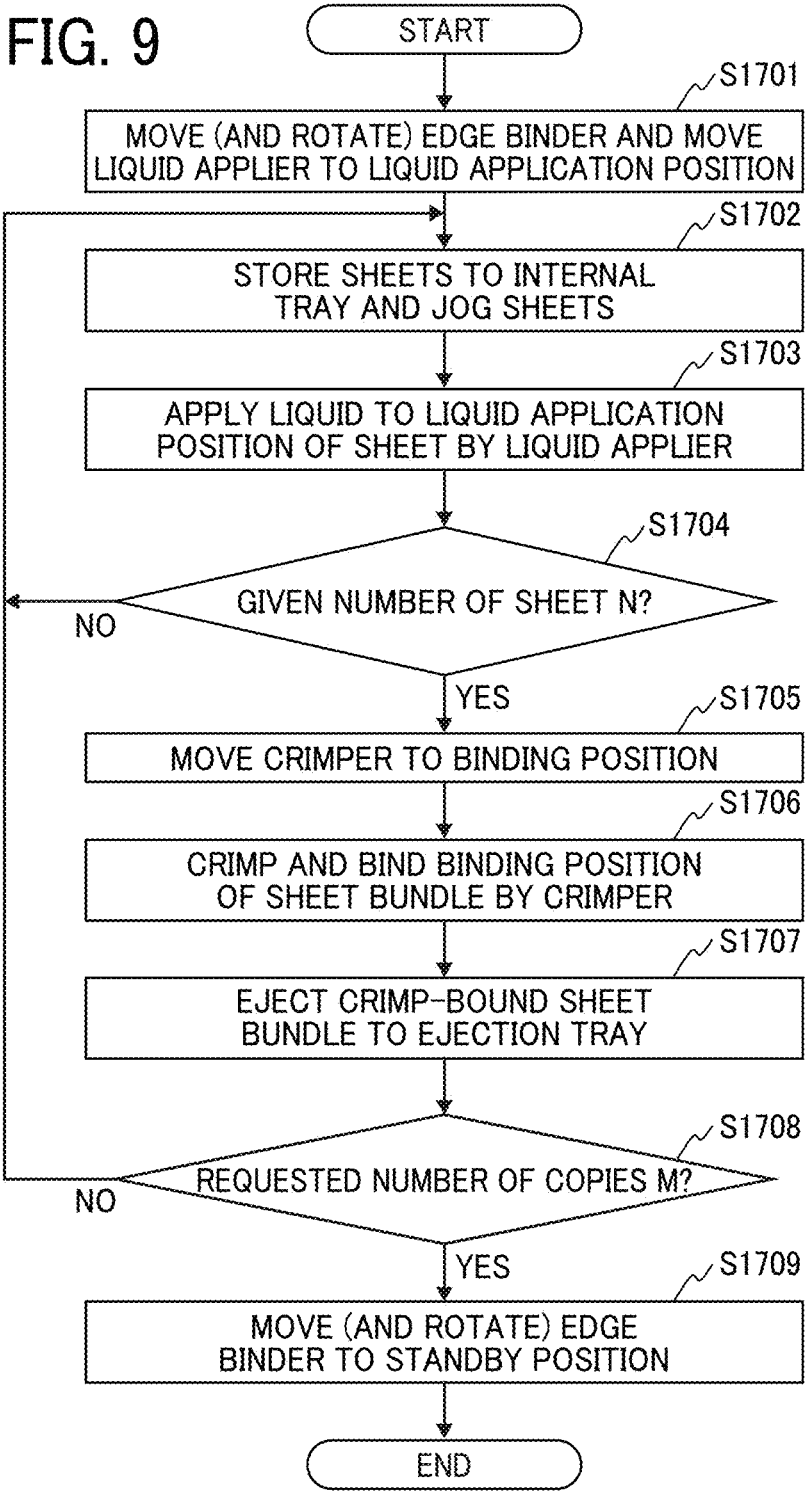
FIG. 9 is a flowchart of a binding process performed by an edge binder according to an embodiment of the present disclosure.

FIG. 9 is a flowchart of the binding process.

Figure 10A:
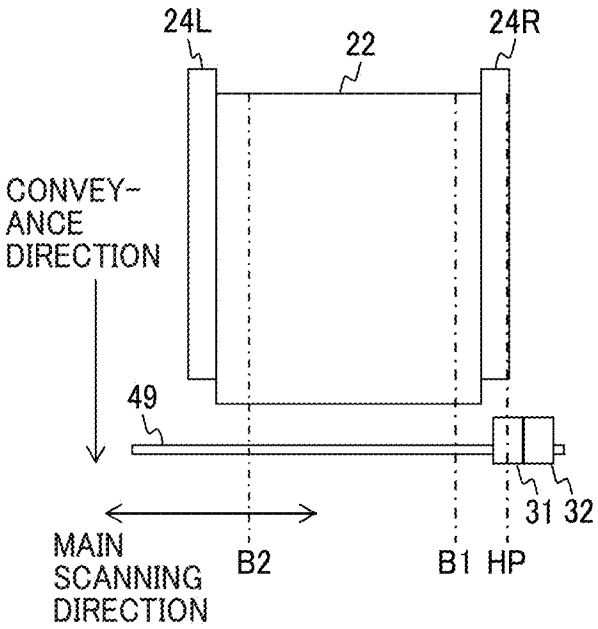
FIGS. 10A, 10B, and 10C are diagrams each illustrating the positions of a liquid applier and a crimper during the binding process of FIG. 9 by the edge binder.
Figure 10B:
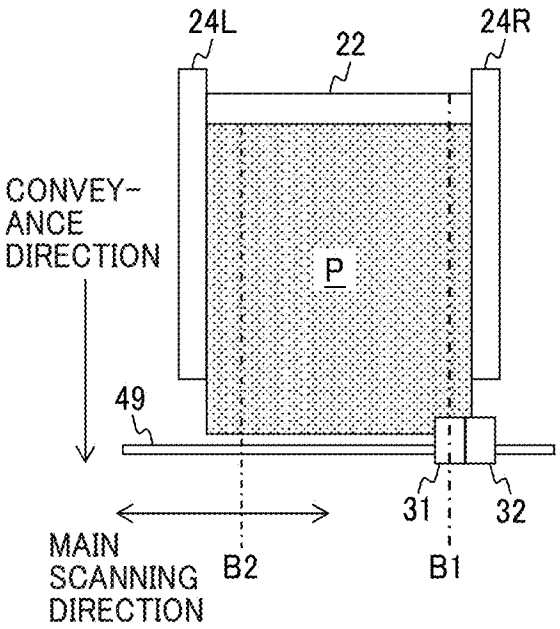
Figure 10C:
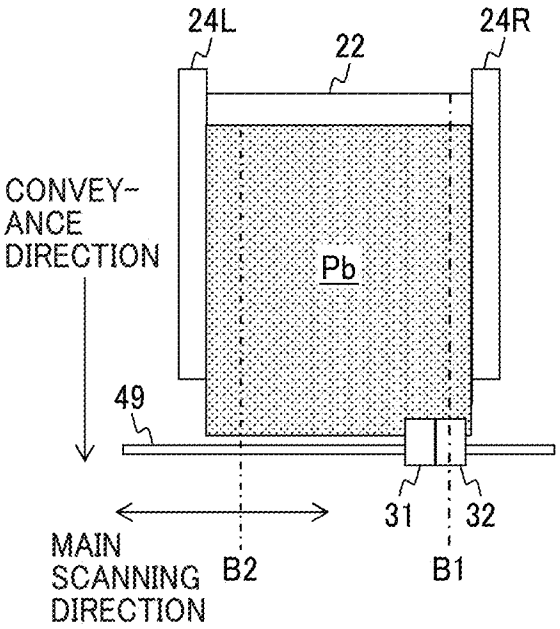

FIGS. 10A, 10B, and 10C are diagrams illustrating the positions of the liquid applier 31 and the crimper 32 during the binding process of FIG. 9.

FIGS. 10A, 10B, and 10C do not illustrate changes in the postures of the liquid applier 31 and the crimper 32. The liquid application position to which liquid is applied on a sheet P or a sheet bundle Pb by the liquid applier 31 corresponds to the binding position on the sheet bundle Pb to be crimped by the crimper 32. For this reason, in the following description, the liquid application position and the binding position are denoted by the same reference sign (B1).

The controller 100*b* starts the binding process illustrated in FIGS. 10A, 10B, and 10C, for example, when the controller 100 acquires an instruction to execute the binding process from the image forming apparatus 2. Hereinafter, the instruction to execute the binding process may be referred to as the "binding command".

The binding command includes, for example, the type of the sheet P (i.e., information affecting the spread of liquid, such as material and thickness), the number of sheets P of the sheet bundle Pb, the number of sheet bundles Pb to be bound, the binding position on the sheet bundle Pb, and the binding posture of the edge binder 25. In the following description, the number of sheets P of the sheet bundle Pb may be referred to as a "given number N" whereas the number of sheet bundles Pb to be bound may be referred to as "requested number M of copies." The liquid applier 31 and the crimper 32 are assumed to be in a parallel binding posture and located at a standby position HP (FIG. 10A) that is a position shifted in the width direction from the sheets P placed on the internal tray 22 at the start of the binding process.

When the posture that is instructed by the binding command is the "oblique binding posture," the controller 100*b* drives the crimper pivot motor 56 to rotate the liquid applier 31 and the crimper 32 of the edge binder 25 into the oblique binding posture.

On the other hand, when the posture that is instructed by the binding command is the "parallel binding posture," the controller 100*b* omits the aforementioned operation of rotating the liquid applier 31 and the crimper 32 of the edge binder 25 to the oblique binding posture. The controller 100*b* drives the edge binder movement motor 50 to move the edge binder 25 in the main scanning direction so that the liquid applier 31 moves to face the first liquid application position B1 instructed by the binding command (step S1701). The controller 100*b* executes the operation of step S1701 before a first sheet P is conveyed to the internal tray 22 by the conveyance roller pairs 10, 11, 14, and 15.

The controller 100*b* rotates the conveyance roller pairs 10, 11, 14, and 15 to store the sheet P, on which the image has been formed by the image forming apparatus 2, onto the internal tray 22 (step S1702). The controller 100*b* moves the side fences 24L and 24R to align the sheet bundle Pb or the position of the sheet bundle Pb placed on the internal tray 22 in the main scanning direction (step S1702). In other words, the controller 100*b* performs so-called jogging.

The controller 100*b* causes the liquid applier 31 facing the first liquid application position B1 to apply liquid to the first liquid application position B1 of the sheet P placed on the internal tray 22 in the immediately preceding step S1702, based on the liquid application control data adjusted in advance (step S1703). In other words, the controller 100*b* drives the liquid applier movement motor 37 to bring the liquid application member 44 into contact with the liquid application position B1 on the sheet P placed on the internal tray 22 (see FIG. 10B). In the liquid application process in step S1703, the controller 100*b* adjusts the position at which the liquid application member 44 applies liquid to the sheet P in accordance with the type of the sheet P and the binding position included in the binding command. The controller 100*b* adjusts the amount of pressing the liquid application member 44 against the sheet P. In other words, the controller 100*b* controls the driving of the liquid applier movement motor 37 based on the adjusted control data, and adjusts the amount of movement of the liquid application member 44 with respect to the first liquid application position B1 of the sheet P placed on the internal tray 22 (see FIG. 10B).

Subsequently, the controller 100*b* determines whether the number of sheets P stored in the internal tray 22 has reached the given number of sheets N instructed by the binding command (S1704). When the controller 100*b* determines that the number of sheets P stored in the internal tray 22 has not reached the given number of sheets N (NO in step S1704), the controller 100*b* executes the operations of steps S1702 to S1704 again.

In other words, the controller 100*b* executes the operations of steps S1702 and S1703 each time a sheet P is conveyed to the internal tray 22 by the conveyance roller pairs 10, 11, 14, and 15.

The liquid application of the liquid applier 31 may be performed on each of the sheets P of the sheet bundle Pb.

When the controller 100*b* determines that the number of sheets P placed on the internal tray 22 has reached the given number of sheets N (YES in step S1704), the controller 100*b* drives the edge binder movement motor 50 to move the edge binder 25 in the main scanning direction so that the crimper 32 moves to face the first binding position B1 as illustrated in FIG. 10C (step S1705).

The controller 100*b* causes the crimper 32 to crimp and bind the sheet bundle Pb placed on the internal tray 22 (step S1706). The details of the crimp binding will be described below. The controller 100*b* causes the conveyance roller pair 15 to eject the sheet bundle Pb thus crimped and bound (in other words, the crimp-bound sheet bundle Pb) by the crimper 32 to the ejection tray 26 (step S1707). Specifically, the controller 100*b* drives the contact-separation motor 32*d* to cause the upper crimping teeth 32*a* and the lower crimping teeth 32*b* to pinch the first binding position B1 on the sheet bundle Pb placed on the internal tray 22. The sheet bundle Pb is pressed and deformed between the upper crimping teeth 32*a* and the lower crimping teeth 32*b*. Thus, the crimper 32 crimps the sheet bundle Pb. Then, the controller 100*b* rotates the conveyance roller pair 15 to eject the sheet bundle Pb thus crimped and bound to the ejection tray 26.

The controller 100*b* determines whether the number of sheet bundles Pb thus ejected to the ejection tray 26 has reached the requested number of copies M indicated by the binding command (step S1708). When the controller 100*b* determines that the number of sheet bundles Pb thus ejected has not reached the requested number of copies (NO in step S1708), the controller 100*b* executes the operations of step S1702 and the following steps again. In other words, when the controller 100*b* determines that the number of sheet bundles Pb thus ejected has not reached the requested number of copies M (NO in step S1708), the controller 100*b* repeats the operations of steps S1702 to S1708 until the number of sheet bundles Pb ejected to the ejection tray 26 reaches the requested number of copies M.

By contrast, when the controller 100*b* determines that the number of sheet bundles Pb output to the ejection tray 26 has reached the requested number of copies M (YES in step S1708), the controller 100*b* drives the edge binder movement motor 50 to move the edge binder 25 (the liquid applier 31 and the crimper 32) to the standby position HP as illustrated in FIG. 10A (step S1709). When the posture that is instructed by the binding command is the "oblique binding posture," the controller 100*b* also drives the crimper pivot motor 56 to rotate the liquid applier 31 and the crimper 32 into the parallel binding posture (step S1709). On the other hand, when the posture that is instructed by the binding command is the "parallel binding posture," the controller 100*b* omits the aforementioned operation of rotating the crimper 32 to the parallel binding posture. As a result, the edge binder 25 (the liquid applier 31 and the crimper 32) returns to the standby position HP position illustrated in FIG. 10A. In steps S1701 and S1709, the execution order of the movement in the main scanning direction and the rotation in the forward and reverse directions of the liquid applier 31 and the crimper 32 is not limited to the aforementioned order and may be reversed.

The sheet bundle Pb that is placed on the internal tray 22 has a crimping area (corresponding to the binding position B1) sandwiched between the upper crimping teeth 32*a* and the lower crimping teeth 32*b* in step S1706. The crimping area overlaps a liquid application area (corresponding to the liquid application position B1) contacted by the end of the liquid application member 44 in step S1703. In other words, the crimper 32 crimps an area to which liquid is applied by the liquid applier 31 on the sheet bundle Pb placed on the internal tray 22. The crimping area that is pinched by the upper crimping teeth 32*a* and the lower crimping teeth 32*b* may completely or partially overlaps the liquid application area contacted by the distal end of the liquid application member 44, to obtain a sufficient binding strength.

A description is given below of a first embodiment of the present disclosure.

Specifically, a more detailed description is given of liquid application of the crimp binding process executable in the post-processing apparatus 3 according to a first embodiment of the present disclosure.

Figure 11A:
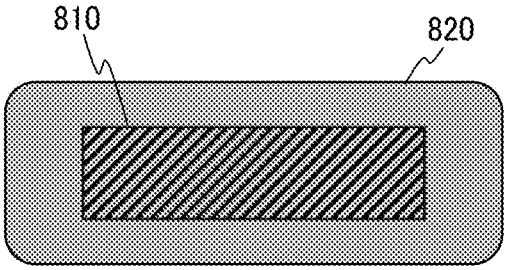
FIGS. 11A, 11B, and 11C are diagrams each illustrating a correlation between the position of a liquid application region and the position of a binding region according to a first embodiment of the present disclosure.
Figure 11B:
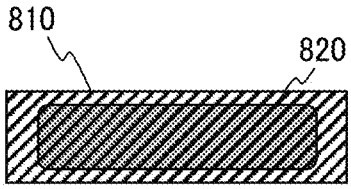
Figure 11C:
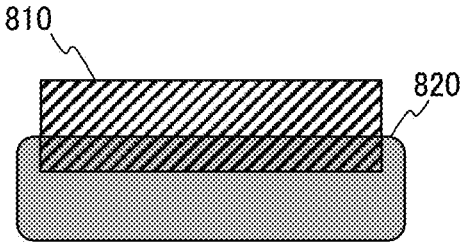

FIGS. 11A, 11B, and 11C are diagrams illustrating a correlation between a binding region 810 and a liquid application region 820 (liquid application position) in the liquid application process of coating (applying) the liquid in a predefined binding position, in cooperation with crimp binding.

The binding region 810 corresponds to a region that is a regional expansion of a crimping position where the sheet P is crimped by the crimper 32 after the crimper 32 contacts the sheet P to press and deform the sheet P. In other words, the binding region 810 corresponds to a region that is a regional expansion of a position where the sheet P is crimped by the crimper 32. The liquid application region 820 includes a regional range in which, due to the liquid application process, the liquid application member 44 contacts the sheet P, and corresponds to a region in which the liquid applied to the sheet P spreads. A post-processing region according to the present embodiment corresponds to a region including the binding region 810 and the liquid application region 820.

For example, as illustrated in FIG. 11A, it is assumed that the binding region 810 is accommodated in the liquid application region 820. In this case, the liquid is also applied to a region (binding peripheral region) around the binding region 810. The binding peripheral region (binding non-execution region) is different from the binding region 810 and is not the portion where the sheets P are crimped. In other words, this region corresponds not to the bound portion but rather the portion where the sheets P are just stacked. When liquid is applied to the binding non-execution region to wet the sheet P, it is assumed that the strength of the sheet P decreases due to the influence of wetting.

Figure 12:
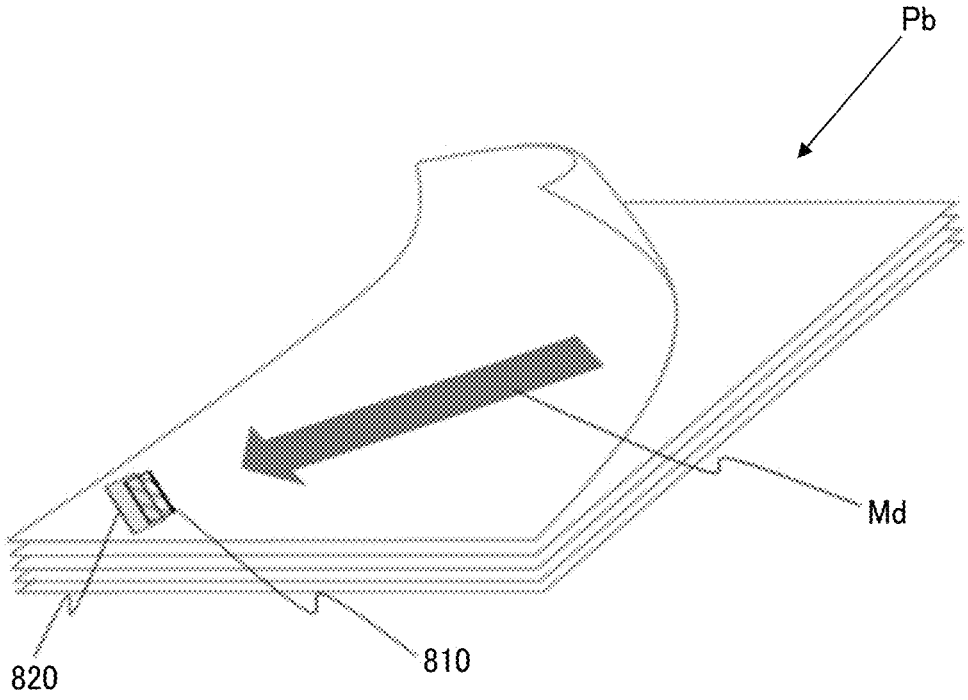
FIG. 12 is a diagram illustrating a configuration of obtaining a relation and binding strength of the liquid application region and the binding region according to the first embodiment of the present disclosure.

Assuming a case where the liquid application is performed as illustrated in FIG. 11A and the sheet bundle Pb subjected to the crimp binding is turned as illustrated in FIG. 12, the force due to the turning is applied to the liquid application region 820 before the force due to the turning is applied to the binding region 810. In other words, when the sheet P is turned toward the binding region 810, a force is applied to a region where the strength of the sheet P is reduced (a wet portion) regardless of the binding strength of the binding portion (binding strength of the binding region 810), and thus the sheet P may be torn.

Based on the foregoing, several conditions are conceived of to enhance the binding strength of the sheet bundle Pb bound by the crimp binding process including liquid application. The crimp binding process with liquid application is referred to as the "liquid application binding process".

The conditions are considered to include three conditions and are desirable to meet the three conditions. Namely, Condition A represents that the liquid application region 820 is not outside the binding region 810, Condition B represents that the liquid application region 820 is contained in the binding region 810, and Condition C represents that an appropriate and uniform amount of liquid is applied.

The effects obtained by meeting the above-described three conditions are described as follows.

Specifically, Condition A corresponds to a condition for avoiding a decrease in the strength of the sheet P due to liquid application around the binding region 810 and a tearing of the sheet P due to the decrease in strength.

Condition B corresponds to a condition for enhancing the binding strength by liquid application.

Condition C corresponds to a condition for stabilizing the effect obtained by meeting Condition B.

As described above, in the liquid application binding process, it is ideal that all of Condition A, Condition B, and Condition C are met. For example, as illustrated in FIG. 11B, the liquid application process is ideally controlled so that the liquid application region 820 having an appropriate liquid application amount exists only inside the binding region 810. More specifically, it is ideal to control the liquid application process to be performed such that the liquid application member 44 is moved relative to the sheet P and the position in which the liquid application member 44 contacts the sheet P is adjusted according to the position at which the crimper 32 performs the binding process.

Further, the amount of liquid application is to be controlled by accurately controlling the position of the liquid application member 44 relative to the sheet P, and controlling the amount of liquid application by considering, for example, "ease of liquid permeation (liquid permeability)" that varies depending on the kind (for example, material and thickness) of the sheet P, the number of sheets P of the sheet bundle Pb. For example, depending on, for example, the kind of the sheet P, it may be desirable that the amount of liquid to be applied is greater than a normal amount to enhance the binding force.

As illustrated in FIG. 11B, even in a case where the contact position of the liquid application member 44 with the sheet P is controlled such that the liquid application region 820 exists only inside the binding region 810, the liquid application region 820 may spread beyond the binding region 810 due to the liquid permeability to the sheet P to be the state illustrated in FIG. 11A. In other words, it is considered that Condition A cannot be met by the application amount of the liquid.

Assuming such a case, the liquid application region 820 is preferably formed relative to the binding region 810 in a position as illustrated in FIG. 11C. In other words, as illustrated in FIG. 12, in a case where the crimp binding is performed on one end of the sheet bundle Pb, the liquid application region 820 is formed in a given liquid application position relative to the position of the binding region 810 related to the crimp binding.

As illustrated in FIG. 12, the "given liquid application position" corresponds to a region to which liquid is applied in a range across the downstream end (downstream side) of the binding region 810 of the sheet bundle Pb in the sheet turning direction Md when the sheet P of the sheet bundle Pb is turned and regions other than the binding region 810. In other words, when the sheet P is turned in the sheet turning direction Md, the liquid application region 820 is not formed at a position (position on the upstream side in the sheet turning direction Md in the binding region 810) at which the force (turning force) generated due to turning the sheet P in the binding region 810 starts to be applied.

In other words, if the liquid application region 820 is formed as the relative position as illustrated in FIG. 12, no liquid application region 820 does not exist in the portion where the turning force starts to be applied to the binding region 810. Due to such a configuration, the strength of the sheet P is not reduced due to wetting by the liquid. For the above reasons, even if the liquid application region 820 exists outside the binding region 810, the resulting reduction in strength of the sheet P and the influence of the reduction in the binding force can be reduced.

To properly use the liquid application positions as illustrated in FIGS. 11B and 11C, the contact position and the contact amount of the liquid application member 44 relative to the sheet P are to be controlled. For example, such a configuration may include a mechanism that can move the liquid applier 31 in the conveyance direction illustrated in FIG. 4 and in the opposite direction. Further, the liquid applier 31 may be controlled to move to any position relative to the sheet P such that the liquid application member 44 contacts a preferable given liquid application position relative to the binding position (binding region 810). At this time, the crimper 32 attached to the liquid applier 31 may move together with the liquid applier 31, or the liquid applier 31 alone may move separate from the crimper 32.

A description is given below of a second embodiment of the present disclosure.

Specifically, a more detailed description is given of liquid application of the crimp binding process executable in the post-processing apparatus 3 according to a second embodiment of the present disclosure.

Figure 13A:
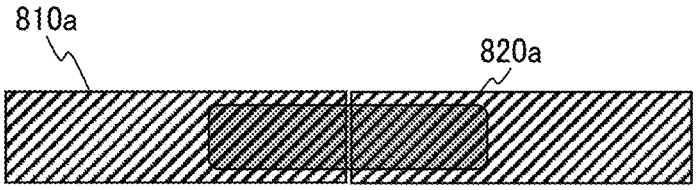
FIGS. 13A, 13B, and 13C are diagrams each illustrating a correlation between the position of a liquid application region and the position of a binding region according to a second embodiment of the present disclosure.
Figure 13B:
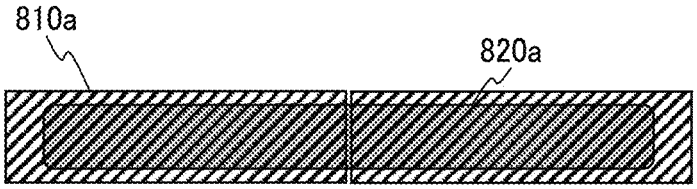
Figure 13C:
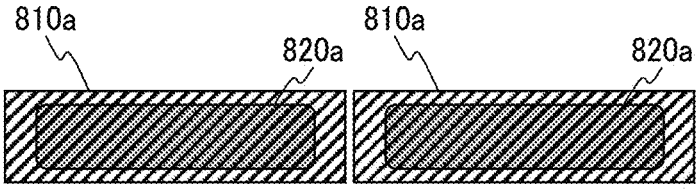

FIGS. 13A, 13B, and 13C are diagrams illustrating a correlation between a binding region 810*a* and a liquid application region 820*a* when the liquid application process corresponding to each binding position is performed in cooperation with the crimp binding process performed in multiple areas. When the number of times the binding process is performed on the sheet bundle Pb is increased, the job time is extended by the binding operation, thus reducing the productivity. However, due to a possible enhancement in the binding strength, it is assumed that the number of binding processes is properly used from the viewpoint of productivity and binding strength.

As illustrated in FIGS. 13A, 13B, and 13C, as the number of binding processes increases, the binding region 810*a* increases in size. When the liquid application process is executed so as to form the liquid application region 820*a* having the same size as a region in which the number of binding processes is one, the liquid application region 820*a* decreases relative to the binding region 810*a*, as illustrated in FIG. 13A. As a result, the effect of enhancing the binding strength through liquid application cannot be adequately obtained.

For this reason, in a case where the liquid application process is performed together with the crimp binding process, it is desirable that the number of liquid application regions 820*a* and the width of the liquid application regions 820*a* can be changed according to the number of binding processes, as illustrated in FIGS. 13B and 13C.

Descriptions are given of cases where the shape of the contact face of the liquid application member 44 with the sheet P is changed, as examples of changing the number and width of the liquid application region 820*a*.

A description is given of a first example of a liquid application member 44 according to the present disclosure.

Figure 14A:
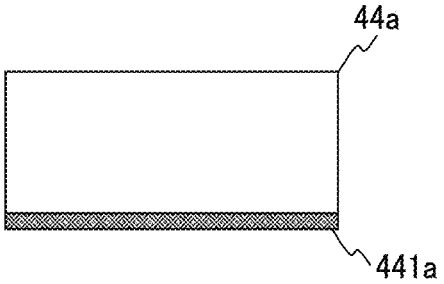
FIGS. 14A and 14B are diagrams each illustrating a first example of the shape of a liquid application member according to the first and second embodiments.
Figure 14B:
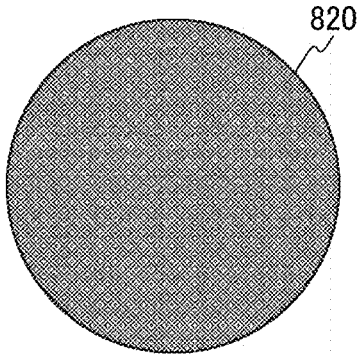

FIGS. 14A and 14B are diagrams illustrating the shape of a liquid application member 44*a* that forms a liquid application region 820 by contacting the sheet P in liquid application.

As described above, the shape and number of portions with which the liquid application member 44*a* contacts when liquid is applied to the sheet P depend in forming a liquid application region 820 in accordance with, for example, the size, shape, and number of the binding region 810. In other words, since the liquid application region 820 depends on the shape of the sheet contact face of the liquid application member 44*a*, the shape of the contact face of the liquid application member 44*a* is desirably set in accordance with, for example, the size, shape, and number of the binding region 810.

To address this inconvenience, a liquid application member 44*a* includes a sheet contact face 441*a* and it is assumed that the shape of the sheet contact face 441*a* of the liquid application member 44*a* includes a single and continuous face having a certain area with no limitation of the range, as illustrated in FIGS. 14A and 14B. FIG. 14A is a side view of the liquid application member 44*a*. FIG. 14B is a bottom view of the liquid application member 44*a*. As illustrated in FIG. 14B, the sheet contact face 441*a* of the liquid application member 44*a* may be, for example, circular, and the liquid application region 820 having a circular shape can be formed by applying the liquid once.

A description is given of a second example of a liquid application member 44 according to the present disclosure.

Figure 15A:
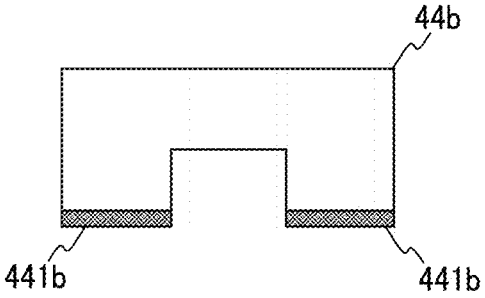
FIGS. 15A and 15B are diagrams each illustrating a second example of the shape of a liquid application member according to the first and second embodiments.
Figure 15B:
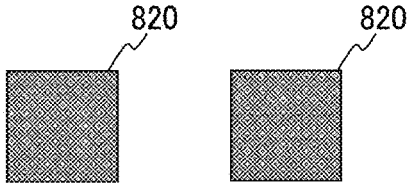

A liquid application member 44*b* includes sheet contact faces 441*b* and it is assumed that the shape of the sheet contact faces 441*b* of the liquid application member 44*b* includes multiple faces that have a certain area and are discontinuously disposed, with no limitation of the range, as illustrated in FIGS. 15A and 15B.

FIG. 15A is a side view the liquid application member 44*b*.

FIG. 15B is a bottom view of the liquid application member 44*b*.

As illustrated in FIG. 15B, the liquid application member 44*b* has a recess in the side view, and the sheet contact faces 441*b* are disposed at the tips of the multiple projections of the liquid application member 44*b*. When liquid is applied by the sheet contact faces 441*b* including discontinuous faces, such as the liquid application member 44*b*, even if multiple binding regions 810 are separately disposed, liquid application regions 820 corresponding to the multiple binding regions 810 can be formed with one liquid application by crossing the binding regions 810. In other words, with the liquid application member 44*b* including the multiple distinguished sheet contact faces 441*b* like the second example, the liquid application regions 820 corresponding to the number of sheet contact faces 441*b* by a single liquid application.

Further, each of the sheet contact face 441*a* of the liquid application member 44 in the first example and the sheet contact face 441*b* of the liquid application member 44 in the second example is not limited to a flat face, and may have a shape in which a part protrudes or is recessed. The shape of the sheet contact face 441*a* of the liquid application member 44 in the first example and the shape of the sheet contact face 441*b* of the liquid application member 44 in the second example is not limited to a circular shape and a polygonal shape.

A description is given of a third example of a liquid application member 44 according to the present disclosure.

Figure 16A:
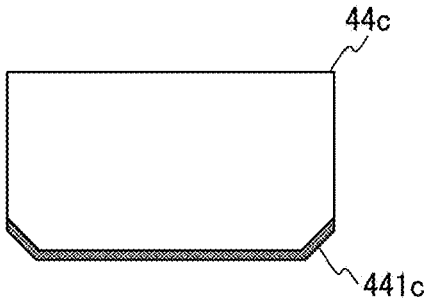
FIGS. 16A, 16B, and 16C are diagrams each illustrating a third example of the shape of a liquid application member according to the first and second embodiments.
Figure 16B:
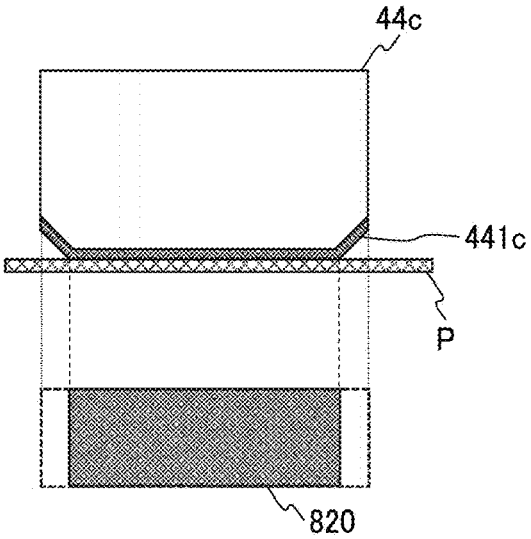
Figure 16C:
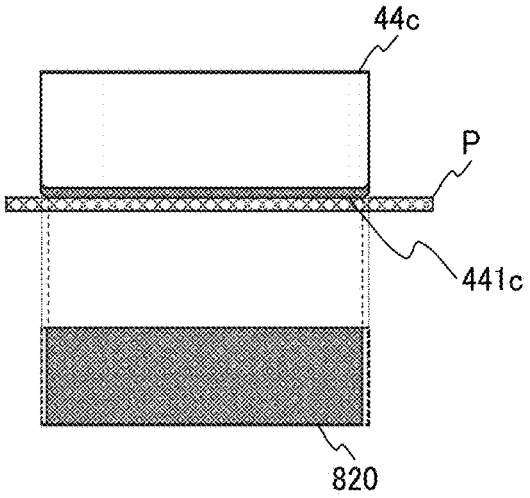

FIGS. 16A, 16B, and 16C are diagrams illustrating the shape of a liquid application member 44*c* that forms a liquid application region 820 by contacting the sheet P in liquid application.

The liquid application member 44*c* illustrated in FIGS. 16A, 16B, and 16C has a shape in which the thicknesses in the direction of movement toward the sheet P are not uniform, and the end portions are thinner than the center portion. In other words, when the liquid application member 44*c* moves toward the sheet P, the center portion of the sheet contact face 441*c* in the width direction first contacts the sheet P, and when the liquid application member 44*c* further moves, the end portion of the sheet contact face 441*c* also contacts the sheet P.

As described above, the liquid application member 44*c* is different in thickness (or in height in a case where the length in the movement direction is the height). By so doing, the sheet contact area of the sheet contact face 441*c* as a face to contact the sheet P can be adjusted, through the liquid application process, in accordance with the amount of movement of the liquid application member 44*c* relative to the sheet P. As a result, the expansion of the liquid application region 820 against the sheet P can be adjusted with the amount of movement of the liquid application member 44*c*.

In other words, the liquid application member 44*c* may have any shape that can increase or decrease the sheet contact area by adjusting the increase and decrease of the amount of movement of the liquid application member 44*c* relative to the sheet P as long as the sheet contact face 441*c* of the liquid application member 44*c* is not limited in the area or the number of sheet contact faces and the liquid application member 44*c* has a difference in thickness (height) due to, for example, a curved portion, an inclined portion, and a step.

As illustrated in FIG. 16B, if the liquid application is terminated immediately when the sheet contact face 441*c* of the liquid application member 44*c* contacts the sheet P to cause the sheet contact face 441*c* of the liquid application member 44*c* to separate from the sheet P, the sheet contact area in which the liquid application member 44*c* contacts the sheet P is reduced. In other words, when the movement amount of the liquid application member 44*c* with respect to the paper P is reduced, the liquid application region 820 can be reduced.

In addition, as illustrated in FIG. 16C, as the liquid application member 44*c* is further moved toward the sheet P from the timing when the sheet contact face 441*c* of the liquid application member 44*c* contacts the sheet P, the sheet contact area in which the sheet contact face 441*c* of the liquid application member 44*c* contacts the sheet P increases. In other words, increasing the amount of movement of the liquid application member 44*c* to the sheet P can increase the liquid application region 820.

As described above, the size of the liquid application region 820 can be adjusted by adjusting the size of the sheet contact area where the sheet contact face 441*c* of the liquid application member 44*c* contacts the sheet P, by using the difference in height of the shape of the sheet contact face of the sheet contact face 441*c* (the difference in thickness of the liquid application member 44*c*) and the amount of movement of the liquid application member 44*c* to the sheet P. Accordingly, the process of applying an appropriate amount of liquid to the binding regions 810 having the numbers of binding times different from each other can be performed with a single liquid application by a single liquid application member 44.

Figure 17A:
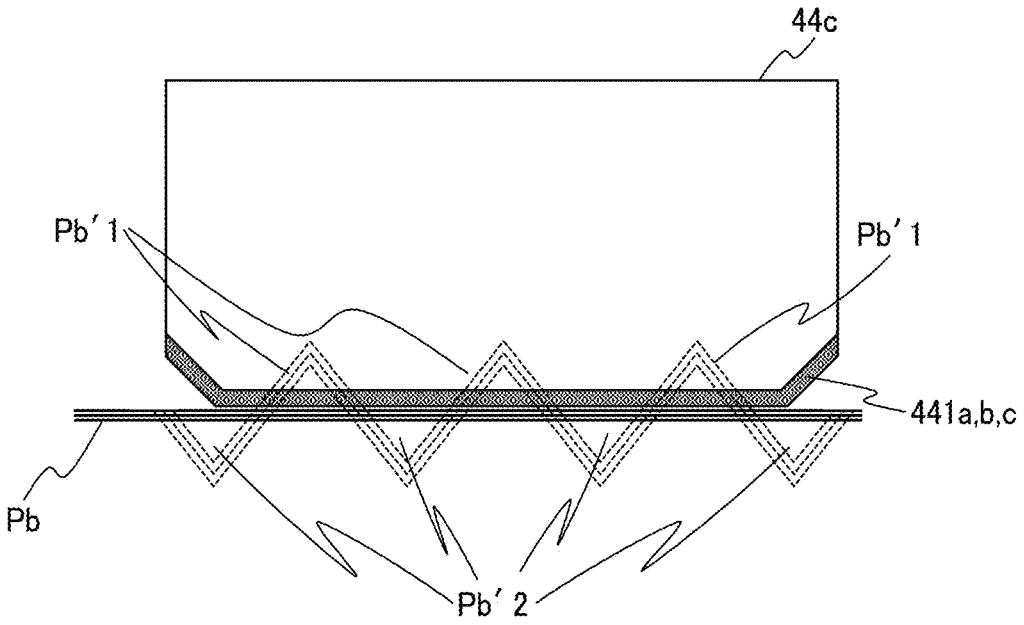
FIGS. 17A and 17B are diagrams illustrating a relation of the contact face of the liquid application member and the crimping trace and the binding region of a sheet bundle after a crimp binding process.
Figure 17B:
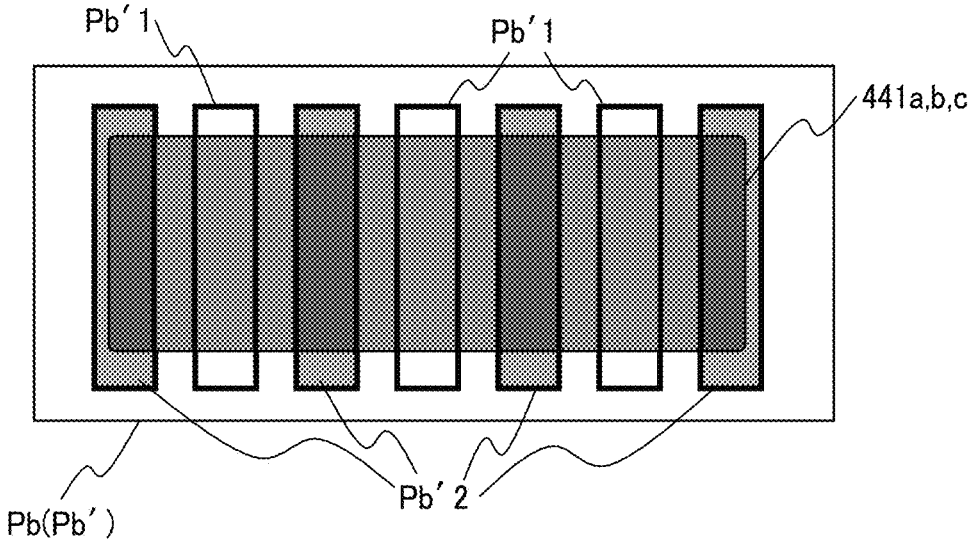

FIGS. 17A and 17B are diagrams illustrating a relation of the sheet contact face of the liquid application member 44*c* and the crimping trace (multiple convex and concave portions) and the binding region of a sheet bundle Pb after a crimp binding process is performed on the sheet bundle Pb.

FIG. 17A is a cross sectional view of the liquid application member 44*c* and the sheet bundle Pb before and after the crimp binding process.

FIG. 17B is a plan view of the liquid application member 44*c* and the sheet bundle Pb of FIG. 17A.

In FIG. 17A, the sheet bundle Pb indicates a sheet bundle before being crimped and bound by the crimper 32 including the upper crimping teeth 32*a* and the lower crimping teeth 32*b*. Further, a sheet bundle Pb' indicates a sheet bundle that has been crimped and bound by the crimper 32 and that includes multiple convex portions Pb'1 (and multiple concave portions Pb'2) are formed by being pressed and deformed by the crimper 32. The sheet contact faces 441*a* of the liquid application member 44*a* in the first example, the sheet contact face 441*b* of the liquid application member 44*b* in the second example, and the sheet contact face 441*c* of the liquid application member 44*c* in the third example described above are disposed so that the position to contact the sheet bundle Pb due to the liquid application continuously straddles the multiple convex portions Pb'1 (and the multiple concave portions Pb'2) of the sheet bundle Pb' that has been crimped and bound by the crimper 32, as illustrated in FIG. 17A.

By forming the sheet contact faces 441*a*, 441*b*, and 441*c* of the liquid application member 44*c* so that same have such a positional relationship, the region in which the plurality of convex portions Pb'1 (concave portions Pb'2) formed in the sheet bundle Pb' crimped and bound by the crimper 32 is formed corresponds to the sheet contact faces 441*a*, 441*b*, and 441*c* as illustrated in FIG. 17B, and the liquid application amount can be uniformly applied, without being biased, to a predetermined region of the sheet bundle Pb before same is crimped and bound. Thus, the strength of the sheet bundle Pb can be enhanced.

In any of the first, second, and third examples described above, the liquid discharged from the liquid application member 44 by the movement of the liquid application member 44*c* with respect to the sheet P is spread to the sheet contact face 441*c*, and thus the sheet contact face 441*c* contacts and presses the sheet P and the liquid is applied to the sheet P through the sheet contact face 441*c*. By so doing, the unevenness of the amount of liquid application due to the sheet contact area and the amount of movement can be reduced.

Figure 27A:
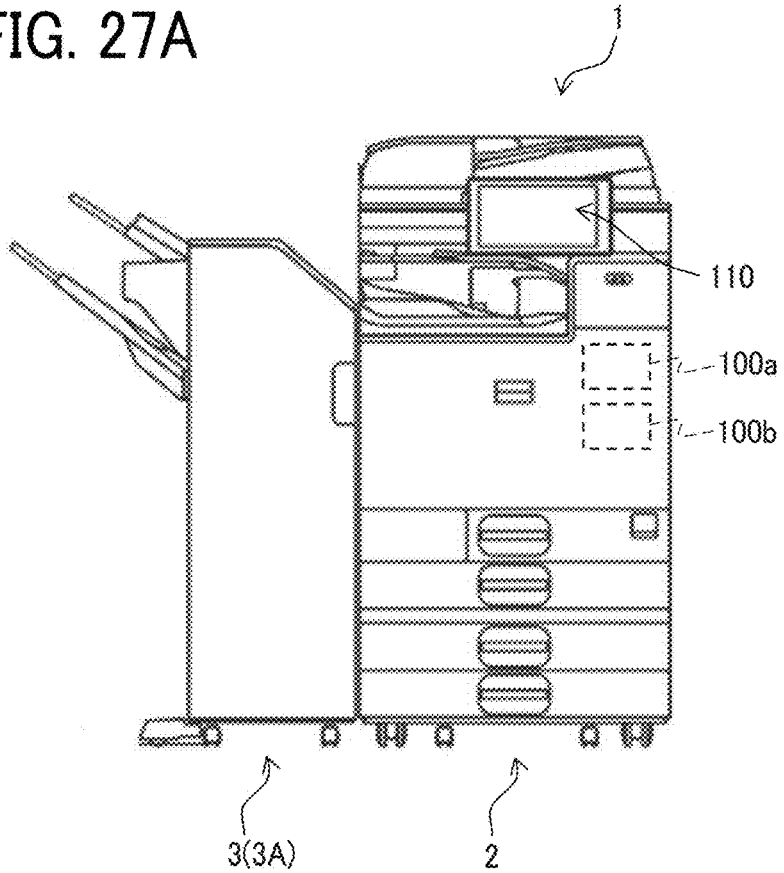
FIGS. 27A and 27B are schematic views of a post-processing apparatus including controllers as a first modification of the embodiment illustrated in FIG. 1.
Figure 27B:
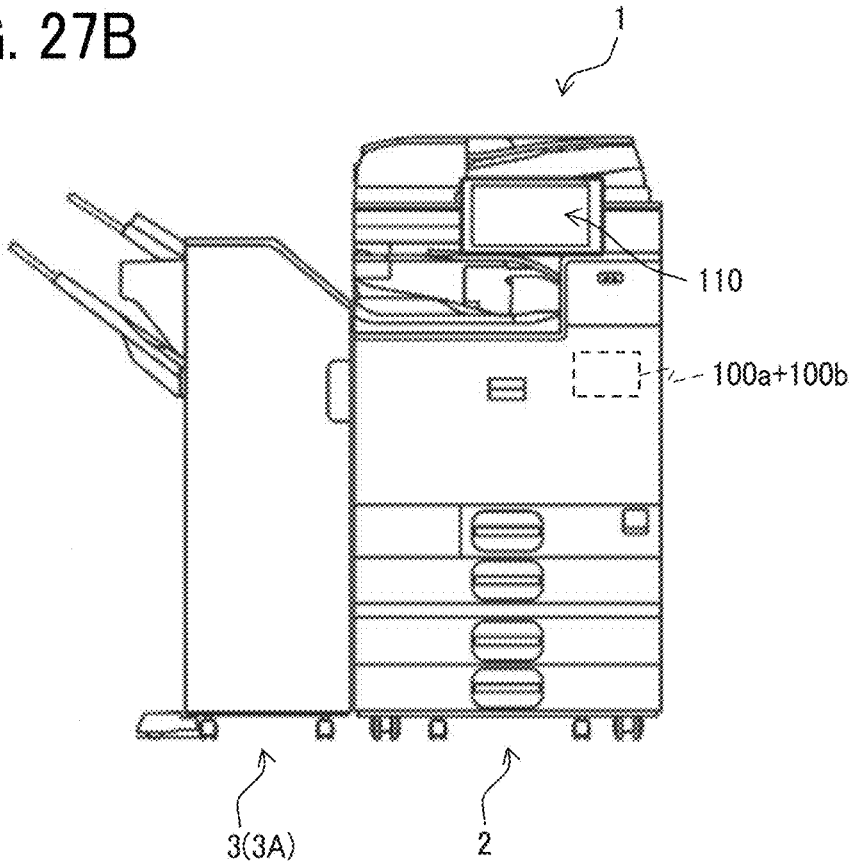

In the above description, the controller 100*b* of the post-processing apparatus 3 is provided separately from the controller 100*a* of the image forming apparatus 2 as illustrated in FIG. 1. However, embodiments of the present disclosure are not limited to the above-described configuration. For example, as illustrated in FIG. 27A, the controller 100B of the post-processing apparatus 3 may be disposed in the image forming apparatus 2. Further, as illustrated in FIG. 27B, the controller 100*b* of the post-processing apparatus 3 may be integrated with the controller 100*a* of the image forming apparatus 2.

Figure 28A:
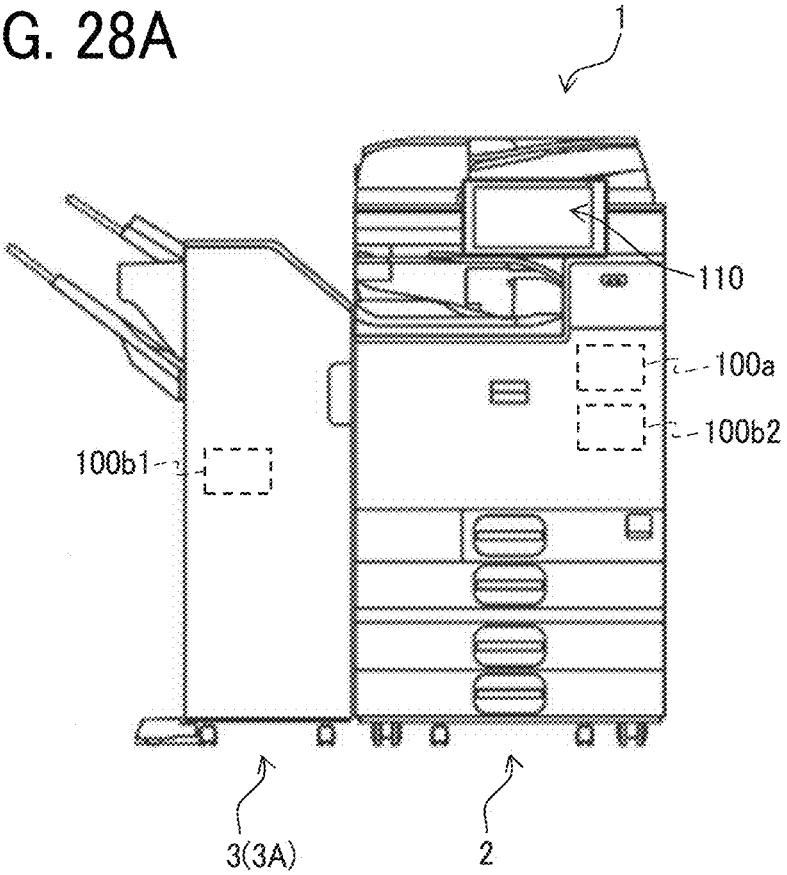
FIGS. 28A and 28B are schematic views of a post-processing apparatus including controllers as a second modification of the embodiment illustrated in FIG. 1.
Figure 28B:
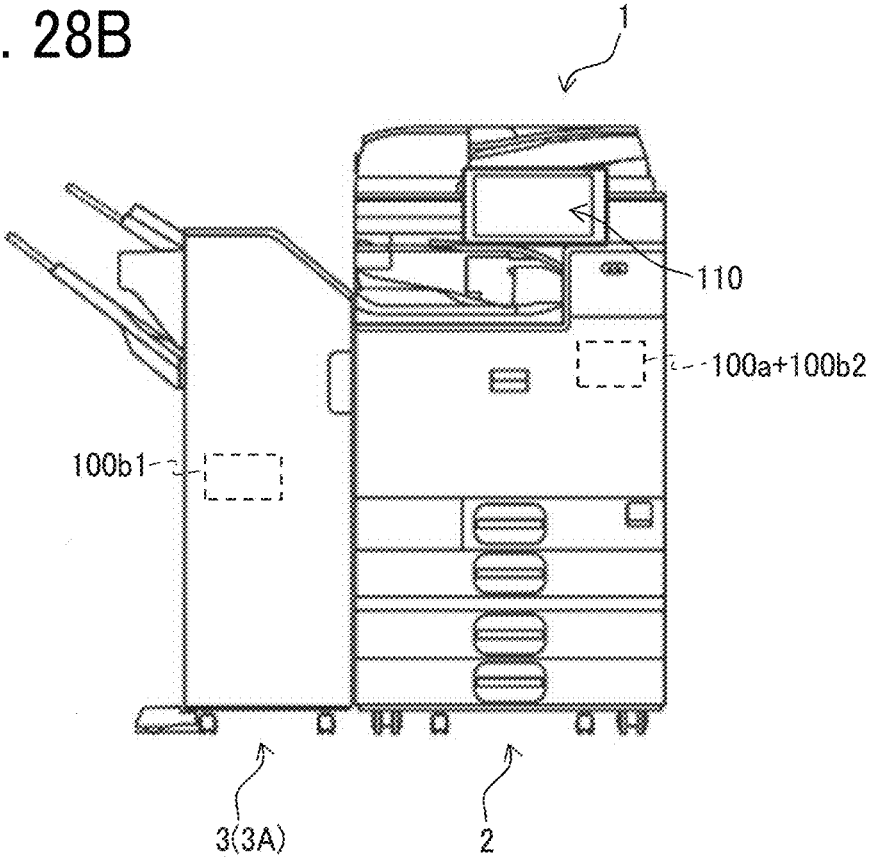

As illustrated in FIG. 28A, the controller 100*b* of the post-processing apparatus 3 may be divided into a controller 100*b*1 (e.g., a driver system such as a motor) and a controller 100*b*2 (a detector such as a sensor) according to the function, and the controller 100*b*2 of the post-processing apparatus 3 may be disposed in the image forming apparatus 2. Further, as illustrated in FIG. 28B, the controller 100*b*2 of the post-processing apparatus 3 disposed in the image forming apparatus 2 may be integrated with the controller 100*a* of the image forming apparatus 2.

A description is given of the post-processing apparatus 3 according to another embodiment of the present disclosure.

Referring now to FIGS. 18 to 26, a description is given of a post-processing apparatus 3A according to another embodiment of the present disclosure.

In the following description, components like those of the above-described embodiment are denoted by like reference numerals, and detailed descriptions thereof may be omitted.

The post-processing apparatus 3A according to another embodiment includes an edge binder 251. The edge binder 251 is different from the edge binder 25 of the post-processing apparatus 3 according to the first embodiment, in which the liquid applier 31 and the crimper 32 are arranged side by side, in that the edge binder 251 includes a crimper 32' and a liquid applier 131 is disposed at an upstream position of a conveyance passage in a direction in which a sheet P is conveyed. Such a configuration allows a given number of sheets P to be stacked after the liquid application process and conveyed to the crimper 32' of the edge binder 251 disposed at a downstream position of the conveyance passage in the direction in which the sheet P is conveyed. Accordingly, the productivity of the binding process performed by the crimper 32' is enhanced.

Since the direction in which the conveyance roller pairs 10, 11, and 14 convey the sheet P is opposite to the "conveyance direction" defined above, the direction in which the conveyance roller pairs 10, 11, and 14 convey the sheet P is defined as an "opposite conveyance direction" in the following description. A direction that is orthogonal to both the opposite conveyance direction and the thickness direction of the sheet P is defined as the "main scanning direction" or the "width direction of the sheet P."

The liquid application position to which the liquid is applied on the sheet P or the sheet bundle Pb by the liquid applier 31 corresponds to the binding position on the sheet bundle Pb to be crimped by the crimper 32'. For this reason, in the following description, the liquid application position and the binding position are denoted by the same reference sign (B1).

Figure 18:
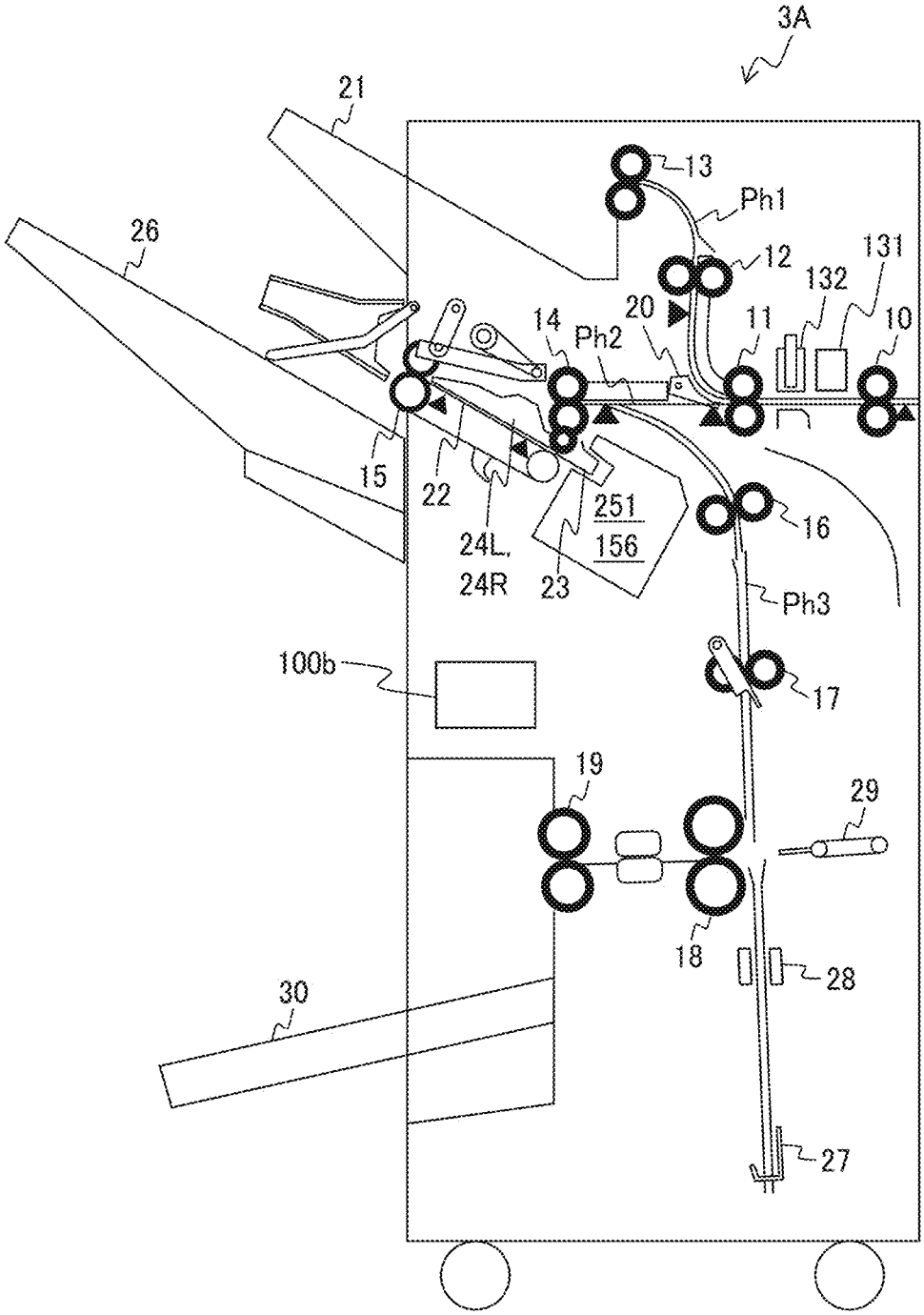
FIG. 18 is a diagram illustrating the internal configuration of a post-processing apparatus according to another embodiment of the present disclosure.

FIG. 18 is a diagram illustrating an internal configuration of the post-processing apparatus 3A according to another embodiment of the present disclosure.

Figure 19A:
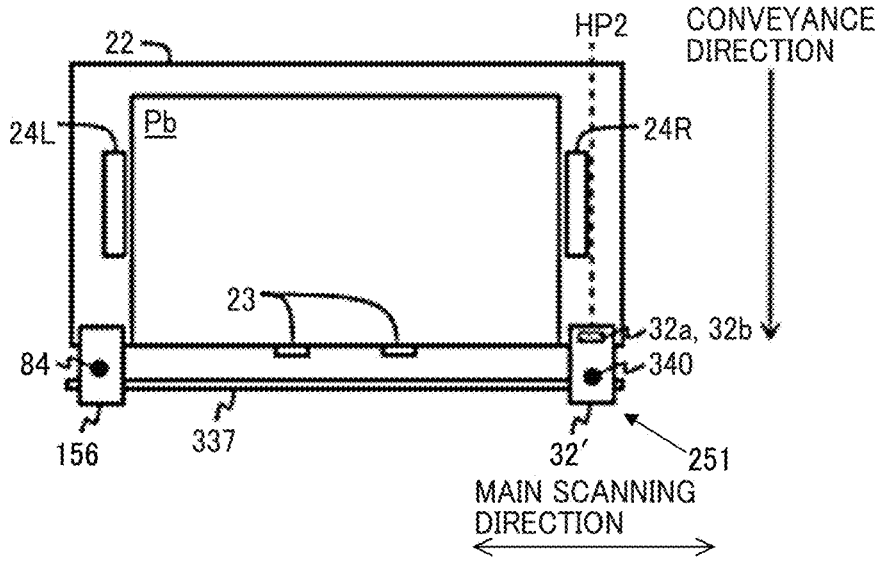
FIGS. 19A, 19B, and 19C are schematic views of an internal tray of the post-processing apparatus according to another embodiment of FIG. 18, viewed from a thickness direction of a sheet.
Figure 19B:
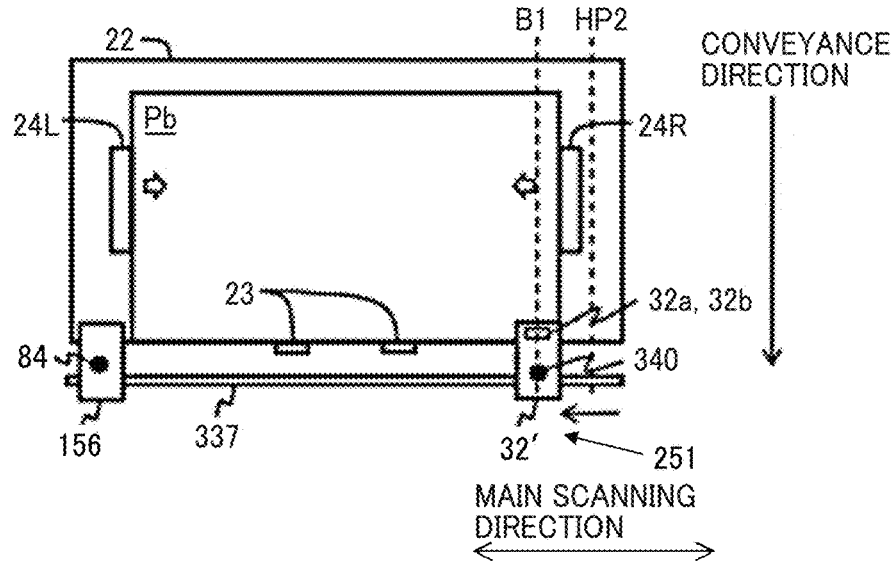
Figure 19C:
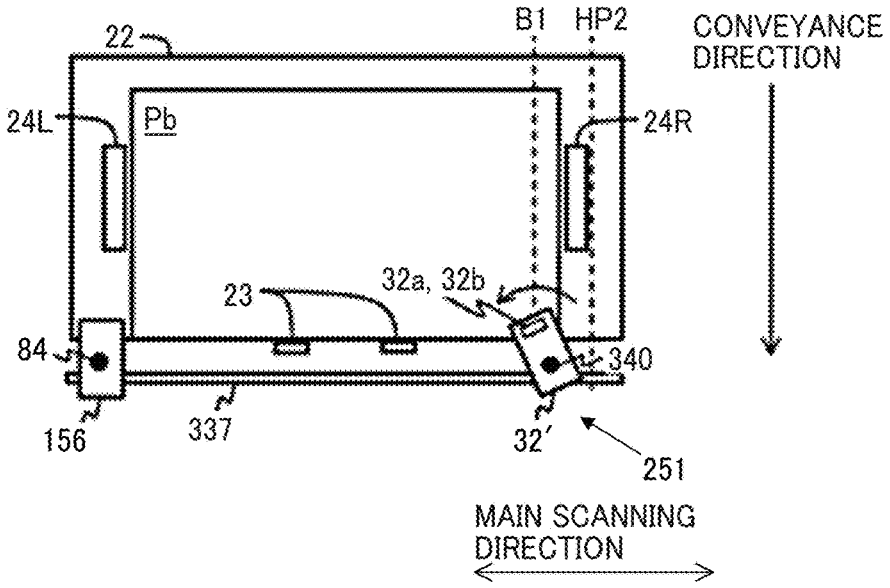

As illustrated in FIGS. 19A, 19B, and 19C, the edge binder 251 includes the crimper 32' alone. As illustrated in FIG. 19, the crimper 32' and a staple binder 156 are disposed downstream from the internal tray 22 in the conveyance direction. In addition, the crimper 32' and the staple binder 156 are located to face a downstream end, in the conveyance direction, of the sheet bundle Pb placed on the internal tray 22 and is movable in the main scanning direction.

Further, the crimper 32' and the staple binder 156 are respectively rotatable in the forward and reverse directions about a crimper shaft 340 and a stapler shaft 84 both extending in the thickness direction of the sheet bundle Pb placed on the internal tray 22. In other words, the crimper 32' and the staple binder 156 bind, at a desired angle, a desired position in the main scanning direction on the sheet bundle Pb placed on the internal tray 22 in, for example, corner oblique binding, parallel one-point binding, or parallel two-point binding.

The crimper 32' presses and deforms the sheet bundle Pb with the serrate upper crimping teeth 32*a* and the serrate lower crimping teeth 32*b* to bind the sheet bundle Pb. In the following description, such a binding way may be referred to as "crimping." In other words, the crimper 32' crimps and binds the sheet bundle Pb or performs the crimping on the sheet bundle Pb. On the other hand, the staple binder 156 passes the staple through a binding position on the sheet bundle Pb placed on the internal tray 22 to staple the sheet bundle Pb.

FIGS. 19A, 19B, and 19C are schematic views of the internal tray 22 as viewed from the thickness direction of the sheet bundle Pb.

Figure 20:
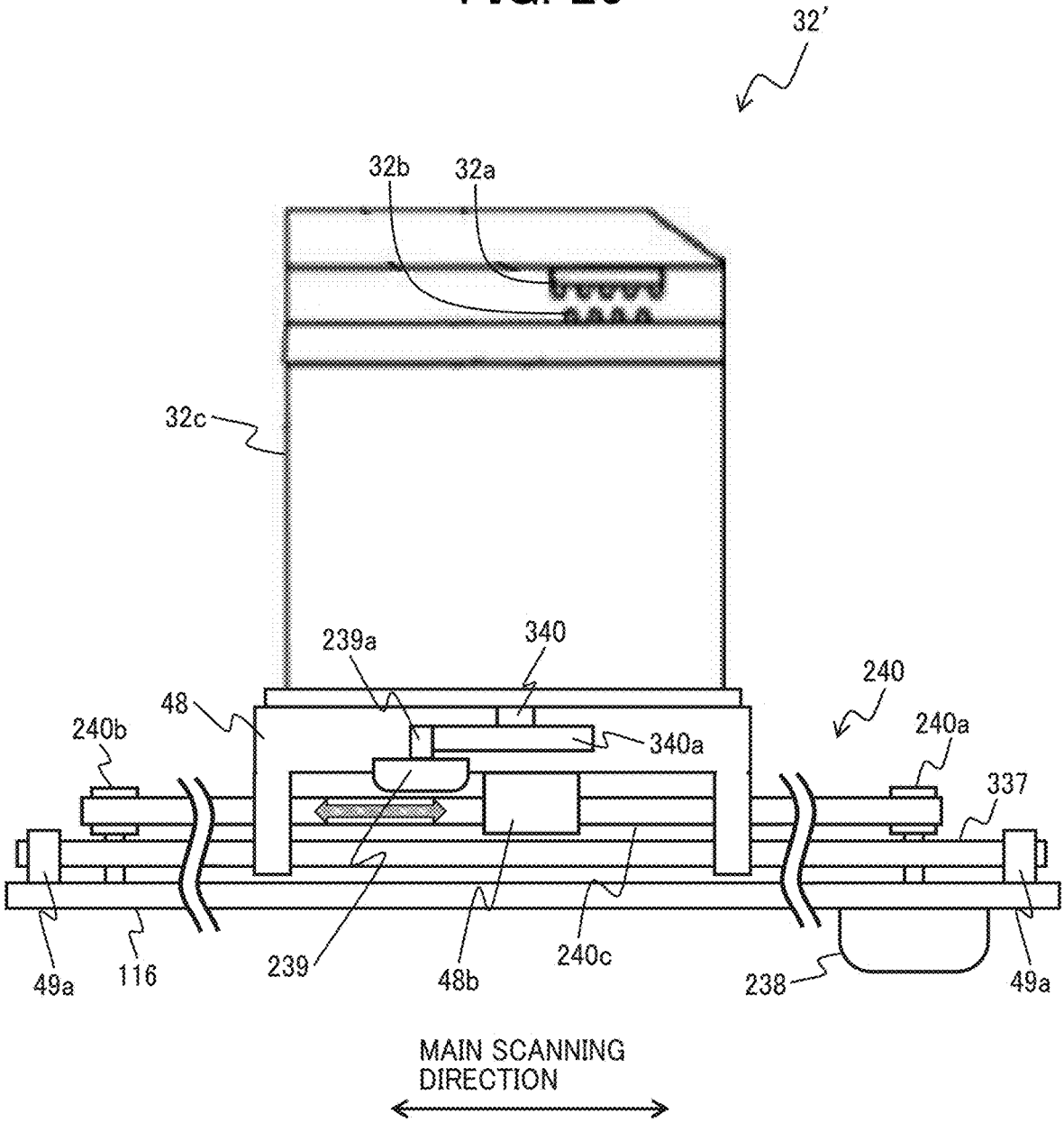
FIG. 20 is a schematic diagram illustrating a downstream side of a crimper of the post-processing apparatus according to another embodiment of FIG. 18 in the conveyance direction.

FIG. 20 is a schematic view of the crimper 32' as viewed from the conveyance direction.

As illustrated in FIG. 19, the crimper 32' and the staple binder 156 are disposed downstream from the internal tray 22 in the conveyance direction. The crimper 32' is movable in the main scanning direction along the surface of the sheet bundle Pb placed on the internal tray 22. Further, the crimper 32' is rotatable in the forward and reverse directions about a crimper shaft 340 extending in the thickness direction of the sheet bundle Pb placed on the internal tray 22.

Similarly, the staple binder 156 is movable in the main scanning direction of the sheet bundle Pb. Further, the staple binder 156 is rotatable in the forward and reverse directions about a stapler shaft 84 extending in thickness direction of the sheet bundle Pb. The other components of the staple binder 156 are similar to, even if not the same as, those of the staple binder 55 (see FIG. 6) of the post-processing apparatus 3 according to the first embodiment. For this reason, a detailed description thereof is omitted.

As illustrated in FIG. 20, the crimper 32' includes a guide rail 337 extending in the main scanning direction at a position downstream from the internal tray 22 in the conveyance direction. The crimper 32' includes a crimper movement motor 238 as a driving source. The base 48 supporting the crimping frame 32*c* has a fastening portion 48*b* for fastening the timing belt 240*c* at the bottom of the base 48. The driving force of the crimper movement motor 238 is transmitted to the base 48 by the drive transmission assembly 240 that includes the pullies 240*a* and 240*b*, the timing belt 240*c*, and the fastening portion 48*b*. By so doing, the crimper 32' is moved in the main scanning direction along the surface of the sheet bundle Pb placed on the internal tray 22, in other words, along the guide rail 337. A crimper shaft 340 including a drive transmission gear 340*a* is fixed to a bottom face of the crimping frame 32*c* that holds the components of the crimper 32.

The crimper shaft 340 and the drive transmission gear 340*a* are held by the base 48 on which the crimping frame 32*c* is disposed, so as to be rotatable in the forward and reverse directions. The drive transmission gear 340*a* meshes with an output gear 239*a* of a crimper pivot motor 239. When the driving force of the crimper pivot motor 239 is transmitted to the crimper shaft 340 via the output gear 239*a* and the drive transmission gear 340*a*, the crimper 32' is rotatable in the forward and reverse directions on the base 48 about the crimper shaft 340 extending in the thickness direction of the sheet P placed on the internal tray 22. The guide rail 337, the crimper movement motor 238, the crimper pivot motor 239, the crimper shaft 340, and the drive transmission assembly 240 constitute at least part of a driving assembly of the crimper 32' according to the present embodiment.

The crimper 32' is movable between a standby position HP2 illustrated in FIG. 19A and a position where the crimper 32' faces the first binding position B1 illustrated in FIGS. 19B and 19C. The standby position HP2 is away in the main scanning direction from the sheet bundle Pb placed on the internal tray 22. For example, in FIGS. 21A to 21C, the standby position HP is distanced to the right of the sheet bundle Pb along the main scanning direction. The first binding position B1 is a position on the sheet bundle Pb placed on the internal tray 22. However, the specific position of the first binding position B1 is not limited to the position illustrated in FIGS. 22B and 22C. The first binding position B1 may be one or more positions along the main scanning direction at the downstream end, in the conveyance direction, of the sheet P.

The posture of the crimper 32' changes or is pivoted between a parallel binding posture illustrated in FIG. 19B and an oblique binding posture illustrated in FIG. 19C. In other words, the crimper 32' is rotatable in the forward and reverse directions about the crimper shaft 340. The parallel binding posture is a posture of the crimper 32' in which the longitudinal direction of the upper crimping teeth 32*a* and the lower crimping teeth 32*b* (in other words, a rectangular crimp binding trace) is along the main scanning direction. The oblique binding posture is a posture of the crimper 32' in which the longitudinal direction of the upper crimping teeth 32*a* and the lower crimping teeth 32*b* (i.e., the rectangular crimp binding trace) is inclined with respect to the main scanning direction.

The pivot angle, which is an angle of the upper crimping teeth 32*a* and the lower crimping teeth 32*b* with respect to the main scanning direction, in the oblique binding posture is not limited to the angle of rotation illustrated in FIG. 19C. The pivot angle in the oblique binding posture may be any angle provided that the upper crimping teeth 32*a* and the lower crimping teeth 32*b* face the sheet bundle Pb placed on the internal tray 22.

The post-processing apparatus 3A includes the liquid applier 131 and a hole punch 132 serving as a processor. The liquid applier 131 and the hole punch 132 are disposed upstream from the internal tray 22 in the opposite conveyance direction. In addition, the liquid applier 131 and the hole punch 132 are disposed at different positions in the opposite conveyance direction to simultaneously face one sheet P that is conveyed by the conveyance roller pairs 10 to 19.

Figure 26:
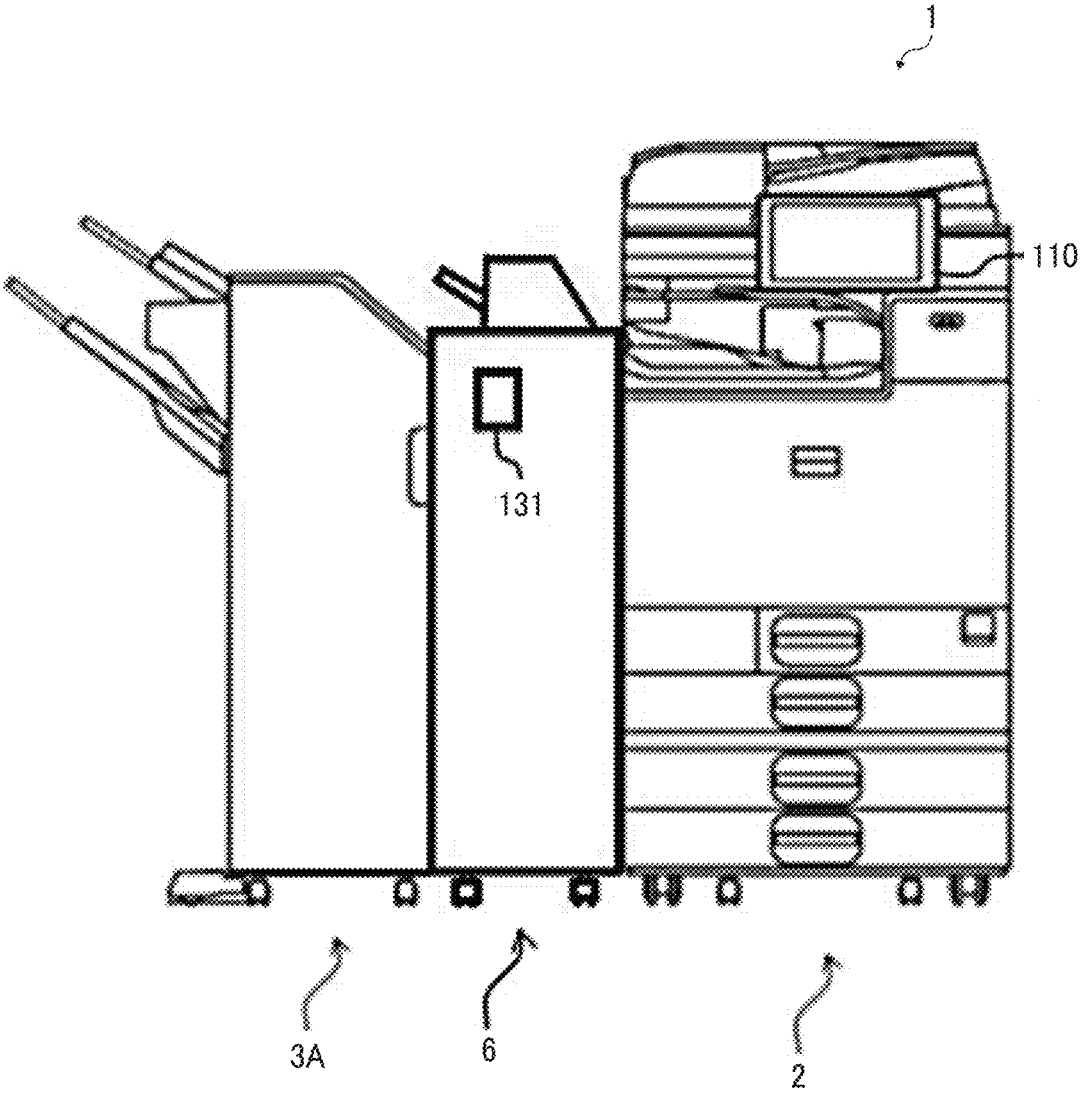
FIG. 26 is a diagram illustrating the overall configuration of an image forming system according to a modification of the embodiment illustrated in FIG. 1.

The liquid applier 131 and the hole punch 132 according to the present embodiment are disposed between the conveyance roller pairs 10 and 11. However, the arrangement of the liquid applier 131 is not limited to the example of FIG. 18. For example, in a case where an inserter 6 is disposed between the image forming apparatus 2 and the post-processing apparatus 3A as illustrated in FIG. 26, the liquid applier 131 may be disposed inside the inserter 6 located upstream from the post-processing apparatus 3A in a direction in which the sheet P is conveyed from the image forming apparatus 2 to the post-processing apparatus 3A. Examples of the inserter 6 include, but are not limited to, an apparatus that allows a pre-printed medium, which is to be conveyed to the post-processing apparatus 3A together with the sheet P conveyed from the image forming apparatus 2, to be fed as a cover sheet, an insertion sheet, or a partition sheet without passing through the image forming apparatus 2.

Figure 21A:
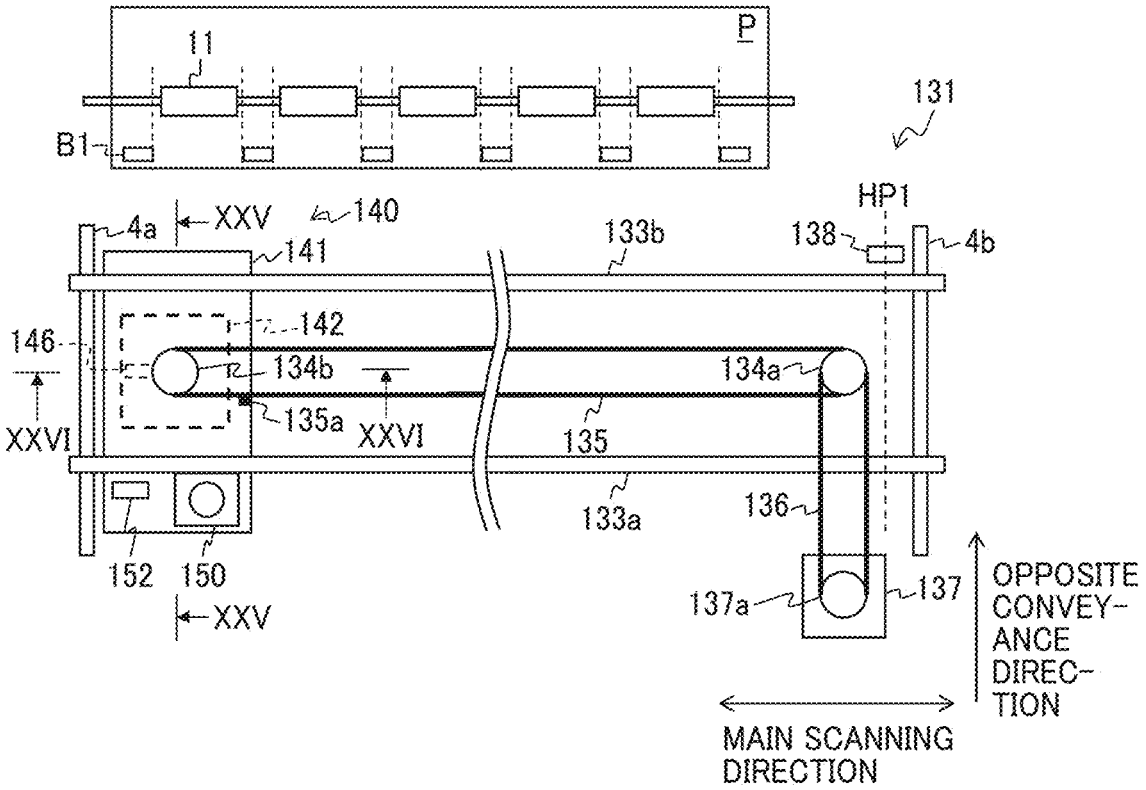
FIGS. 21A and 21B are schematic views of a liquid applier of the post-processing apparatus according to another embodiment of FIG. 18, viewed from the thickness direction of the sheet.

As illustrated in FIG. 21A, the conveyance roller pair 11 is located so as not to overlap, in the main scanning direction, the first liquid application position B1 on the sheet P to which the liquid has been applied by a liquid application head 146 of the liquid applier 131. This arrangement is to prevent the amount of liquid at the first liquid application position B1 from decreasing due to the multiple roller pairs pressing the first liquid application position B1 when the conveyance roller pair 11 conveys the sheet P. As a result, when the sheet P reaches the crimper 32' disposed downstream from the liquid applier 131 in the opposite conveyance direction, the amount of liquid at the first liquid application position B1 is sufficient to maintain the binding strength. Accordingly, the binding strength of the sheet bundle Pb is prevented from decreasing due to a decrease in the amount of liquid at the first liquid application position B1 (corresponding to the first binding position B1) while the sheet P is conveyed.

In addition, the multiple roller pairs of the conveyance roller pair 11 that is located so as not to overlap the first liquid application position B1 on the sheet P in the main scanning direction prevents the conveying performance of the sheet P from being worse due to the adhesion of liquid to the multiple roller pairs and further prevents a conveyance jam caused by the worsened conveying performance of the sheet P.

Although only the conveyance roller pair 11 has been described above, the multiple roller pairs of the conveyance roller pairs 14 and 15 are preferably located so as not to overlap the first liquid application position B1 on the sheet P in the main scanning direction, like the multiple roller pairs of the conveyance roller pair 11.

The liquid applier 131 applies liquid to the sheet P that is conveyed by the conveyance roller pairs 10 and 11. In the following description, the application of liquid may be referred to as "liquid application." The hole punch 132 punches a hole in the sheet P that is conveyed by the conveyance roller pairs 10 and 11 such that the hole penetrates the sheet P in the thickness direction of the sheet P. The processor disposed near the liquid applier 131 is not limited to the hole punch 132. Alternatively, the processor may be an inclination corrector that corrects an inclination or skew of the sheet P that is conveyed by the conveyance roller pairs 10 and 11.

Figure 21B:
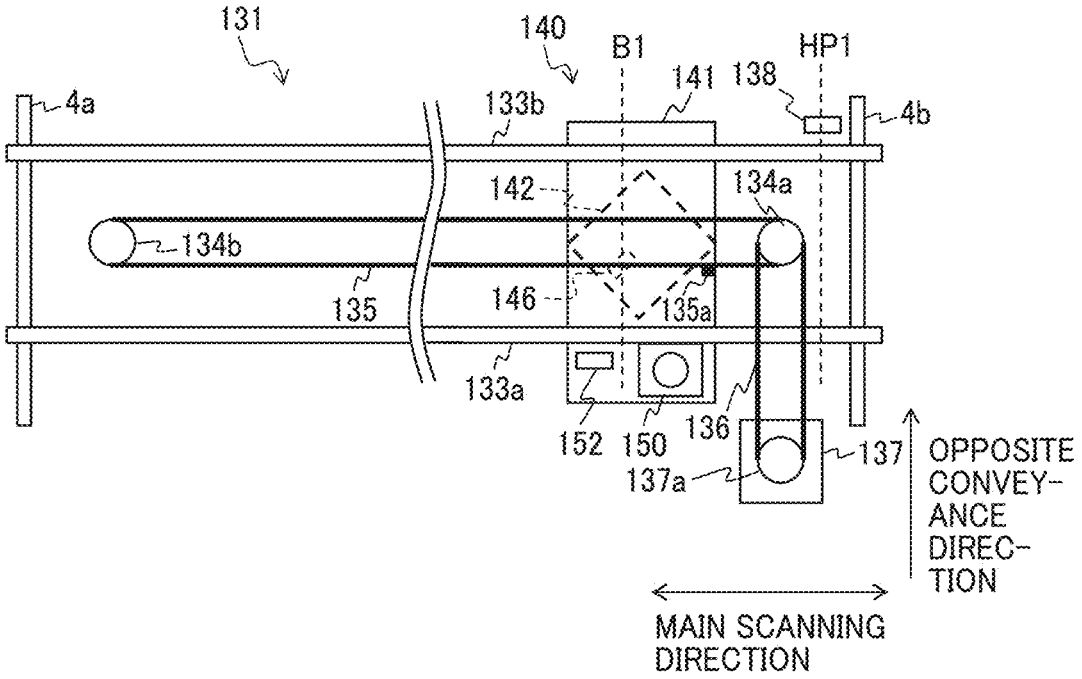

FIGS. 21A and 21B are schematic views of the liquid applier 131 in the thickness direction of the sheet P, according to another embodiment of the present disclosure.

Figure 22A:
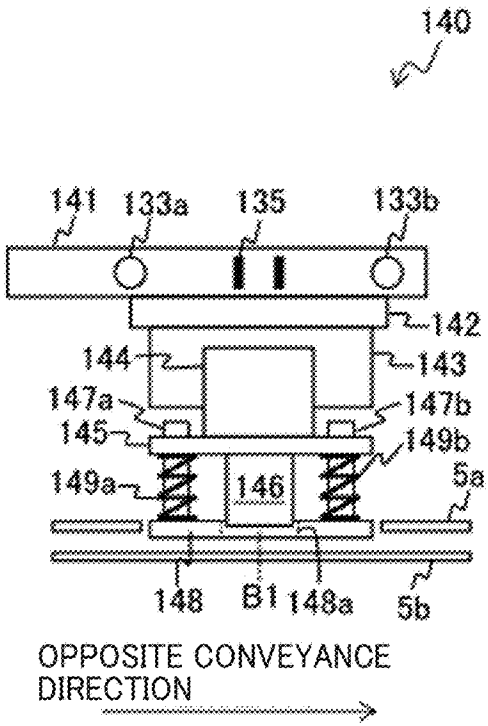
FIGS. 22A, 22B, and 22C are cross-sectional views of a liquid application unit of the liquid applier, taken along a line XXV-XXV of FIG. 21A.
Figure 22B:
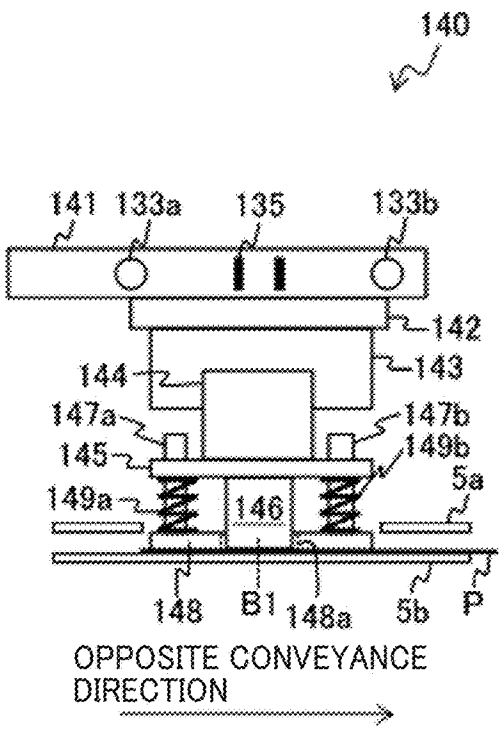
Figure 22C:
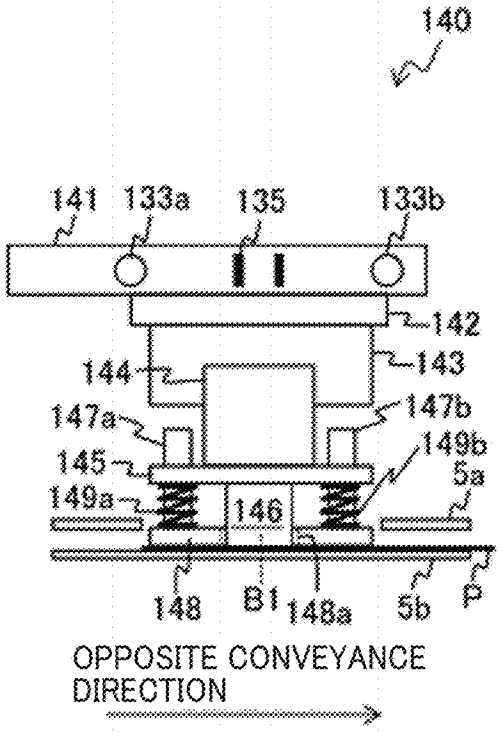

FIGS. 22A, 22B, and 22C are cross-sectional views of the liquid applier 131 taken along line XXV-XXV of FIG. 21A.

Figure 23A:
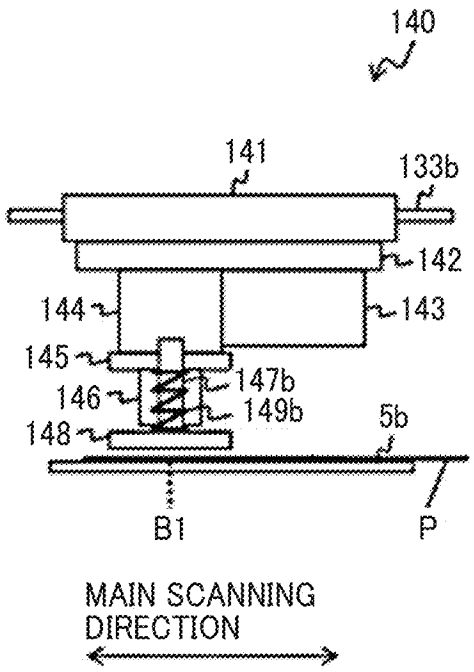
FIGS. 23A, 23B, and 23C are cross-sectional views of the liquid application unit of the liquid applier, taken along a line XXVI-XXVI of FIG. 21A.
Figure 23B:
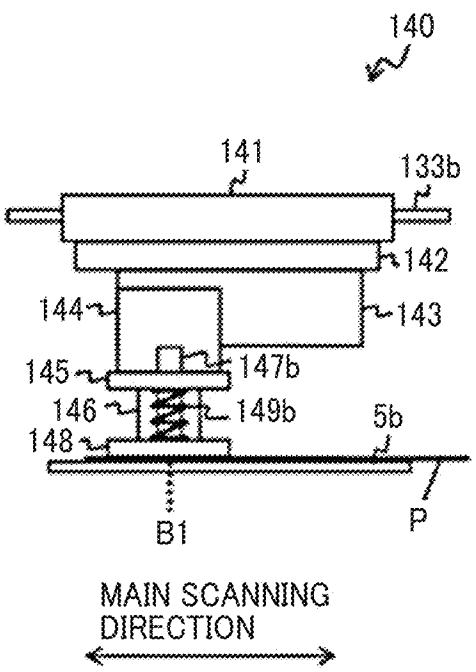
Figure 23C:
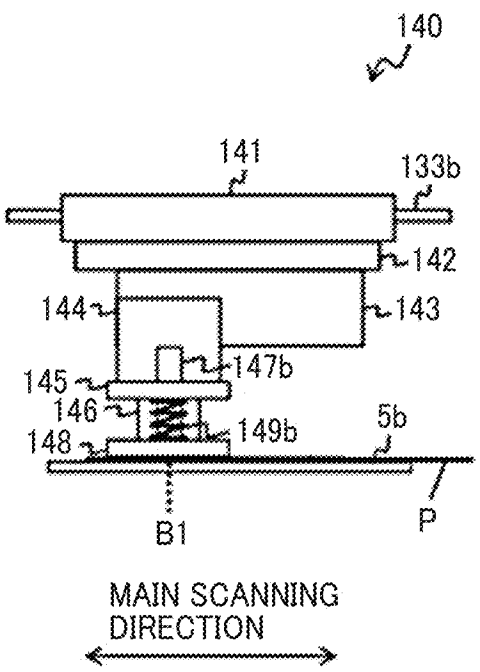

FIGS. 23A, 23B, and 23C are cross-sectional views of the liquid applier 131 taken along line XXVI-XXVI of FIG. 21A.

As illustrated in FIGS. 21A to 23C, the liquid applier 131 includes a pair of guide shafts 133*a* and 133*b*, a pair of pulleys 134*a* and 134*b*, endless annular belts 135 and 136, a liquid applier movement motor 137, a standby position sensor 138, and a liquid application unit 140.

The guide shafts 133*a* and 133*b*, each extending in the main scanning direction, are spaced apart from each other in the opposite conveyance direction. The pair of guide shafts 133*a* and 133*b* are supported by a pair of side plates 4*a* and 4*b* of the post-processing apparatus 3A. The pair of guide shafts 133*a* and 133*b* support the liquid application unit 140 such that the liquid application unit 140 can move in the main scanning direction.

The pair of pulleys 134*a* and 134*b* is disposed between the pair of guide shafts 133*a* and 133*b* in the opposite conveyance direction. The pair of pulleys 134*a* and 134*b* are spaced apart from each other in the main scanning direction. The pair of pulleys 134*a* and 134*b* are supported by a frame of the post-processing apparatus 3A so as to be rotatable in the forward and reverse directions about the respective shafts extending in the thickness direction of the sheet P.

The endless annular belt 135 is looped around the pair of pulleys 134*a* and 134*b*. The endless annular belt 135 is coupled to the liquid application unit 140 by a connection 135*a*. The endless annular belt 136 is entrained around the pulley 134*a* and a driving pulley 137*a* that is fixed to an output shaft of the liquid applier movement motor 137. The liquid applier movement motor 137 generates a driving force to move the liquid application unit 140 in the main scanning direction.

As the liquid applier movement motor 137 rotates, the endless annular belt 136 circulates around the pulley 134*a* and the driving pulley 137*a* to rotate the pulley 134*a*. As the pulley 134*a* rotates, the endless annular belt 135 circulates around the pair of pulleys 134*a* and 134*b*. As a result, the liquid application unit 140 moves in the main scanning direction along the pair of guide shafts 133*a* and 133*b*. The liquid application unit 140 reciprocates in the main scanning direction in response to switching of the rotation direction of the liquid applier movement motor 137.

The standby position sensor 138 detects that the liquid application unit 140 has reached a standby position HP1 (see FIGS. 21A and 21B) in the main scanning direction. The standby position sensor 138 then outputs a standby position signal indicating the detection result to the controller 100*b*, which will be described below with reference to FIG. 24. The standby position sensor 138 is, for example, an optical sensor including a light emitter and a light receiver. The liquid application unit 140 at the standby position blocks an optical path between the light emitter and the light receiver. The standby position sensor 138 outputs the standby position signal in response to the light output from the light emitter not being received by the light receiver. The specific configuration of the standby position sensor 138 is not limited to the configuration described above.

As illustrated in FIGS. 22A, 22B, and 22C, the conveyance passage inside the post-processing apparatus 3A is defined by an upper guide plate 5*a* and a lower guide plate 5*b*, which are spaced apart from each other in the thickness direction of the sheet P. The liquid application unit 140 is located at a position to face an opening of the upper guide plate 5*a*. In other words, the liquid application unit 140 is disposed to face the conveyance passage (a position (at which the liquid application unit 140 is to face the sheet P conveyed along the conveyance passage) through the opening of the upper guide plate 5*a*.

Figure 24:
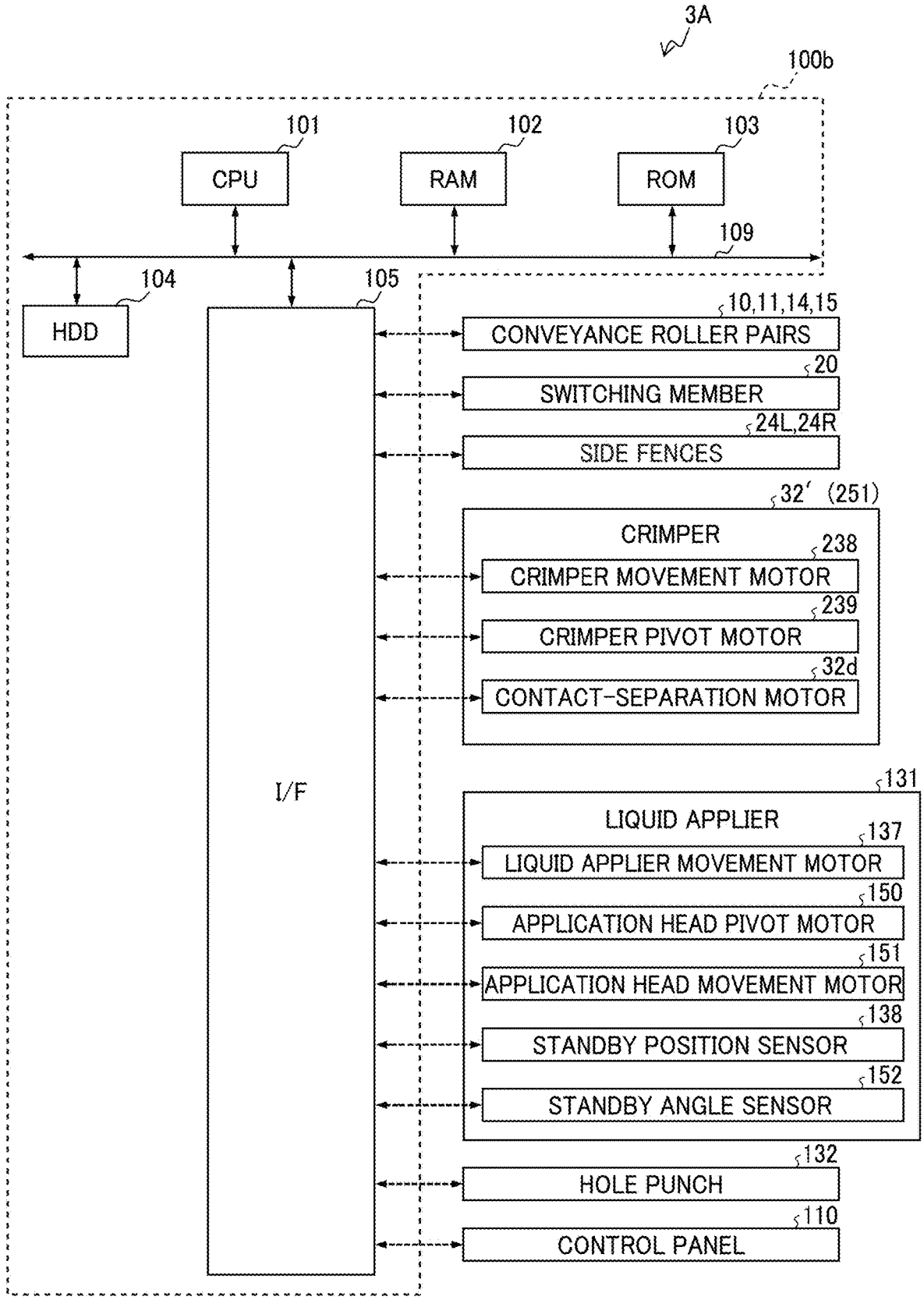
FIG. 24 is a control block diagram illustrating a hardware configuration of the post-processing apparatus according to another embodiment of FIG. 18 to control the operation of the post-processing apparatus.

As illustrated in FIGS. 21A to 23C, the liquid application unit 140 includes a base 141, a rotary bracket 142, a liquid storage tank 143, an application head mover 144, a holder 145, the liquid application head 146, columns 147*a* and 147*b*, a pressure plate 148, coil springs 149*a* and 149*b*, the application head pivot motor 150, the application head movement motor 151 illustrated in FIG. 24, and a standby angle sensor 152, which is also illustrated in FIG. 24.

The base 141 is supported by the pair of guide shafts 133*a* and 133*b* so as to be slidable in the main scanning direction. The base 141 is coupled to the endless annular belt 135 by the connection 135*a*. The base 141 supports the components of the liquid application unit 140 such as the rotary bracket 142, the liquid storage tank 143, the application head mover 144, the holder 145, the liquid application head 146, the columns 147*a* and 147*b*, the pressure plate 148, the coil springs 149*a* and 149*b*, the application head pivot motor 150, the application head movement motor 151, and the standby angle sensor 152.

The rotary bracket 142 is supported by a lower face of the base 141 so as to be rotatable in the forward and reverse directions about an axis extending in the thickness direction of the sheet P. The rotary bracket 142 is rotated with respect to the base 141 by a driving force transmitted from the application head pivot motor 150. The rotary bracket 142 supports the liquid storage tank 143, the application head mover 144, the holder 145, the liquid application head 146, the columns 147*a* and 147*b*, the pressure plate 148, and the coil springs 149*a* and 149*b*.

The standby angle sensor 152, which is also illustrated in FIG. 24, detects that the rotary bracket 142 has reached a standby angle. The standby angle sensor 152 then outputs a standby angle signal indicating the detection result to the controller 100*b*. The standby angle is, for example, an angle for the parallel binding. The standby angle sensor 152 is, for example, an optical sensor including a light emitter and a light receiver. The rotary bracket 142 at the standby angle blocks an optical path between the light emitter and the light receiver. The standby angle sensor 152 outputs the standby angle signal in response to the light output from the light emitter not being received by the light receiver. The specific configuration of the standby angle sensor 152 is not limited to the configuration described above.

FIG. 21A illustrates the rotary bracket 142 in a position for the parallel binding that is performed by the crimper 32' disposed downstream from the liquid applier 131 in a direction in which the sheet P is conveyed.

FIG. 21B illustrates the rotary bracket 142 in a position for the oblique binding (i.e., corner binding) that is performed by the crimper 32' disposed downstream from the liquid applier 131 in the direction in which the sheet P is conveyed.

The liquid storage tank 143 stores liquid to be applied to the sheet P. The application head mover 144 is attached by the liquid storage tank 143 so as to be movable (e.g., up and down) in the thickness direction of the sheet P. The application head mover 144 is moved with respect to the liquid storage tank 143 by a driving force transmitted from the application head movement motor 151. The holder 145 is attached to a lower end of the application head mover 144. The liquid application head 146 projects from the holder 145 toward the conveyance passage (downward in the present embodiment). The liquid that is stored in the liquid storage tank 143 is supplied to the liquid application head 146. The liquid application head 146 is made of a material having a relatively high liquid absorption (e.g., sponge or fiber).

The columns 147*a* and 147*b* project downward from the holder 145 around the liquid application head 146. The columns 147*a* and 147*b* can move relative to the holder 145 in the thickness direction. The columns 147*a* and 147*b* have respective lower ends holding the pressure plate 148. The pressure plate 148 has a through hole 148*a* at a position where the through hole 148*a* faces the liquid application head 146. The coil springs 149*a* and 149*b* are fitted around the columns 147*a* and 147*b*, respectively, between the holder 145 and the pressure plate 148. The coil springs 149*a* and 149*b* bias the columns 147*a* and 147*b* and the pressure plate 148 in a direction away from the holder 145.

As illustrated in FIGS. 22A and 23A, before the sheet P is conveyed to the position where the sheet P faces the opening of the upper guide plate 5*a*, the pressure plate 148 is positioned at or above the opening. Subsequently, when the sheet P that is conveyed by the conveyance roller pairs 10 and 11 stops at a position where the first liquid application position B1 on the sheet P faces the opening, the application head movement motor 151 is rotated in a first direction. As a result, the application head mover 144, the holder 145, the liquid application head 146, the columns 147*a* and 147*b*, the pressure plate 148, and the coil springs 149*a* and 149*b* are moved down together to allow the pressure plate 148 to contact the sheet P. The first liquid application position B1 corresponds to the first binding position B1 to be crimped and bound by the edge binder 251, specifically, the crimper 32'.

As the application head movement motor 151 keeps rotating in the first direction after the pressure plate 148 contacts the sheet P, the coil springs 149*a* and 149*b* are compressed to further move down the application head mover 144, the holder 145, the liquid application head 146, and the columns 147*a* and 147*b*. As a result, as illustrated in FIGS. 22B and 23B, a lower face of the liquid application head 146 contacts the sheet P through the through hole 148*a*. As a result, the liquid contained in the liquid application head 146 is applied to the sheet P.

Further rotation of the application head movement motor 151 in the first direction further strongly presses the liquid application head 146 against the sheet P as illustrated in FIGS. 22C and 23C. Accordingly, the amount of liquid that is applied to the sheet P increases. In short, the liquid applier 131 changes the pressing force of the liquid application head 146 against the sheet P to adjust the amount of liquid that is applied to the sheet P.

On the other hand, the rotation of the application head movement motor 151 in the second direction opposite to the first direction moves up the application head mover 144, the holder 145, the liquid application head 146, the columns 147*a* and 147*b*, the pressure plate 148, and the coil springs 149*a* and 149*b* together. As a result, as illustrated in FIGS. 22A and 23A, the liquid application head 146 and the pressure plate 148 are separated from the sheet P. In other words, the liquid applier 131 includes the liquid application head 146 that can be separated from the sheet P.

FIG. 24 is a block diagram illustrating a hardware configuration of the post-processing apparatus 3A to control the operation of the post-processing apparatus 3A according to another embodiment of the present disclosure.

As illustrated in FIG. 24, the post-processing apparatus 3A includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the overall operation of the post-processing apparatus 3A. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs.

By an arithmetic function of the CPU 101, the post-processing apparatus 3A processes, for example, a control program stored in the ROM 103 and an information processing program (application program) loaded into the RAM 102 from a storage medium such as the HDD 104. Such processing configures a software controller including various functional modules of the post-processing apparatus 3A. The software controller thus configured cooperates with hardware resources of the post-processing apparatus 3A to construct functional blocks that implement functions of the post-processing apparatus 3A. In other words, the CPU 101, the RAM 102, the ROM 103, the HDD 104, and the I/F 105 constitute at least part of a controller 100*b* serving as a control device that controls the operation of the post-processing apparatus 3A.

The I/F 105 is an interface that connects the conveyance roller pairs 10, 11, 14, and 15, the switching member 20, the side fences 24L and 24R, the crimper movement motor 238, the crimper pivot motor 239, a contact-separation motor 32*d*, a liquid applier movement motor 137, an application head pivot motor 150, an application head movement motor 151, a standby position sensor 138, a standby angle sensor 152, a hole punch 132, and a control panel 110 to the common bus 109.

The controller 100*b* controls, via the I/F 105, the operations of the conveyance roller pairs 10, 11, 14, and 15, the switching member 20, the side fences 24L and 24R, the crimper movement motor 238, the crimper pivot motor 239, the contact-separation motor 32*d*, the liquid applier movement motor 137, the application head pivot motor 150, the application head movement motor 151, and the hole punch 132. The controller 100*b* acquires detection results from the standby position sensor 138 and the standby angle sensor 152 through the I/F 105.

Although FIG. 24 illustrates the components of the liquid applier 131 and the edge binder 251 (the crimper 32') that executes the edge binding, the components of the saddle binder 28 that executes the saddle binding are controlled by the controller 100*b* like the components of the liquid applier 131 and the edge binder 251 (the crimper 32') that executes the edge binding.

As illustrated in FIG. 26, the image forming apparatus 2 includes the control panel 110. The control panel 110 includes an operation device that receives instructions input by an operator and a display serving as a notifier that notifies the operator of information. The operation unit includes, for example, hard keys and a touch panel superimposed on a display. The control panel 110 acquires information from the user through the operation unit and provides the information to the user through the display. The post-processing apparatus 3A may include a control panel 110 similar to the above-described control panel 110 of the image forming apparatus 2.

Figure 25:
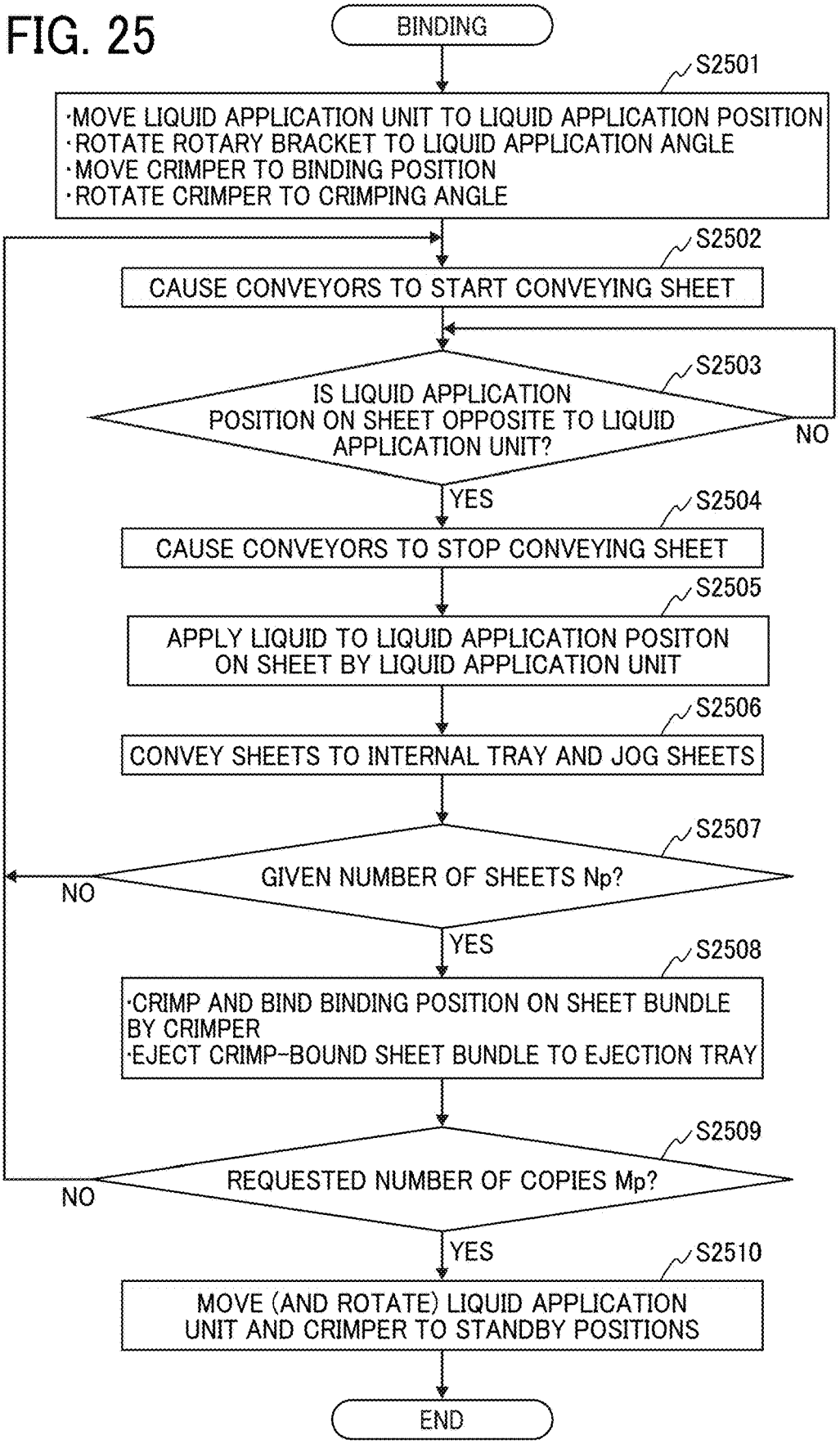
FIG. 25 is a flowchart of post-processing performed by the post-processing apparatus according to another embodiment of the present disclosure.

FIG. 25 is a flowchart of the post-processing process performed by the post-processing apparatus 3A according to another embodiment of the present disclosure. Specifically, FIG. 25 is a flowchart for when the one-point binding illustrated in FIGS. 19A to 19C is executed.

For example, the controller 100*b* executes the post-processing illustrated in FIG. 25 when the controller 100*b* acquires an instruction to execute the post-processing from the image forming apparatus 2. In the following description, the instruction to execute the post-processing may be referred to as a "post-processing command." The post-processing command includes, for example, the number of sheets P of the sheet bundle Pb (referred to as "given number of sheets Np"), the number of sheet bundles Pb to be subjected to binding processing, the first binding position B1 (corresponding to the first liquid application position B1), the angle of the first binding position B1 (corresponding to the angle of the first liquid application position B1), the type of binding process (parallel binding process or oblique binding process), and a process that is executed in parallel with the liquid application process (i.e., punching a hole in the present embodiment). In the following description, the number of sheets P of the sheet bundle Pb may be referred to as a "given number of sheets Np," and the number of sheet bundles Pb to be subjected to binding processing may be referred to as "requested number of copies Mp."

At the start of the post-processing, the liquid application unit 140 is at the standby position HP1 illustrated in FIGS. 22A to 22C whereas the rotary bracket 142 is held at the standby angle (corresponding to the parallel binding posture).

First, the controller 100*b* drives the liquid applier movement motor 137 to move the liquid application unit 140 (corresponding to a liquid applier) in the main scanning direction such that a liquid application head 146 moves from the standby position HP1 to a position where the liquid application head 146 can face the first liquid application position B1 (see FIG. 21) corresponding to the first binding position B1 illustrated in FIG. 19. If the type of the binding process instructed by the post-processing instruction is "oblique binding process," the controller 100*b* drives the application head pivot motor 150 to rotate the rotary bracket 142. Thus, the liquid application head 146 is rotated from the standby angle to the liquid application angle corresponding to the "oblique binding posture" (step S2501). It is ascertained, based on a pulse signal output from a rotary encoder of the liquid applier movement motor 137, that the liquid application head 146 has reached the position where the liquid application head 146 can face the first liquid application position B1. Similarly, it is ascertained, based on a pulse signal output from a rotary encoder of the application head pivot motor 150, that the liquid application head 146 has reached the liquid application angle. If the type of the binding process instructed by the post-processing instruction is "parallel binding process", the controller 100*b* omits the above-described operation of rotating the rotary bracket 142. In other words, the liquid application unit 140 moves in the main scanning direction while holding the rotary bracket 142 at the standby angle.

Further, the controller 100*b* drives the crimper movement motor 238 to move the crimper 32' from the standby position HP2 to the position where the crimper 32' can face the first binding position B1 as illustrated in FIGS. 19A and 19B (step S2501). Alternatively, if the type of the binding process instructed by the post-processing instruction is "oblique binding process," the controller 100*b* drives the crimper pivot motor 239 to rotate the crimper 32' from the standby angle to the crimping angle corresponding to the "oblique binding posture" (step S2501). It is ascertained, based on a pulse signal output from a rotary encoder of the crimper movement motor 238, that the crimper 32' has reached the position where the crimper 32' can face the first binding position B1. Similarly, it is ascertained, based on a pulse signal output from a rotary encoder of the crimper pivot motor 239, that the crimper 32' has reached the crimping angle.

If the type of the binding process instructed by the post-processing instruction is "parallel binding process," the controller 100*b* omits the above-described operation of rotating the crimper 32'. In other words, the crimper 32' moves in the main scanning direction while maintaining the standby angle.

Subsequently, the controller 100*b* drives the conveyance roller pairs 10 and 11 serving as conveyors to start conveying the sheet P on which an image is formed by the image forming apparatus 2 (step S2502). The controller 100*b* determines whether the first liquid application position B1 on the sheet P faces first the liquid application unit 140 (more specifically, the liquid application head 146) (step S2503). In other words, the controller 100*b* determines whether the liquid application unit 140 has faced the first liquid application position B1 on the sheet P. When the first liquid application position B1 on the sheet P has not faced the liquid application head 146 (NO in step S2503), the controller 100*b* repeats the determination in step S2503. In other words, the controller 100*b* continues driving the conveyance roller pairs 10 and 11 until the first liquid application position B1 on the sheet P faces the liquid application head 146. The controller 100*b* determines whether the liquid application position B1 on the sheet P is opposite to the liquid application unit 140 (more specifically, the liquid application head 146) (step S2503). In other words, the controller 100*b* determines whether the liquid application unit 140 is opposite to the first liquid application position B1 on the sheet P. When the controller 100*b* determines that the first liquid application position B1 on the sheet P is not opposite to the liquid application head 146 (NO in step S2503), the controller 100*b* repeats the determination in step S2503. In other words, the controller 100*b* continues driving the conveyance roller pairs 10 and 11 until the liquid application position B1 on the sheet P is opposite to the liquid application head 146. When the controller 100*b* determines that the first liquid application position B1 on the sheet P is opposite to the liquid application head 146 (YES in step S2503), the controller 100*b* the first liquid application position B1 stops the conveyance roller pairs 10 and 11 (step S2504). It is ascertained, based on a pulse signal output from a rotary encoder of a motor that drives the conveyance roller pairs 10 and 11, that the first liquid application position B1 on the sheet P has faced the liquid application head 146.

The controller 100*b* causes the liquid application unit 140 to execute the process of applying liquid to the first liquid application position B1 on the sheet P (step S2505). More specifically, the controller 100*b* rotates the application head movement motor 151 in the first direction to bring the liquid application head 146 into contact with the first liquid application position B1 on the sheet P. The controller 100*b* changes the pressing force of the liquid application head 146 (i.e., the amount of rotation or rotation speed of the application head movement motor 151) depending on the amount of liquid to be applied to the sheet P.

The amount of liquid that is applied to the sheet P may be the same for all the sheets P of the sheet bundle Pb or may be different for each sheet P. For example, the controller 100*b* may decrease the amount of liquid applied to a sheet P conveyed later. The amount of rotation of the application head movement motor 151 may be ascertained based on a pulse signal outputted from a rotary encoder of the application head movement motor 151.

The controller 100*b* drives the conveyance roller pairs 10, 11, 14, and 15 to convey and place a sheet P on the internal tray 22 (step S2506). The controller 100*b* moves the side fences 24L and 24R to align the position of the sheet bundle Pb placed on the internal tray 22 in the main scanning direction (step S2506). In short, the controller 100*b* performs so-called jogging.

The controller 100*b* determines whether the number of sheets P placed on the internal tray 22 has reached the given number of sheets Np indicated by the post-processing command (step S2507). When the controller 100*b* determines that the number of sheets P placed on the internal tray 22 has not reached the given number of sheets Np (NO in step S2507), the controller 100*b* executes the operations of steps S2502 and S2503 again until the number of sheets P placed on the internal tray 22 reaches the given number of sheets Np (YES in step S2507).

By contrast, when the controller 100*b* determines that the number of sheets P that are placed on the internal tray 22 has reached the given number of sheets Np (YES in step S2507), the controller 100*b* causes the crimper 32' to crimp the first binding position B1 (corresponding to the first liquid application position B1) on the sheet bundle Pb to which the liquid has been applied by the liquid application unit 140 (step S2508). In addition, the controller 100*b* rotates the conveyance roller pair 15 to eject the sheet bundle Pb crimped and bound (the crimp-bound sheet bundle Pb) to the ejection tray 26 (step S2508).

The controller 100*b* determines whether the number of sheet bundles Pb thus ejected to the ejection tray 26 has reached the requested number of copies Mp indicated by the binding command (step S2509). When the controller 100*b* determines that the number of the sheet bundles Pb ejected to the ejection tray 26 has not reached the requested number of copies Mp (NO in step S2509), the controller 100*b* repeats the processing of steps S2502 to S2509 until the number of the sheet bundles Pb ejected to the ejection tray 26 reaches the requested number of copies Mp (YES in step S2509).

When the controller 100*b* determines that the number of sheet bundles Pb ejected to the ejection tray 26 reaches the requested number of copies Mp (YES in step S2509), the controller 100*b* drives the liquid applier movement motor 137 to move the liquid application unit 140 to the standby position HP1 (see FIG. 21) and drives the crimper movement motor 238 to move the crimper 32' to the standby position HP2 (see FIG. 19) (step S2510). When the posture that is instructed by the post-processing operation is the "oblique binding posture," the controller 100 drives the application head pivot motor 150 and the crimper pivot motor 239 to rotate the liquid application unit 140 and crimper 32' and the parallel binding posture (standby angle) into the parallel binding posture (step S2510). By contrast, when the posture that is instructed by the post-processing operation is the "parallel binding posture," the controller 100*b* skips the aforementioned operation of rotating the liquid application unit 140 and the crimper 32' to the parallel binding posture. In steps S2501 and S2510, the execution order of the movement in the main scanning direction and the rotation in the forward and reverse directions of the liquid application unit 140 and the crimper 32' is not limited to the aforementioned order and may be reversed.

The embodiments of the present disclosure are applied to the edge binder 25 that executes the edge stitching as described above. However, the embodiments of the present disclosure may be applied to the saddle binder 28 that executes the saddle stitching.

The controller 100*b* of the post-processing apparatus 3A according to the second embodiment illustrated in FIG. 18 is provided separately from the controller 100*a* of the image forming apparatus 2 as in the configuration of FIG. 1. However, embodiments of the present disclosure are not limited to the above-described configuration. For example, as illustrated in FIG. 27A, the controller 100*b* of the post-processing apparatus 3A may be disposed in the image forming apparatus 2. Further, as in the configuration of FIG. 27B, the controller 100*b* of the post-processing apparatus 3A may be integrated with the controller 100*a* of the image forming apparatus 2.

As in the configuration of FIG. 28A, the controller 100*b* of the post-processing apparatus 3A may be divided into a controller 100*b*1 (e.g., a driver system such as a motor) and a controller 100*b*2 (a detector such as a sensor) according to the function, and the controller 100*b*2 of the post-processing apparatus 3A may be disposed in the image forming apparatus 2. Further, as in the configuration of FIG. 28B, the controller 100*b*2 of the post-processing apparatus 3A disposed in the image forming apparatus 2 may be integrated with the controller 100*a* of the image forming apparatus 2.

As described above, the control method by the controller 100*b* described above is implemented by cooperation between hardware resources of a computer and a program as computer software. In other words, the control method may be executed by causing an arithmetic device, a storage device, an input device, an output device, and a control device to operate in cooperation with each other based on a program. In addition, the program may be written in, for example, a storage device or a storage medium and distributed, or may be distributed through, for example, an electric communication line.

Embodiments of the present disclosure are not limited to the above-described embodiments, and numerous additional modifications and variations are possible in light of the teachings within the technical scope of the appended claims. It is therefore to be understood that the above-described embodiments of the present disclosure may be practiced otherwise by those skilled in the art than as specifically described herein. Such modifications are also included in the technical scope of the present disclosure.

Aspects of the present disclosure are, for example, as follows.

Aspect 1

In Aspect 1, a medium processing apparatus (for example, the post-processing apparatus 3) includes a liquid applier (for example, a liquid applier 31) and a post-processing device (for example, the crimper 32). The liquid applier applies liquid to a part of at least one medium (for example, the sheet P) of a bundle of media (for example, the sheet bundle Pb). The post-processing device performs a given process on the bundle of media including the at least one medium on which the liquid is applied by the liquid applier. The liquid applier includes a liquid application member (for example, the liquid application member 44) including an open-cell foam that contains liquid for liquid application and applies the liquid across the part of the at least one medium to a liquid application region (for example, the first liquid application the position B1, the liquid application region 820) as a region in which the liquid application member contacts the medium and a post-processing region (for example, the binding region 810, the liquid application region 820) as a region in which the given process is performed on the medium, to cause the liquid application region and the post-processing region to overlap partially.

Aspect 2

In Aspect 2, according to Aspect 1, the liquid application member is made of a material having a property of being crushable in accordance with an amount of movement of the liquid application member in liquid application.

Aspect 3

In Aspect 3, according to Aspect 1 or 2, the liquid applier includes a liquid application member mover (for example, the liquid applier movement motor 37) to move the liquid application member to be contactable and separatable relative to the medium in the liquid application, and the post-processing device includes a post-processing unit (for example, the upper crimping teeth 32*a*, the lower crimping teeth 32*b*), and a post-processing mover (for example, the contact-separation motor 32*d*) to move the post-processing unit to be contactable to and separatable from the medium in the given process.

Aspect 4

In Aspect 4, according to Aspect 3, the liquid applier causes the liquid application member to change an amount of movement of the liquid application member to the medium to adjust a size of the liquid application region to be formed on the medium.

Aspect 5

In Aspect 5, according to Aspect 3 or 4, the liquid applier includes a liquid applier positional adjuster (for example, the liquid applier positional adjustment motor 52*a*) to move the liquid application member in a direction orthogonal to a movement direction in which the liquid application member mover moves the liquid application member.

Aspect 6

In Aspect 6, according to any one of Aspects 1 to 5, the liquid applier forms the liquid application region in the post-processing region by contacting the liquid application member with a downstream side of the liquid application region in a turning direction of the medium when the medium of the bundle of media is turned.

Aspect 7

In Aspect 7, according to any one of Aspects 1 to 6, the post-processing device is a crimper (for example, the crimper 32) that press and deform the bundle of media to bind the bundle of media.

Aspect 8

In Aspect 8, according to any one of Aspects 1 to 7, the liquid application member has a contact face (for example, the sheet contact faces 441*a*, 441*b*, 441*c*), and the contact face of the liquid application member straddles multiple convex portions and multiple concave portions in the post-processing region on the bundle of media formed by the crimper.

Aspect 9

In Aspect 9, an image forming system (for example, the image forming system 1) includes an image forming apparatus (for example, the image forming apparatus 2) and the medium processing apparatus (for example, the post-processing apparatus 3) according to any one of Aspects 1 to 8. The image forming apparatus forms an image on a medium (for example, the sheet P). The medium processing apparatus binds a bundle of media (for example, the sheet bundle Pb) including the medium (for example, the sheet P) on which the image is formed by the image forming apparatus by pressing and deforming the media.

Aspect 10

In Aspect 10, a medium processing apparatus (for example, the post-processing apparatus 3) includes a liquid applier (for example, the liquid applier 31) and a post-processing device (for example, the crimper 32). The liquid applier includes a liquid application member (for example, the liquid application member 44) including a foam containable a liquid to apply the liquid to a liquid application region (for example, the binding position B1, the liquid application region 820) in a part of at least one medium (for example, the sheet P) of a bundle of media (for example, the sheet bundle Pb). The post-processing device performs a given process on a post-processing region in the part of at least one medium having the liquid application region on which the liquid is applied by the liquid applier. The liquid applier applies the liquid to the liquid application region overlapped with at least a part of the post-processing region (for example, the post-processing region 810, the liquid application region 820).

Aspect 11

In Aspect 11, according to Aspect 10, the liquid application member (for example, the liquid application member 44) deforms in accordance with the liquid application member pushed toward the part of at least one medium (for example, the sheet P) in a liquid application process.

Aspect 12

In Aspect 12, according to Aspect 10 or 11, the liquid applier (for example, the liquid applier 31) includes a first mover (for example, the liquid applier movement motor 37) to move the liquid application member (for example, the liquid application member 44) relative to the part of at least one medium (for example, the sheet P) in one direction to cause the liquid application member to contact with or separated from the part of at least one medium in a liquid application process, and the post-processing device (for example, the crimper 32) includes a post-processing unit (for example, the upper crimping teeth 32*a*, the lower crimping teeth 32*b*) to perform the given process on the post-processing region (for example, the binding region 810, the liquid application region 820), and a second mover (for example, the contact-separation motor 32*d*) to move the post-processing unit relative to the part of at least one medium in the one direction to cause the post-processing region to contact with or separated from the part of at least one medium in the given process.

Aspect 13

In Aspect 13, the medium processing apparatus (for example, the post-processing apparatus 3) according to Aspect 12 further includes circuitry (for example, the controller 100*b*) to cause the first mover (for example, the liquid applier movement motor 37) to change an amount of movement of the liquid application member (for example, the liquid application member 44) to the part of at least one medium (for example, the sheet P) in the one direction to adjust a size of the liquid application region (for example, the liquid application region B1, 820) formed on the part of at least one medium.

Aspect 14

In Aspect 14, according to Aspect 12 or 13, the liquid applier (for example, the liquid applier 31) further includes an adjuster (for example, the liquid applier positional adjustment motor 52*a*) to move the liquid application member (for example, the liquid application member 44) in another direction orthogonal to the one direction.

Aspect 15

In Aspect 15, according to any one of Aspects 10 to 14, the liquid applier (for example, the liquid applier 31) cause the liquid application member (for example, the liquid application member 44) to contact with a downstream part of the post-processing region (for example, the binding region 810, the liquid application region 820) in a turning direction of the at least one medium (for example, the sheet P) to form the liquid application region having a part overlapped with the downstream part of the post-processing region.

Aspect 16

In Aspect 16, according to any one of Aspects 10 to 15, the post-processing device (for example, the crimper 32) includes a crimper (for example, the crimper 32) to press and deform the bundle of media (for example, the sheet bundle Pb) to bind the bundle of media in a post-processing process.

Aspect 17

In Aspect 17, according to any one of Aspects 10 to 16, the crimper (for example, the crimper 32) has crimping teeth (for example, the upper crimping teeth 32*a*, the lower crimping teeth 32*b*) to from multiple convex and concave portions in the post-processing region (for example, the binding region 810, the liquid application region 820) on the bundle of media (for example, the sheet bundle Pb), and the liquid application member (for example, the liquid application member 44) having a contact face (for example, the sheet contact faces 441*a*, 441*b*, 441*c*) contactable with the part of at least one medium (for example, the sheet P) covering the multiple convex and concave portions in the post-processing process.

Aspect 18

In Aspect 18, an image forming system (for example, the image forming system 1) includes an image forming apparatus (for example, the image forming apparatus 2) and the medium processing apparatus (for example, the post-processing apparatus 3) according to any one of Aspects 10 to 17. The image forming apparatus forms an image on a medium (for example, the sheet P). The medium processing apparatus binds a bundle of media (for example, the sheet bundle Pb) including the medium (for example, the sheet P) on which the image is formed by the image forming apparatus by pressing and deforming the media.

Aspect 19

In Aspect 19, according to Aspect 10, the liquid applier (for example, the liquid applier 31) does not form the liquid application region (for example, the liquid application region B1, the liquid application region 820) outside the post-processing region (for example, the post-processing region 810, the liquid application region 820) and form the liquid application region inside the post-processing region.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A medium processing apparatus comprising:

a liquid applier configured to apply a liquid to a liquid application region in a part of at least one medium of a bundle of media, the liquid application region corresponding to a region of the at least one medium of the bundle of media to which the liquid spreads; and a post-processing device configured to perform a predetermined binding process on a binding region of the bundle of media, wherein the liquid applier is configured to apply the liquid to the liquid application region, the liquid application region partially overlapped, but not fully overlapped, by the binding region.

2. The medium processing apparatus according to claim 1, wherein the liquid applier includes a liquid application member configured to apply the liquid to the liquid application region, and the liquid application member is configured to deform in accordance with the liquid application member being pushed toward the part of the at least one medium in a liquid application process.

3. The medium processing apparatus according to claim 1, wherein the liquid applier includes a liquid applier mover configured to move a liquid application member relative to the part of the at least one medium in one direction to cause the liquid application member to contact with or separate from the part of the at least one medium in a liquid application process.

4. The medium processing apparatus according to claim 3, wherein the liquid applier further includes an adjuster configured to move the liquid application member in another direction orthogonal to the one direction, said another direction corresponding to a conveyance direction of the at least one medium.

5. The medium processing apparatus according to claim 1, wherein the post-processing device includes a crimper configured to press and deform the bundle of media to bind the bundle of media in a post-processing process.

6. The medium processing apparatus according to claim 5, wherein the crimper has crimping teeth to form multiple convex and concave portions in the binding region on the bundle of media, and a liquid application member having a contact face contactable with the part of the at least one medium covering the multiple convex and concave portions in the post-processing process.

7. An image forming system comprising:

an image forming apparatus configured to form an image on the at least one medium; and the medium processing apparatus according to claim 1 configured to press and deform the bundle of media on which the image is formed by the image forming apparatus to bind the bundle of media.

8. The medium processing apparatus according to claim 1, wherein the post-processing device includes:

a post-processing unit configured to perform the predetermined binding process on a post-processing region; and a post-processing unit mover configured to move the post-processing unit relative to the part of the at least one medium in a particular direction to cause the post-processing region to contact with or separate from the part of the at least one medium in the predetermined binding process.

9. The medium processing apparatus according to claim 1, further comprising:

a movement motor configured to move the post-processing device and the liquid applier in a width direction of the at least one medium.

10. The medium processing apparatus according to claim 1, further comprising:

circuitry configured to cause the liquid applier to apply a desired amount of the liquid to the liquid application region in the part of the at least one medium based on a type of the at least one medium and a number of media included in the bundle of media.

11. A medium processing apparatus comprising:

a liquid applier including a liquid applier mover to move a liquid application member relative to a part of at least one medium of a bundle of media in one direction to cause the liquid application member to contact with or separate from the part of the at least one medium in a liquid application process, the liquid applier configured to:

apply a liquid to a liquid application region in the part of the at least one medium; and apply the liquid to the liquid application region overlapped with at least a part of a post-processing region;

a post-processing device configured to perform a given process on the post-processing region in the part of the at least one medium having the liquid application region on which the liquid is applied by the liquid applier; and circuitry configured to cause the liquid applier mover to change an amount of movement of the liquid application member to the part of the at least one medium in the one direction to adjust a size of the liquid application region formed on the part of the at least one medium.

12. An image forming system comprising:

an image forming apparatus configured to form an image on the at least one medium; and the medium processing apparatus according to claim 11 configured to press and deform the bundle of media on which the image is formed by the image forming apparatus to bind the bundle of media.

13. The medium processing apparatus according to claim 11, further comprising:

a movement motor configured to move the post-processing device and the liquid applier in a width direction of the at least one medium.

14. The medium processing apparatus according to claim 11, wherein the circuitry is further configured to cause the liquid applier to:

apply a desired amount of the liquid to the liquid application region in the part of the at least one medium based on a type of the at least one medium and a number of media included in the bundle of media.

15. A medium processing apparatus comprising:

a liquid applier configured to apply a liquid to a liquid application region in a part of at least one medium of a bundle of media; and a post-processing device to perform a given process on a post-processing region in the part of the at least one medium having the liquid application region on which the liquid is applied by the liquid applier, wherein the liquid applier is configured to cause a liquid application member to contact a downstream part of the post-processing region in a turning direction of the at least one medium to form the liquid application region having a part overlapped with the downstream part of the post-processing region.

16. An image forming system comprising:

an image forming apparatus configured to form an image on the at least one medium; and the medium processing apparatus according to claim 15 configured to press and deform the bundle of media on which the image is formed by the image forming apparatus to bind the bundle of media.

17. The medium processing apparatus according to claim 15, further comprising:

a movement motor configured to move the post-processing device and the liquid applier in a width direction of the at least one medium.

18. The medium processing apparatus according to claim 15, further comprising:

circuitry configured to cause the liquid applier to apply a desired amount of the liquid to the liquid application region in the part of the at least one medium based on a type of the at least one medium and a number of media included in the bundle of media.

* * * * *